US007544886B2

(12) United States Patent
Detian et al.

(10) Patent No.: US 7,544,886 B2
(45) Date of Patent: Jun. 9, 2009

(54) EXTRA-FINE COPPER ALLOY WIRE, EXTRA-FINE COPPER ALLOY TWISTED WIRE, EXTRA-FINE INSULATED WIRE, COAXIAL CABLE, MULTICORE CABLE AND MANUFACTURING METHOD THEREOF

(75) Inventors: Huang Detian, Hitachi (JP); Hiromitsu Kuroda, Hitachi (JP); Hakaru Matsui, Hitachi (JP); Osamu Seya, Hitachi (JP); Ryohei Okada, Hitachi (JP); Shinichi Masui, Takahagi (JP); Ryuji Nakagawa, Tokaimura (JP); Hiroshi Okikawa, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 330 days.

(21) Appl. No.: 11/641,934

(22) Filed: Dec. 19, 2006

(65) Prior Publication Data

US 2007/0187134 A1 Aug. 16, 2007

(30) Foreign Application Priority Data

Dec. 20, 2005 (JP) ..... 2005-366566
Dec. 20, 2005 (JP) ..... 2005-366567
Dec. 20, 2005 (JP) ..... 2005-366568

(51) Int. Cl.
*H01B 11/06* (2006.01)

(52) U.S. Cl. ..... 174/36; 174/28; 174/110 R; 174/113 R

(58) Field of Classification Search ..... 174/36, 174/110 R, 113 R, 106 R, 102 R, 102 C, 174/103 C, 28
See application file for complete search history.

(56) References Cited

U.S. PATENT DOCUMENTS

| | | | | |
|---|---|---|---|---|
| 5,106,701 | A * | 4/1992 | Kurosaka et al. | 428/606 |
| 6,063,217 | A * | 5/2000 | Saleh et al. | 148/682 |
| 6,417,445 | B1 * | 7/2002 | Sato et al. | 174/36 |
| 2002/0066503 | A1 * | 6/2002 | Matsui et al. | 148/432 |
| 2003/0037957 | A1 * | 2/2003 | Ueno et al. | 174/128.1 |
| 2004/0187977 | A1 * | 9/2004 | Matsui et al. | 148/553 |
| 2004/0231883 | A1 * | 11/2004 | Kondo et al. | 174/128.1 |

FOREIGN PATENT DOCUMENTS

| | | |
|---|---|---|
| JP | 2001-40439 | 2/2001 |
| JP | 2001-234309 | 8/2001 |

* cited by examiner

*Primary Examiner*—William H Mayo, III
(74) *Attorney, Agent, or Firm*—Scully, Scott, Murphy & Presser, P.C.

(57) ABSTRACT

An extra-fine copper alloy wire has: a wire diameter of 0.010 to 0.025 mm; 1 to 3 weight % of silver (Ag), and a balance consisting copper (Co) and an inevitable impurity; a tensile strength of not less than 850 MPa; an electrical conductivity of not less than 85% IACS; an elongation of 0.5 to 3.0%; and a lowering rate in tensile strength of not more than 2%. The lowering rate is represented by $[(1-\sigma_{h1}/\sigma_{h0})\times 100\%]$ where $\sigma_{h1}$ is a tensile strength of the wire measured after a heat treatment under conditions of a heating temperature of not more than 350° C. and a heating time of not more than 5 seconds, and $\sigma_{h0}$ is a tensile strength of the wire measured before the heat treatment.

18 Claims, 18 Drawing Sheets

EXTRA-FINE COPPER ALLOY WIRE, EXTRA-FINE COPPER ALLOY TWISTED WIRE, EXTRA-FINE INSULATED WIRE, COAXIAL CABLE, MULTICORE CABLE AND MANUFACTURING METHOD THEREOF

The present application is based on Japanese patent application Nos. 2005-366566, 2005-366567, and 2005-366568, the entire contents of which are incorporated herein by reference.

BACKGROUND OF THE INVENTION

1. Field of the Invention

This invention relates to an extra-fine copper alloy wire, an extra-fine copper alloy twisted wire, an extra-fine insulated wire, a coaxial cable, and a multicore cable. In particular, this invention relates to the extra-fine copper alloy wire, an extra-fine copper alloy twisted wire, an extra-fine insulated wire, a coaxial cable, and a multicore cable that have both of a high mechanical strength and a high electrical conductivity, and also have a high heat resistance to suppress a reduction in its mechanical strength even in a heat load work such as an extrusion work, an foam extrusion work and a soldering work. Also, this invention relates to methods of making the extra-fine copper alloy wire, the extra-fine copper alloy twisted wire, the extra-fine insulated wire, the coaxial cable, and the multicore cable.

2. Description of the Related Art

Copper alloys with a high mechanical strength and a high electrical conductivity are generally used as conductor materials of flexing cables for an electric device such as a robot cable, and for a medical device such as a probe cable.

At present, mass-produced copper alloy wires are formed of a Cu—Sn alloy wire and a Cu—Sn—In alloy wire which are applicable to continuous casting and rolling, and excellent in economic efficiency and which are in wide use as conductor materials of the flexing cables for the electric device and the medical device. The other copper alloy wires are also applied to various fields according to the product cost and various characteristics of copper alloy wire.

In recent years, conductors with $\phi$0.03 mm or less have been required according as the electric device is reduced in size and weight and as the medical device is downsized. In particular, according as a head portion of an ultrasonic endoscope is sophisticated, a cable for the ultrasonic endoscope tends to increase in number of cores (e.g., 200 to 260 cores). On the other hand, the head portion is required to decrease in diameter to mitigate the pain of a patient. In case of a curl cable etc. used for performing an intravascular operation approaching from a vascular space to an affected part, the downsizing of the diameter is also required.

Further, recently, the development of conductor materials to satisfy both a high mechanical strength and a high electrical conductivity as well as the reduced diameter has been desired to improve its flexibility and to increase its transmission capacity.

The Cu—Sn alloy wire and the Cu—Sn—In alloy wire as described above are formed of a copper alloy produced by adding tin (Sn) to a tough pitch copper as a base metal. However, since the amount of Sn added need to be increased to enhance the mechanical strength of the Cu—Sn alloy wire, the electrical conductivity must be lowered. Thus, it is difficult to satisfy both the mechanical strength and the electrical conductivity.

In recent years, a Cu—Ag alloy has drawn attention as a copper alloy to satisfy both the mechanical strength and the electrical conductivity. The Cu—Ag alloy excellent in mechanical strength and electrical conductivity is produced, for example, by (1) casting a Cu—Ag alloy with a Ag content of 1.0 to 15 weight % and then cold-working the cast Cu—Ag alloy to an area reduction of 70% or more, (2) conducting a heat treatment at 400 to 500° C. for 1 to 230 hours, and (3) cold-working it to an area reduction of 95% or more (See JP-A-2001-40439).

Further, a method of making an extra-fine copper alloy twisted wire is known which is conduced by adding 0.1 to 1.0 weight % of silver to a pure copper to have a Cu—Ag alloy, forming a single wire with a diameter of 0.01 to 0.08 mm and a tensile strength of 600 MPa or more from the alloy, twisting a predetermined number of the wires together, and conducting a heat treatment to the twisted wire to remove distortion thereof (See JP-A-2001-234309).

In case of using the extra-fine copper alloy wire formed of Cu—Ag alloy as a flexing cable, an insulating material is generally extruded to cover it. In this extruding, the insulating material is heated to cause a heat load to the extra-fine copper alloy wire. Therefore, required as characteristics for the extra-fine copper alloy wire is not only the mechanical strength and the electrical conductivity but also a heat stability that the strength is not lowered by a heat history in the extruding.

For example, the insulating material with a melting point of approx. 300° C. is generally extruded to cover it. Thus, in the extruding, the mechanical property thereof, especially, the tensile strength is lowered by heat (e.g., 300 to 380° C.) of the insulating material and an extruder head part during the covering process. Further, in the terminal processing, the tensile strength of a terminal portion of the extra-fine copper alloy wire is significantly lowered by a heat of soldering iron at approx. 300 to 350° C. during the soldering. Therefore, after the extruding or the soldering, it may be difficult to satisfy both the electrical property and the mechanical property. The mechanical reliability of the cable and the cable terminal work portion may be significantly damaged by the lowering of, especially, the tensile strength.

In case of a coaxial cable with a low capacitance, a foamed insulating material is generally extruded and covered it at its melting point of approx. 300° C. In the extruding process, the mechanical property of the extra-fine copper alloy wire, in particular, the tensile strength is lowered by heat (e.g., 300 to 380° C.) of the insulating material and an extruder head part during the covering process. In the terminal processing, the tensile strength of a terminal portion of the extra-fine copper alloy wire is significantly lowered by a heat of a soldering iron at approx. 300 to 350° C. during the soldering. Therefore, after the extruding and the soldering, it may be difficult to satisfy both the electrical property and the mechanical property. The mechanical reliability of the cable and the cable terminal work portion may be significantly damaged by the lowering of, especially, the tensile strength.

Further, an extra-fine wire with a diameter of about 0.025 mm or less is used for a probe cable of a ultrasonic diagnostic equipment and for a ultrasonic endoscope cable, where an electrical resistance corresponding to a conductor size becomes problematic. For example, such an extra-fine copper alloy twisted wire needs to satisfy truly both a reduced diameter and an enhanced electric property need while complying with the AWG (American Wire Gauge) standards. A relationship between the AWG standards and the twisted wire structure (i.e., number of twisted wires/wire diameter) needs to be 42 AWG (7/0.025), 43 AWG (7/0.023), 44 AWG (7/0.020), 45 AWG (7/0.018), 46 AWG (7/0.016), 48 AWG (7/0.013), 50 AWG (7/0.010).

However, although the Cu—Ag alloy in JP-A-2001-234309 satisfies both the tensile strength and the electrical conductivity, the heat treatment needs to be conducted at a specific temperature for the long time (1 to 30 hours) so that the production efficiency is reduced to increase the manufacturing cost. JP-A-2001-234309 does not teach the lowering of the strength caused by the heat history when a heat load is applied thereto in the extruding process, and does not show any measures for it. Further, it does not teach the electrical resistance corresponding to the extra-fine conductor size.

Although JP-A-2001-234309 discloses the extra-fine copper alloy twisted wire that comprises silver as an additional element to the copper alloy, the silver content is as low as 0.1 to 1.0 weight % so that improvement of the tensile strength can not be expected. In this extra-fine copper alloy twisted wire, an elongation of 5% or more is secured to improve its flexibility in plastic distortion region, but the tensile strength must be lowered under such a property emphasizing the elongation. Therefore, the strength and the flexibility become inadequate for use as an electronics device cable or a medical device cable using extra-fine wires with a diameter of 0.025 mm or less, such as a probe cable of a ultrasonic diagnostic instrument and as ultrasonic endoscope cable.

SUMMARY OF THE INVENTION

It is an object of the invention to provide an extra-fine copper alloy wire, and an extra-fine copper alloy twisted wire that have extra-fine wires with a final wire diameter of not more than 0.025 mm, both a high mechanical strength and a low electrical resistance (a high electrical conductivity), and also have a high heat resistance to suppress a reduction in its mechanical strength even in a heat load work such as an extrusion process, and to provide manufacturing methods thereof.

It is a further object of the invention to provide an extra-fine insulated wire, a coaxial cable, and a multicore cable that have both a high mechanical strength and a low electrical resistance (a high electrical conductivity), and also have a high heat resistance to suppress a reduction in its mechanical strength even in a heat load work such as an extrusion making process and a soldering work at a terminal portion, and to provide manufacturing methods thereof.

It is a furthermore object of the invention to provide a coaxial cable and a multicore cable that have both a high strength characteristic and a low electrical resistance (a high electrical conductivity), and also have a high heat resistance to suppress a reduction in its mechanical strength even in a heat load work such as a foam extrusion process and a soldering work at a terminal portion, and to provide manufacturing methods thereof.

(1) According to one aspect of the invention, an extra-fine copper alloy wire comprises:

a wire diameter of 0.010 to 0.025 mm;

1 to 3 weight % of silver (Ag), and a balance consisting copper (Co) and an inevitable impurity;

a tensile strength of not less than 850 MPa;

an electrical conductivity of not less than 85% IACS;

an elongation of 0.5 to 3.0%; and a lowering rate in tensile strength of not more than 2%, the lowering rate being represented by $[(1-\sigma_{h1}/\sigma_{h0})\times 100\%]$ where $\sigma_{h1}$ is a tensile strength of the wire measured after a heat treatment under conditions of a heating temperature of not more than 350° C. and a heating time of not more than 5 seconds, and $\sigma_{h0}$ is a tensile strength of the wire measured before the heat treatment.

In the above invention (1), the following modifications and changes can be made.

(i) The extra-fine copper alloy wire further comprises:

a plated layer comprising tin (Sn), silver (Ag) or nickel (Ni) and formed on a surface of the extra-fine copper alloy wire.

(2) According to another aspect of the invention, an extra-fine copper alloy twisted wire comprises:

a plurality of the extra-fine copper alloy wires according to the invention (1) twisted together.

In the above invention (2), the following modifications and changes can be made.

(ii) The plurality of the extra-fine copper alloy wires comprise the seven extra-fine copper alloy wires with a wire diameter of 0.025 mm, and the twisted wire comprises an electric resistance of not more than 6000 Ω/km at 20° C.

(iii) The plurality of the extra-fine copper alloy wires comprise the seven extra-fine copper alloy wires with a wire diameter of 0.023 mm, and the twisted wire comprises an electric resistance of not more than 7000 Ω/km at 20° C.

(iv) The plurality of the extra-fine copper alloy wires comprise the seven extra-fine copper alloy wires with a wire diameter of 0.020 mm, and the twisted wire comprises an electric resistance of not more than 9500 Ω/km at 20° C.

(v) The plurality of the extra-fine copper alloy wires comprise the seven extra-fine copper alloy wires with a wire diameter of 0.018 mm, and the twisted wire comprises an electric resistance of not more than 11500 Ω/km at 20° C.

(vi) The plurality of the extra-fine copper alloy wires comprise the seven extra-fine copper alloy wires with a wire diameter of 0.016 mm, and the twisted wire comprises an electric resistance of not more than 15000 Ω/km at 20° C.

(vii) The plurality of the extra-fine copper alloy wires comprise the seven extra-fine copper alloy wires with a wire diameter of 0.013 mm, and the twisted wire comprises an electric resistance of not more than 22000 Ω/km at 20° C.

(viii) The plurality of the extra-fine copper alloy wires comprise the seven extra-fine copper alloy wires with a wire diameter of 0.010 mm, and the twisted wire comprises an electric resistance of not more than 38000 Ω/km at 20° C.

(3) According to another aspect of the invention, a coaxial cable comprises:

a central conductor comprising a plurality of the extra-fine copper alloy wires according to the invention (1) twisted together;

an insulation cover formed on an outer circumference of the central conductor;

an outer conductor comprising a copper or a copper alloy formed on an outer circumference of the insulation cover; and a jacket layer formed on an outer circumference of the outer conductor.

(4) According to another aspect of the invention, a multicore cable comprises:

a shield layer;

a plurality of the coaxial cables according to the invention (3) disposed in the shield layer; and a sheath formed on an outer circumference of the shield layer.

(5) According to another aspect of the invention, a method of making an extra-fine copper alloy wire comprises the steps of:

adding 1 to 3 weight % of silver to a pure copper so as to produce a copper alloy;

conducting a wire drawing work to the copper alloy to form an extra-fine copper alloy wire with a wire diameter of 0.010 to 0.025 mm; and conducting a heat treatment to the extra-fine copper alloy wire at a temperature of 300 to 500° C. for 0.2 to 5 seconds such that the extra-fine copper alloy wire comprises a tensile strength of 850 MPa or more, an electrical conductivity of 85% IACS or more, an elongation of 0.5 to 3.0%, and a lowering rate in tensile strength of not more than 2%, the lowering rate being represented by $[(1-\sigma_{h1}/\sigma_{h0})\times 100\%]$ where $\sigma_{h1}$ is a tensile strength of the wire measured after a test heat treatment under conditions of a heating temperature of not more than 350° C. and a heating time of not more than 5 seconds, and $\sigma_{h0}$ is a tensile strength of the wire measured the test heat treatment.

In the above invention (5), the following modifications and changes can be made.

(ix) The method further comprises the step of:

after forming the extra-fine wire with a wire diameter of 0.010 to 0.025 mm, forming a plated layer formed of tin (Sn), silver (Ag) or nickel (Ni) on a surface of the extra-fine copper alloy wire.

(6) According to another aspect of the invention, a method of an extra-fine copper alloy twisted wire comprises the steps of:

adding 1 to 3 weight % of silver to produce a copper alloy;

conducting a wire drawing work to the copper alloy to form an extra-fine copper alloy wire with a wire diameter of 0.010 to 0.025 mm;

twisting a plurality of the extra-fine copper alloy wires together to form an extra-fine copper alloy twisted wire; and conducting a heat treatment to the twisted wire at a temperature of 300 to 500° C. for 0.2 to 5 seconds.

(7) According to another aspect of the invention, an extra-fine insulated wire comprises:

an extra-fine copper alloy twisted wire comprising a plurality of copper alloy wires with a wire diameter of 0.010 to 0.025 mm twisted together, each of the copper alloy wires comprising 1 to 3 weight % of silver (Ag) and a balance consisting of a copper and an inevitable impurity, the copper alloy twisted wire further comprising a tensile strength of not less than 850 MPa, and an electrical conductivity of not less than 85% IACS; and a solid insulation with a thickness of not more than 0.07 mm formed on an outer circumference of the extra-fine insulated wire.

In the above invention (7), the following modifications and changes can be made.

(x) The extra-fine copper alloy twisted wire is heat-treated, and comprises a lowering rate in electric resistance of not less than 6% after the heat treatment and a lowering rate in tensile strength of not more than 20% after the heat treatment.

(xi) The extra-fine insulated wire further comprises:

a plated layer comprising tin (Sn), silver (Ag) or nickel (Ni) and formed on a surface of the extra-fine copper alloy wire.

(8) According to another aspect of the invention, a coaxial cable comprises:

an outer conductor comprising a plurality of conductor wires wound on an outer circumference of the extra-fine insulated wire according to the invention (7) along a longitudinal direction thereof in a spiral form; and a jacket layer formed on a surface of the outer conductor.

In the above invention (8), the following modifications and changes can be made.

(xii) The copper alloy wire composing the extra-fine insulated wire comprises a wire diameter of more than 0.021 mm and not more than 0.025 mm, and the coaxial cable comprises an electric resistance of not more than 7200 Ω/km, a capacitance of 100 to 130 pF/m, an attenuation of 0.6 to 1.0 dB/m (at a frequency of 10 MHz), and a bending life of not less than 20000 times under conditions of a bend (R)=2 mm and a load=50 g.

(xiii) The copper alloy wire composing the extra-fine insulated wire comprises a wire diameter of more than 0.018 mm and not more than 0.022 mm, and the coaxial cable comprises an electric resistance of not more than 9500 Ω/km, a capacitance of 100 to 130 pF/m, an attenuation of 0.8 to 1.2 dB/m (at a frequency of 10 MHz), and a bending life of not less than 20000 times under conditions of a bend (R)=2 mm and a load=50 g.

(xiv) The copper alloy wire composing the extra-fine insulated wire comprises a the wire diameter of more than 0.016 mm and not more than 0.020 mm, and the coaxial cable comprises an electric resistance of not more than 12200 Ω/km, a capacitance of 100 to 130 pF/m, an attenuation of 1.0 to 1.5 dB/m (at a frequency of 10 MHz), and a bending life of not less than 20000 times under conditions of a bend (R)=2 mm and a load=50 g.

(xv) The copper alloy wire composing the extra-fine insulated wire comprises a wire diameter of more than 0.014 mm and not more than 0.018 mm, and the coaxial cable comprises an electric resistance of not more than 14700 Ω/km, a capacitance of 100 to 130 pF/m, an attenuation of 1.1 to 1.6 dB/m (at a frequency of 10 MHz), and a bending life of not less than 30000 times under conditions of a bend (R)=2 mm and a load=50 g.

(xvi) The copper alloy wire composing the extra-fine insulated wire comprises a wire diameter of more than 0.013 mm and not more than 0.017 mm, and the coaxial cable comprises an electric resistance of not more than 16500 Ω/km, a capacitance of 100 to 130 pF/m, an attenuation of 1.1 to 1.6 dB/m (at a frequency of 10 MHz), and a bending life of not less than 30000 times under conditions of a bend (R)=2 mm and a load=20 g.

(xvii) The copper alloy wire composing the extra-fine insulated wire comprises a wire diameter of more than 0.011 mm and not more than 0.015 mm, and the coaxial cable comprises an electric resistance of not more than 22500 Ω/km, a capacitance of 100 to 130 pF/m, an attenuation of 1.7 to 2.4 dB/m (at a frequency of 10 MHz), and a bending life of not less than 30000 times under conditions of a bend (R)=2 mm and a load=20 g.

(xviii) The copper alloy wire composing the extra-fine insulated wire comprises a wire diameter of more than 0.008 mm and not more than 0.012 mm, and the coaxial cable comprises an electric resistance of not more than 38000 Ω/km, a capacitance of 100 to 130 pF/m, an attenuation of 2.5 to 3.8 dB/m (at a frequency of 10 MHz), and a bending life of not less than 10000 times under conditions of a bend (R)=2 mm and a load=20 g.

(9) According to another aspect of the invention, a method of making an extra-fine insulated wire comprises the steps of:

adding 1 to 3 weight % of silver to a pure copper to produce a copper alloy;

conducting a wire drawing work to the copper alloy to form an extra-fine copper alloy wire comprising a wire diameter of 0.010 to 0.025 mm;

twisting a plurality of the extra-fine copper alloy wires together to obtain an extra-fine copper alloy twisted wire;

conducting a heat treatment the twisted wire at a temperature of 300 to 500° C. for 0.2 to 5 seconds; and forming a solid insulation comprising a thickness of not more than 0.07 mm on an outer circumference of the extra-fine copper alloy twisted wire.

(10) According to another aspect of the invention, a method of making a coaxial cable comprises the steps of:

adding 1 to 3 weight % of silver to a pure copper to produce a copper alloy;

conducting a wire drawing work to the copper alloy to form an extra-fine wire comprising a wire diameter of 0.010 to 0.025 mm;

twisting a plurality of the extra-fine copper alloy wires together to obtain an extra-fine copper alloy twisted wire;

conducting a heat treatment to the twisted wire at a temperature of 300 to 500° C. for 0.2 to 5 seconds;

forming a solid insulation comprising a thickness of not more than 0.07 mm on an outer circumference of the extra-fine copper alloy twisted wire to obtain an extra-fine insulated wire;

winding a plurality of conductor wires on an outer circumference of the extra-fine insulated wire along a longitudinal direction thereof in a spiral form to form an outer-conductor; and forming a jacket layer on a surface of the outer conductor.

(11) According to another aspect of the invention, a multicore cable comprises:

a tension member or a central interposition; and a plurality of the coaxial cables according to the invention (8) twisted together on an outer circumference of the tension member or the central interposition.

(12) According to another aspect of the invention, a multicore cable comprises:

a tension member or an central interposition; and a coaxial cable and the extra-fine insulated wire according to the invention (7) twisted together on an outer circumference of the tension member or the central interposition, wherein the coaxial cable comprises an outer conductor comprising a plurality of conductor wires wound on an outer circumference of the extra-fine insulated wire according to the invention (7) along a longitudinal direction thereof in a spiral form, and a jacket layer formed on a surface of the outer conductor.

(13) According to another aspect of the invention, a multicore cable comprises:

a tension member or an central interposition; and a plurality of the extra-fine insulated wires according to the invention (7) twisted together on an outer circumference of the tension member or the central interposition.

(14) According to another aspect of the invention, a multicore cable comprises:

a tension member or an central interposition; and a plurality of coaxial cable units comprising a plurality of the coaxial cables according to the invention (8) bundled together and twisted together on an outer circumference of the tension member or the central interposition.

(15) According to another aspect of the invention, a multicore cable comprises:

a central conductor wire, and a plurality of the extra-fine insulated wires according to the invention (7) wound on the central conductor wire at a constant pitch.

(16) According to another aspect of the invention, a multicore cable comprises:

a plurality of the coaxial cables according to the invention (8) juxtaposed at a constant pitch.

(17) According to another aspect of the invention, a coaxial cable comprises:

an extra-fine copper alloy twisted wire comprising seven copper alloy wires each of which comprises a wire diameter of 0.010 to 0.025 mm, and 1 to 3 weight % of silver (Ag) and a balance consisting of copper and an inevitable impurity, the twisted wire further comprising a tensile strength of not less than 850 MPa, and an electrical conductivity of not less than 85% IACS;

a foamed insulation formed on an outer circumference of the extra-fine copper alloy twisted wire;

an outer conductor comprising a plurality of conductor wires wound on an outer circumference of the foamed insulation along a longitudinal direction thereof in a spiral form; and a jacket layer formed on a surface of the outer conductor.

In the above invention (17), the following modifications and changes can be made.

(xix) The extra-fine copper alloy twisted wire is heat-treated, and comprises a lowering rate in electric resistance of not less than 6% after the heat treatment and a lowering rate in tensile strength of not more than 20% after the heat treatment.

(xx) The coaxial cable further comprises:

a plated layer comprising tin (Sn), silver (Ag) or nickel (Ni) and formed on a surface of the extra-fine copper alloy wire.

(xxi) The copper alloy wire comprises a wire diameter of more than 0.021 mm and not more than 0.025 mm, and the coaxial cable comprises an electric resistance of not more than 7500 Ω/km, and a capacitance of 30 to 80 pF/m.

(xxii) The copper alloy wire comprises a wire diameter of more than 0.018 mm and not more than 0.022 mm, and the coaxial cable comprises an electric resistance of not more than 10000 Ω/km, and a capacitance of 30 to 80 pF/m.

(xxiii) The copper alloy wire comprises a wire diameter of more than 0.016 mm and not more than 0.020 mm, and the coaxial cable comprises an electric resistance of not more than 13000 Ω/km, and a capacitance of 30 to 80 pF/m.

(xxiv) The copper alloy wire comprises a wire diameter of more than 0.014 mm and not more than 0.018 mm, and the coaxial cable comprises an electric resistance of not more than 15500 Ω/km, and a capacitance of 30 to 80 pF/m.

(xxv) The copper alloy wire comprises a wire diameter of more than 0.013 mm and not more than 0.017 mm, and the coaxial cable comprises an electric resistance of not more than 17000 Ω/km, and a capacitance of 30 to 80 pF/m.

(xxvi) The copper alloy wire comprises a wire diameter of more than 0.011 mm and not more than 0.015 mm, and the coaxial cable comprises an electric resistance of not more than 23500 Ω/km, and a capacitance of 30 to 80 pF/m.

(xxvii) The copper alloy wire comprises a wire diameter of more than 0.008 mm and not more than 0.012 mm, and the coaxial cable comprises an electric resistance of not more than 40000 Ω/km, and a capacitance of 30 to 80 pF/m.

(18) According to another aspect of the invention, a method of making a coaxial cable comprises the steps of:

adding 1 to 3 weight % of silver to a pure copper to produce a copper alloy;

conducting a wire drawing work to the copper alloy to form an extra-fine wire comprising a wire diameter of 0.010 to 0.025 mm;

twisting a plurality of the extra-fine copper alloy wires together to obtain an extra-fine copper alloy twisted wire;

conducting a heat treatment to the twisted wire at a temperature of 300 to 500° C. for 0.2 to 5 seconds;

forming a foamed insulation comprising a thickness of not more than 0.28 mm on an outer circumference of the extra-fine copper alloy twisted wire;

forming a skin layer on an outer circumference of the foamed insulation;

winding a plurality of conductor wires on an outer circumference of the skin layer along a longitudinal direction of the extra-fine copper alloy twisted wire in a spiral form to form an outer conductor; and forming a jacket layer on a surface of the outer conductor.

(19) According to another aspect of the invention, a multicore cable comprises:

a tension member or an central interposition; and a plurality of the coaxial cables according to the invention (17) twisted together on an outer circumference of the tension member or the central interposition.

(20) According to another aspect of the invention, a multicore cable comprises:

a tension member or an central interposition; and a plurality of coaxial cable units comprising a plurality of the coaxial cables according to the invention (17) bundled together, and twisted together on an outer circumference of the tension member or the central interposition.

(21) According to another aspect of the invention, a multicore cable comprises:

a plurality of the coaxial cables according to the invention (17) juxtaposed at a constant pitch.

Advantages of the Invention

According to the invention, an extra-fine copper alloy wire and an extra-fine copper alloy twisted wire that comprises the extra-fine copper alloy wires with a final wire diameter of 0.025 mm or less can have both a high mechanical strength and a low electric resistance (i.e., a high electrical conductivity) as well as a high heat resistance, so that lowering of the mechanical strength can be suppressed even in a heat load work such as an extrusion process. Also, manufacturing methods thereof can be provided.

Further, according to the invention, an extra-fine insulated wire, a coaxial cable and a multicore cable can have both a high mechanical strength and a low electric resistance (i.e., a high electrical conductivity) as well as a high heat resistance so that lowering of the mechanical strength can be suppressed even in a heat load work such as an extrusion making process and a soldering work at its terminal portion. Also, manufacturing methods thereof can be provided.

Furthermore, according to the invention, a coaxial cable and a multicore cable can have both a high mechanical strength and a low electric resistance (i.e., a high electrical conductivity) as well as a high heat resistance so that lowering of the mechanical strength can be suppressed even in a heat load work such as a foam extrusion process and a soldering work at its terminal portion. Also, manufacturing methods thereof can be provided.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Extra-Fine Copper Alloy Wire

Figure 1:
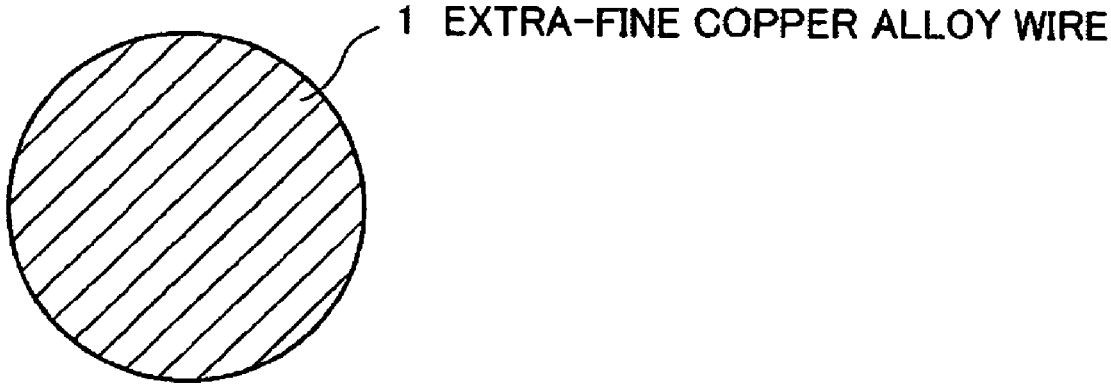
FIG. 1 is a cross sectional view showing an extra-fine copper alloy wire in a preferred embodiment according to the invention.

FIG. 1 is a cross sectional view showing the extra-fine copper alloy wire in the preferred embodiment according to the invention.

The extra-fine copper alloy wire 1 is formed of a Cu—Ag alloy wire, and comprises a wire diameter of 0.010 to 0.025 mm, silver content of 1 to 3 weight %, preferably 1.5 to 2.5 weight %, a tensile strength of 850 MPa or more, an electrical conductivity of 85% IACS or more and an elongation percentage of 0.5 to 3.0%. The silver content of 1 to 3 weight % is adopted, for the reason that if less than 1 weight % the strength is not enhanced and if more than 3 weight % while the strength is enhanced, the electrical conductivity is lowered.

Further, the silver content of 1.5 to 2.5 weight % is adopted, so that a performance satisfying at a maximum both characteristics of the strength and the electrical conductivity can be obtained.

Furthermore, the tensile strength of 850 MPa or more, the electrical conductivity of 85% IACS or more and an elongation percentage of 0.5 to 3.0% are adopted, for the reason that in consideration of being applied to a cable for a medical device if within the range described above characteristics satisfying a bending property, an electric resistance and a flexibility etc. can be obtained, but if outside the ranges they are not obtained.

Further, in the extra-fine copper alloy wire 1, a lowering rate of the tensile strength ($\sigma_{h1}$) after a heat treatment to the tensile strength ($\sigma_{h0}$) before the heat treatment represented as a formula $[(1-\sigma_{h1}/\sigma_{h0})\times 100\%]$ is maintained not more than 2%. In the formula the sign of $\sigma_{h1}$ shows the tensile strength after the heat treatment and the sign of $\sigma_{h0}$ shows the strength before the heat treatment, under conditions of a heating temperature of not more than 350° C., a heating time of not more than 5 seconds.

The heat treatment conditions of a heating temperature of not more than 350° C. and a heating time of not more than 5 seconds is adopted for the reason that a thermal load condition in a cable making process of the extra-fine copper alloy wire and the twisted wire, for example an insulator extrusion process is within the range described above. Further, the lowering rate of the tensile strength ($\sigma_{h1}$) after a heat treatment to the tensile strength ($\sigma_{h0}$) before the heat treatment represented as a formula $[(1-\sigma_{h1}/\sigma_{h0})\times 100\%]$ is maintained not more than 2% for the reason that if the lowering rate is more than 2%, the breaking of wire is caused in the extrusion process and the cable characteristic is extremely lowered. Therefore, a lowering of the strength is maintained within the range described above, so that the cable making without the breaking of wire and a change of performance can be achieved.

Extra-Fine Copper Alloy Twisted Wire

Figure 2:
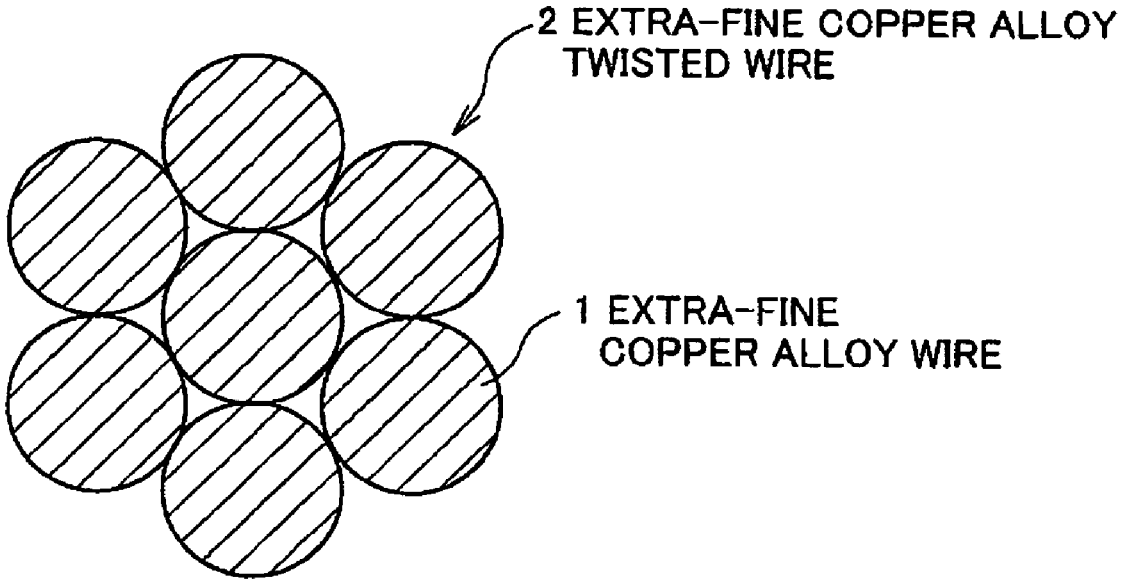
FIG. 2 is a cross sectional view showing an extra-fine copper alloy twisted wire in a preferred embodiment according to the invention.

FIG. 2 is a cross sectional view showing the extra-fine copper alloy twisted wire in the preferred embodiment according to the invention.

The extra-fine copper alloy twisted wire 2 is formed by that seven extra-fine copper alloy wires 1 shown in FIG. 1 are twisted together, and comprises a predetermined relationship between a wire diameter and an electric resistance. That is, the extra-fine copper alloy twisted wire 2 is formed by that the seven extra-fine copper alloy wires 1 being formed of a Cu—Ag alloy wire, and comprising a wire diameter of 0.010 to 0.025 mm, silver content of 1 to 3 weight %, preferably 1.5 to 2.5 weight %, a tensile strength of 850 MPa or more, an electrical conductivity of 85% IACS or more and an elongation percentage of 0.5 to 3.0% are twisted together, and has the following relationships between the wire diameter and the electric resistance.

An electric resistance of not more than 6000 Ω/km at 20° C. for the seven twisted wires with a wire diameter of 0.025 mm, An electric resistance of not more than 7000 Ω/km at 20° C. for the seven twisted wires with a wire diameter of 0.023 mm, An electric resistance of not more than 9500 Ω/km at 20° C. for the seven twisted wires with a wire diameter of 0.020 mm, An electric resistance of not more than 11500 Ω/km at 20° C. for the seven twisted wires with a wire diameter of 0.018 mm, An electric resistance of not more than 15000 Ω/km at 20° C. for the seven twisted wires with a wire diameter of 0.016 mm, An electric resistance of not more than 22000 Ω/km at 20° C. for the seven twisted wires with a wire diameter of 0.013 mm, An electric resistance of not more than 38000 Ω/km at 20° C. for the seven twisted wires with a wire diameter of 0.010 mm.

The electric resistance is limited according to each of the wire diameters, for the reason that the extra-fine copper alloy twisted wire 2 satisfying truly both of a downsizing of the diameter and an enhancing of an electric characteristic can be obtained, complying with the AWG (American Wire Gauge).

Plated Extra-Fine Copper Alloy Wire and Plated Twisted Wire

Figure 3:
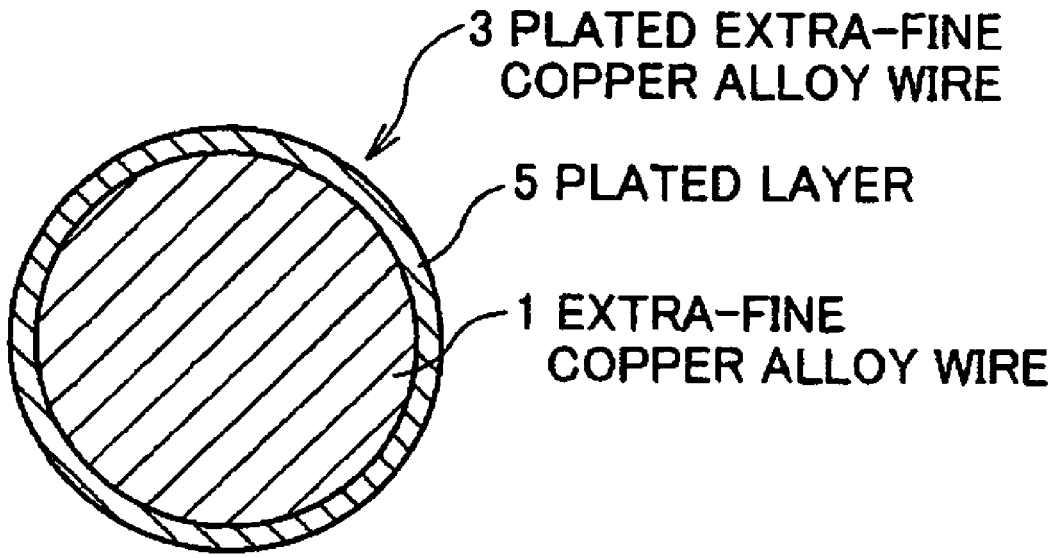
FIG. 3 is a cross sectional view showing a plated extra-fine copper alloy wire in a preferred embodiment according to the invention.

FIG. 3 is a cross sectional view showing the plated extra-fine copper alloy wire in the preferred embodiment according to the invention.

The plated extra-fine copper alloy wire 3 comprises the extra-fine copper alloy wire 1 and a plated layer 5 formed on an outer circumference of the wire 1. The plated layer 5 is generally formed of a tin (Sn), silver (Ag) or a nickel (Ni) mainly in terms of improvements in a corrosion resistance and a solder connectivity of the extra-fine copper alloy wire.

Figure 4:
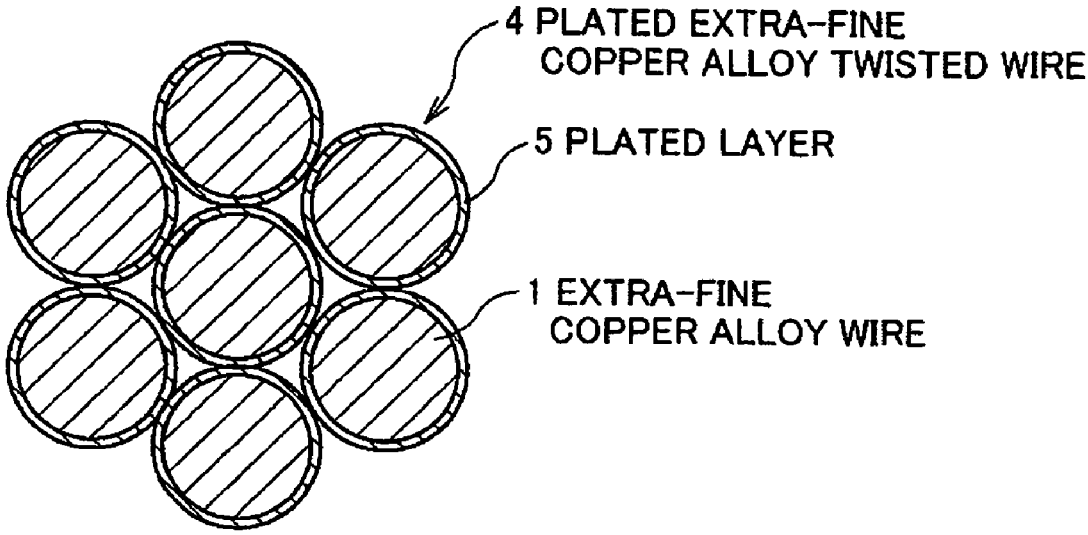
FIG. 4 is a cross sectional view showing a plated extra-fine copper alloy twisted wire in a preferred embodiment according to the invention.

Further, as shown in FIG. 4, the seven plated extra-fine copper alloy wires 3 can be twisted so as to form a plated extra-fine copper alloy twisted wire 4.

Coaxial Cable and Multicore Cable

Figure 5:
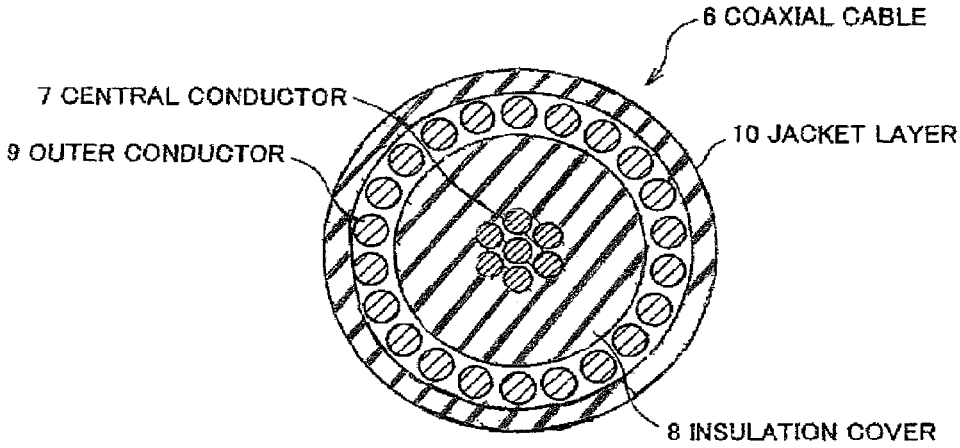
FIG. 5 is a cross sectional view showing a coaxial cable in a preferred embodiment according to the invention.

FIG. 5 is a cross sectional view showing a coaxial cable in a preferred embodiment according to the invention.

The coaxial cable 6 comprises a central conductor 7 formed by that the seven extra-fine copper alloy wires 1 shown in FIG. 1 or the seven plated extra-fine copper alloy wires 3 shown in FIG. 3 are twisted together, an insulation cover 8 formed on an outer circumference of the central conductor 7, an outer conductor 9 formed of a copper or a copper alloy disposed on an outer circumference of the insulation cover 8, and a jacket layer 10 disposed on an outer circumference of the outer conductor 9.

Figure 6:
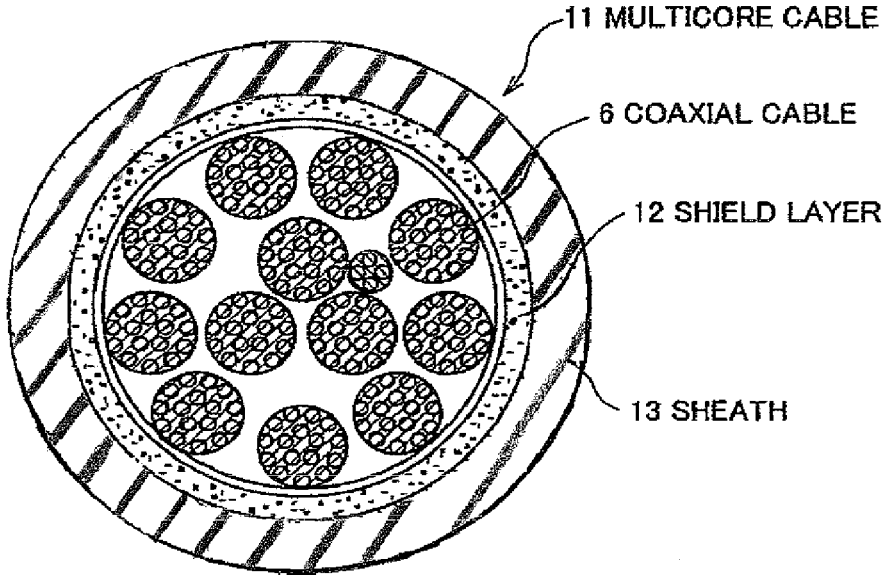
FIG. 6 is a cross sectional view showing a multicore cable in a preferred embodiment according to the invention.

Further, as shown in FIG. 6, a plurality of the coaxial cables 6 can be disposed in a shield layer 12 and a sheath 13 can be disposed on an outer circumference of the shield layer 12, so as to form a multicore cable 11.

Manufacturing Method

A manufacturing method of the extra-fine copper alloy wire and the extra-fine copper alloy twisted wire in the preferred embodiment according to the invention will be explained below.

The manufacturing method comprises the following steps. First, adding silver of 1 to 3 weight %, preferably 1.5 to 2.5 to a pure copper, so as to produce a copper alloy. After that, by conducting a wire drawing work or interposing a heat treatment during the wire drawing work, an extra-fine wire comprising a wire diameter of 0.010 to 0.025 mm is formed. In this case, it can be adopted to plate the extra-fine wire comprising an intermediate wire diameter with a tin (Sn), silver (Ag) or a nickel (Ni), so as to finally obtain the extra-fine wire comprising the wire diameter of 0.010 to 0.025 mm.

Next, conducting a heat treatment under a specific condition to a single extra-fine copper alloy wire or extra-fine copper alloy twisted wire formed by that predetermined numbers, for example, seven extra-fine wires are twisted together. The heat treatment is conducted by running the extra-fine wire or the twisted wire in a heating furnace heated at a temperature of 300 to 500° C. for 0.2 to 5 seconds. As a condition of the heat treatment at a temperature of 300 to 500° C. and a time of 0.2 to 5 seconds are adopted, for the reason that if the temperature is less than 300° C. and the time is less than 0.5 seconds, a lowering of the tensile strength is small, but an increase in the electrical conductivity is also small so that a desired characteristic can not be obtained. Further, if the temperature is more than 500° C. and the time is more than 5 seconds, the increase in the electrical conductivity is large, but the lowering of the tensile strength also extremely large so that a desired characteristic can not be obtained.

Concretely, by means that the heat treatment is conducted under the condition of 300 to 500° C. and 0.2 to 5 seconds, the lowering rate of the tensile strength ($\sigma_{h1}$) after a heat treatment to the tensile strength ($\sigma_{h0}$) before the heat treatment represented as a formula $[(1-\sigma_{h1}/\sigma_{h0})\times 100\%]$ can be maintained not more than 30%, and the increasing rate of the electrical conductivity ($\rho_{a1}$) after a heat treatment to the electrical conductivity ($\rho_{a0}$) before the heat treatment represented as a formula $[(\rho_{a1}/\rho_{a0}-1)\times 100\%]$ can be maintained not less than 6%.

The extra-fine copper alloy wire or the extra-fine copper alloy twisted wire obtained by the treating described above comprises a wire diameter of 0.010 to 0.025 mm, a silver content of 1 to 3 weight %, preferably 1.5 to 2.5 weight %, a tensile strength of not less than 850 MPa, an electrical conductivity of not less than 85% IACS and an elongation percentage of 0.5 to 3.0%, and further comprises a lowering rate of not more than 2%, of the tensile strength ($\sigma_{h1}$) after a heat treatment to the tensile strength ($\sigma_{h0}$) before the heat treatment represented as a formula $[(1-\sigma_{h1}/\sigma_{h0})\times 100\%]$.

Advantages of the Embodiment

According to the preferred embodiment an extra-fine copper alloy wire and an extra-fine copper alloy twisted wire are provided, that comprise a final wire diameter of not more than 0.025 mm, satisfy both of a high strength characteristic and a low resistance characteristic (a high electrical conductivity), and also comprise a high heat resistance so that a lowering of a strength characteristic is suppressed even if a heat loading is applied in an extrusion making process of a coaxial cable using the extra-fine wire.

Therefore, the coaxial cable made by using the extra-fine copper alloy wire and the extra-fine copper alloy twisted wire are suitably applied to a cable for an electronics device and a medical device, the cable required a downsizing, a diameter thinning, a weight saving, a high flexibility, a high transmission performance.

Extra-Fine Insulated Wire

Figure 7:
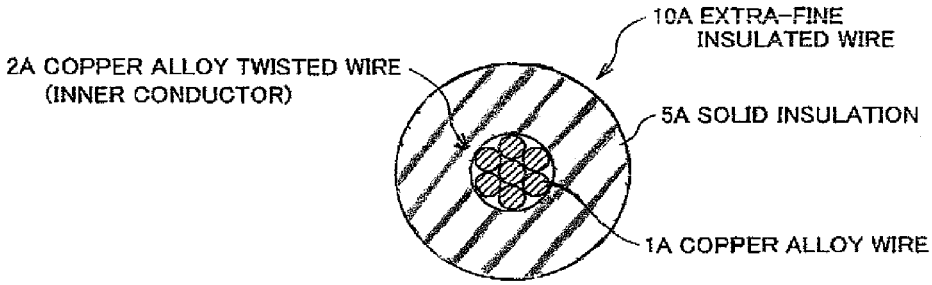
FIG. 7 is a cross sectional view showing an extra-fine insulated wire in a preferred embodiment according to the invention.

FIG. 7 is a cross sectional view showing an extra-fine insulated wire in the preferred embodiment according to the invention.

The extra-fine insulated wire 10A comprises the copper alloy twisted wire 2A (an inner conductor) formed by twisting seven copper alloy wires 1A twisted together and a solid insulation 5A formed on an outer circumference of the inner conductor.

Copper Alloy Wire

The copper alloy wire 1A is formed of a Cu—Ag alloy wire, and comprises a wire diameter of 0.010 to 0.025 mm and silver content of 1 to 3 weight %, preferably 1.5 to 2.5 weight %.

The silver content of 1 to 3 weight % is adopted, for the reason that if less than 1 weight % the strength is not enhanced and if more than 3 weight % while the strength is enhanced, the electrical conductivity is lowered. Further, the silver content of 1.5 to 2.5 weight % is adopted, so that a performance satisfying at a maximum both characteristics of the strength and the electrical conductivity can be obtained.

Further, a plated layer formed of a tin (Sn), silver (Ag) or a nickel (Ni) can be formed on the copper alloy wire 1A.

Inner Conductor

The inner conductor comprises the copper alloy twisted wire 2A formed by twisting the seven copper alloy wires 1A together, and comprises a tensile strength of 850 MPa or more, an electrical conductivity of 85% IACS or more. The tensile strength of 850 MPa or more, and the electrical conductivity of 85% IACS or more are adopted, for the reason that in consideration of being applied to a cable for a medical device if within the range described above characteristics satisfying a bending property, an electric resistance and a flexibility etc. can be obtained, but if outside the ranges they are not obtained.

Further, the copper alloy twisted wire (the inner conductor) 2A to which a heat treatment is applied, comprise a lowering rate of 6% or more in an electric resistance after the heat treatment and a lowering rate of not more than 20% in a tensile strength after the heat treatment. If the lowering rate of the electric resistance after the heat treatment is less than 6% and the lowering rate of the tensile strength after the heat treatment is more than 20%, a breaking of wire is likely to be caused in an extrusion making work and in a soldering work at a terminal portion, it is difficult to obtain characteristics satisfying both of a high strength and a low resistance (i.e., a high electrical conductivity).

Further, the following relationships are established between the electric resistance of the copper alloy twisted wire (the inner conductor) 2A and the wire diameter of the copper alloy wire 1A.

(1) When the wire diameter of the copper alloy wire 1A is more than 0.021 mm and not more than 0.025 mm, the electric resistance is not more than 7200 Ω/km, (2) When the wire diameter of the copper alloy wire 1A is more than 0.018 mm and not more than 0.022 mm, the electric resistance is not more than 9500 Ω/km, (3) When the wire diameter of the copper alloy wire 1A is more than 0.016 mm and not more than 0.020 mm, the electric resistance is not more than 12200 Ω/km, (4) When the wire diameter of the copper alloy wire 1A is more than 0.014 mm and not more than 0.018 mm, the electric resistance is not more than 14700 Ω/km, (5) When the wire diameter of the copper alloy wire 1A is more than 0.013 mm and not more than 0.017 mm, the electric resistance is not more than 16500 Ω/km, (6) When the wire diameter of the copper alloy wire 1A is more than 0.011 mm and not more than 0.015 mm, the electric resistance is not more than 22500 Ω/km, (7) When the wire diameter of the copper alloy wire 1A is more than 0.008 mm and not more than 0.012 mm, the electric resistance is less than 38000 Ω/km.

The electric resistance is limited according to each of the wire diameters, for the reason that copper alloy twisted wire (the inner conductor) 2A satisfying truly both of a downsizing of the diameter and an enhancing of an electric characteristic can be obtained, complying with the AWG (American Wire Gauge).

Solid Insulation

The solid insulation 5A is formed on an outer circumference of the copper alloy twisted wire (the inner conductor) 2A of not more than 0.07 mm in thickness. The thickness of not more than 0.07 mm is adopted for the reason that a capacitance of 100 pF/m or more can be obtained in a coaxial cable of 43 to 50 AWG.

The solid insulation 5A can be formed of resins such as polytetrafluoroethylene/perfluoropropylvinylether copolymer (PFA), polytetrafluoroethylene/polyhexafluoropropylene copolymer (FEP), etc. selected from materials comprising a dielectric constant of 2.1 and a melting point of approx. 300° C.

Coaxial Cable

Figure 8:
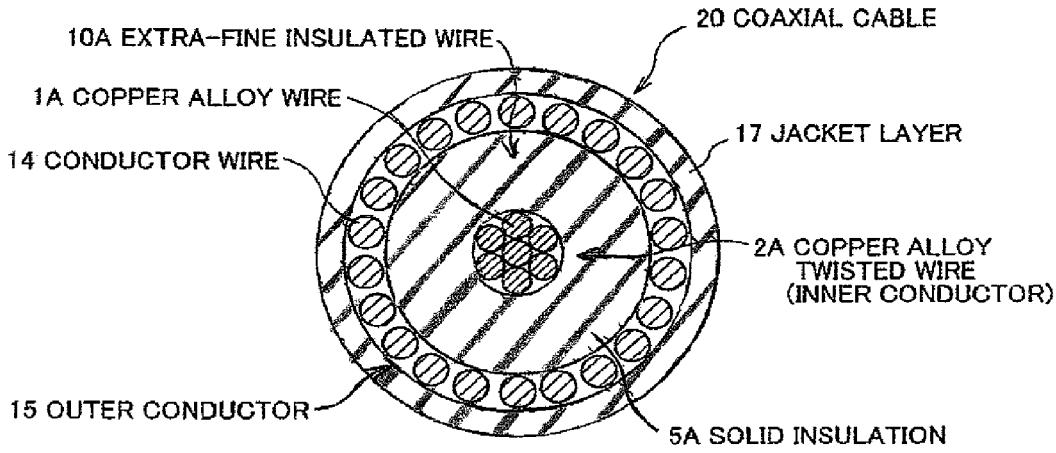
FIG. 8 is a cross sectional view showing a coaxial cable in a preferred embodiment according to the invention.

FIG. 8 is a cross sectional view showing a coaxial cable in a preferred embodiment according to the invention.

The coaxial cable 20 comprises the extra-fine insulated wire 10A shown in FIG. 7, an outer conductor 15 formed by that a plurality of conductor wires 14 are wound on an outer circumference of the extra-fine insulated wire 10A along the longitudinal direction thereof in a spiral form, and a jacket layer 17 formed on a surface of the outer conductor 15.

Outer Conductor

The outer conductor 15 (served shield) is formed by that a plurality (e.g. 30 to 60 wires) of the conductor wires 14 such as a Sn-plated copper wire, a Sn-plated copper alloy wire, a Ag-plated copper wire, a Ag-plated copper alloy wire etc. are laterally wound in a spiral form at a predetermined pitch.

Jacket Layer

The jacket layer 17 can be formed by that resins such as polytetrafluoroethylene/perfluoropropylvinylether copolymer (PFA), polytetrafluoroethylene/polyhexafluoropropylene copolymer (FEP), ethylene/polytetrafluoroethylene copolymer (ETFE) etc. are extruded and formed on the outer conductor 15.

Capacitance, Attenuation, Bending Life at Right Angle to Left and Right of Coaxial Cable A capacitance, an attenuation, a bending life at right angles to left and right of the coaxial cable 20 comprises the following relationship between the wire diameter of the copper alloy wire 1A.

(1) When the wire diameter of the copper alloy wire 1A is more than 0.021 mm and not more than 0.025 mm, the capacitance is 100 to 130 pF/m, the attenuation is 0.6 to 1.0 dB/m (frequency 10 MHz), the bending life at right angle to left and right is 20000 times or more in a condition of a bending (R)=2 mm, and a loading=50 g.

(2) When the wire diameter of the copper alloy wire 1A is more than 0.018 mm and not more than 0.022 mm, the capacitance is 100 to 130 pF/m, the attenuation is 0.8 to 1.2 dB/m (frequency 10 MHz), the bending life at right angle to left and right is 20000 times or more in a condition of a bending (R)=2 mm, and a loading=50 g.

(3) When the wire diameter of the copper alloy wire 1A is more than 0.016 mm and not more than 0.020 mm, the capacitance is 100 to 130 pF/m, the attenuation is 1.0 to 1.5 dB/m (frequency 10 MHz), the bending life at right angle to left and right is 20000 times or more in a condition of a bending (R)=2 mm, and a loading=50 g.

(4) When the wire diameter of the copper alloy wire 1A is more than 0.014 mm and not more than 0.018 mm, the capacitance is 100 to 130 pF/m, the attenuation is 1.1 to 1.6 dB/m (frequency 10 MHz), the bending life at right angle to left and right is 30000 times or more in a condition of a bending (R)=2 mm, and a loading=50 g.

(5) When the wire diameter of the copper alloy wire 1A is more than 0.013 mm and not more than 0.017 mm, the capacitance is 100 to 130 pF/m, the attenuation is 1.3 to 1.8 dB/m (frequency 10 MHz), the bending life at right angle to left and right is 30000 times or more in a condition of a bending (R)=2 mm, and a loading=20 g.

(6) When the wire diameter of the copper alloy wire 1A is more than 0.011 mm and not more than 0.015 mm, the capacitance is 100 to 130 pF/m, the attenuation is 1.7 to 2.4 dB/m (frequency 10 MHz), the bending life at right angle to left and right is 30000 times or more in a condition of a bending (R)=2 mm, and a loading=20 g.

(7) When the wire diameter of the copper alloy wire 1A is more than 0.008 mm and not more than 0.012 mm, the capacitance is 100 to 130 pF/m, the attenuation is 2.5 to 3.8 dB/m (frequency 10 MHz), the bending life at right angle to left and right is 10000 times or more in a condition of a bending (R)=2 mm, and a loading=20 g.

The capacitance, attenuation, bending life at right angle to left and right is limited according to each of the wire diameters, for the reason that the copper alloy twisted wire (the inner conductor) 2A satisfying truly both of a downsizing of the diameter and an enhancing of electric and mechanical characteristics can be obtained, complying with the AWG (American Wire Gauge).

Multicore Cable with Four Coaxial Cables

Figure 9:
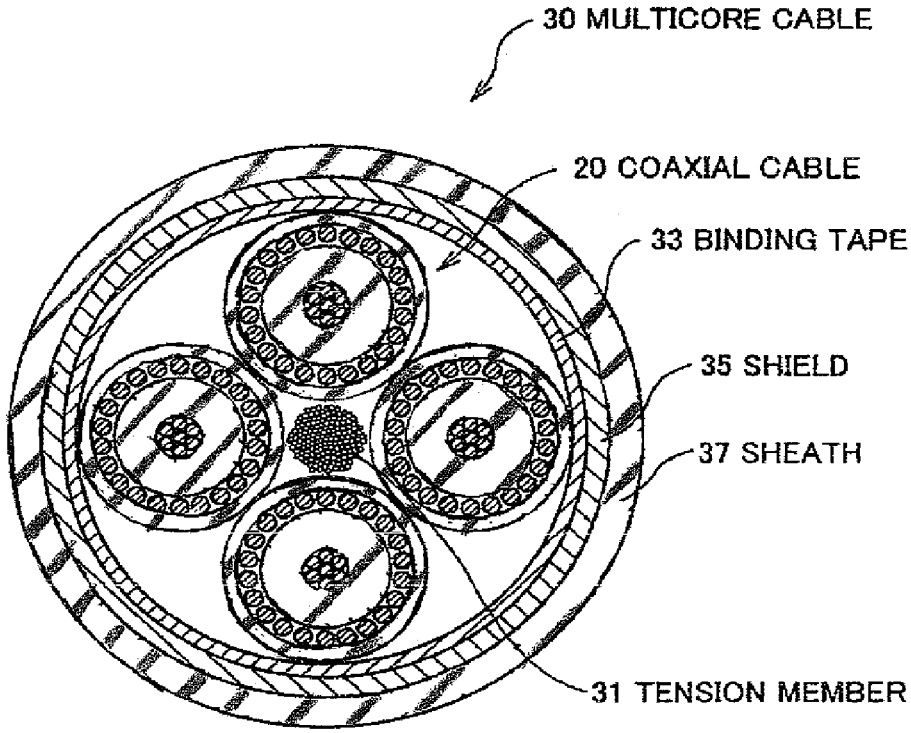
FIG. 9 is a cross sectional view showing a multicore cable in a preferred embodiment according to the invention.

FIG. 9 is a cross sectional view showing a multicore cable in a preferred embodiment according to the invention.

The multicore cable 30 comprises a tension member 31 (or an central interposition), the four coaxial cables 20 shown in FIG. 8 disposed on an outer circumference of the tension member 31, arranged on a concentric circle at FIG. 9 of a cross-sectional view surface, twisted together, and wound by a binding tape 33, and a shield 35 and a sheath 37 disposed on an outside of the binding tape 33.

The binding tape 33 comprises a wound thickness of e.g. 0.05 mm. Further, the shield 35 can be formed of e.g. a braided Sn-plated annealed copper wire of 0.05 thickness. The shield 35 can be a served shield other than the served shield. The sheath 37 can be formed by that a PET tape is wound around the shield 35, or resins such as polytetrafluoroethylene/perfluoropropylvinylether copolymer (PFA), polytetrafluoroethylene/polyhexafluoropropylene copolymer (FEP), ethylene/polytetrafluoroethylene copolymer (ETFE), polyvinylchloride (PVC) etc. are extruded and formed on the shield 35.

FIG. 9 shows a structure that the four coaxial cables 20 are arranged to form a single layer on a concentric circle and twisted together, but more of the coaxial cables 20 can be arranged to form two or more layers and twisted together.

Multicore Cable with Three Coaxial Cables and One Extra-Fine Insulated Wire

Figure 10:
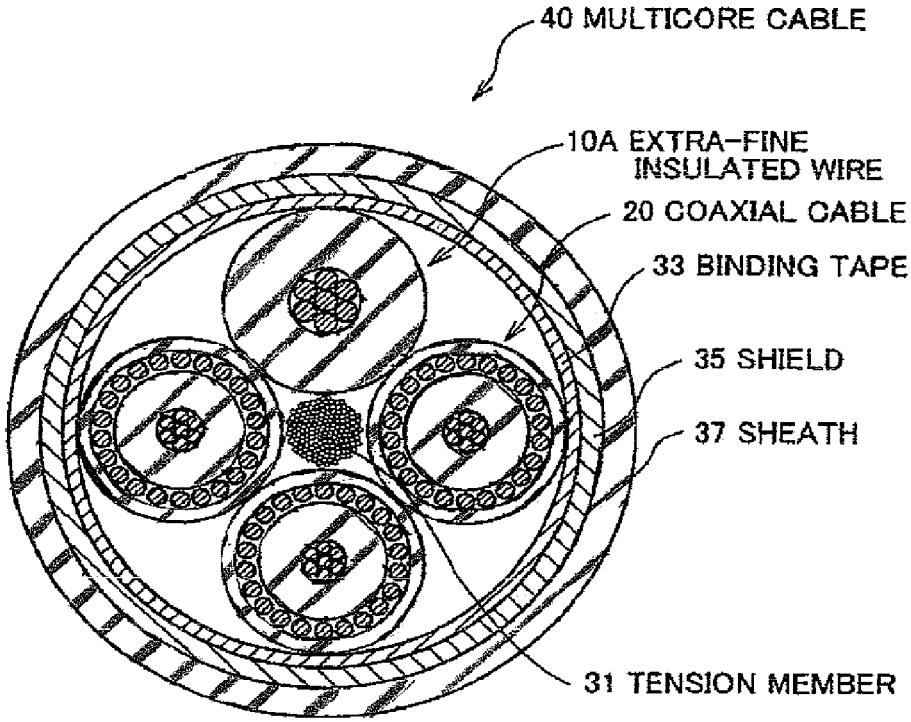
FIG. 10 is a cross sectional view showing a multicore cable in the other preferred embodiment according to the invention.

FIG. 10 is a cross sectional view showing a multicore cable in the other preferred embodiment according to the invention.

The multicore cable 40 is a composite cable which comprises a tension member 31 (or an central interposition), the three coaxial cables 20 shown in FIG. 8 and the one extra-fine insulated wire 10A disposed on an outer circumference of the tension member 31, arranged on a concentric circle at FIG. 10 of a cross-sectional view surface, twisted together, and wound by a binding tape 33, and a shield 35 and a sheath 37 disposed on an outside of the binding tape 33.

FIG. 10 shows a structure that the three coaxial cables 20 and the one extra-fine insulated wire 10A are used, but a ratio of the coaxial cables 20 to the extra-fine insulated wire 10A is voluntarily changeable according to need. And, FIG. 10 shows a structure that the coaxial cables 20 and the extra-fine insulated wire 10A are arranged to form a single layer on a concentric circle and twisted together, but more of the coaxial cables 20 and the extra-fine insulated wire 10A can be arranged to form two or more layers and twisted together.

Multicore Cable with Four Extra-Fine Insulated Wires

Figure 11:
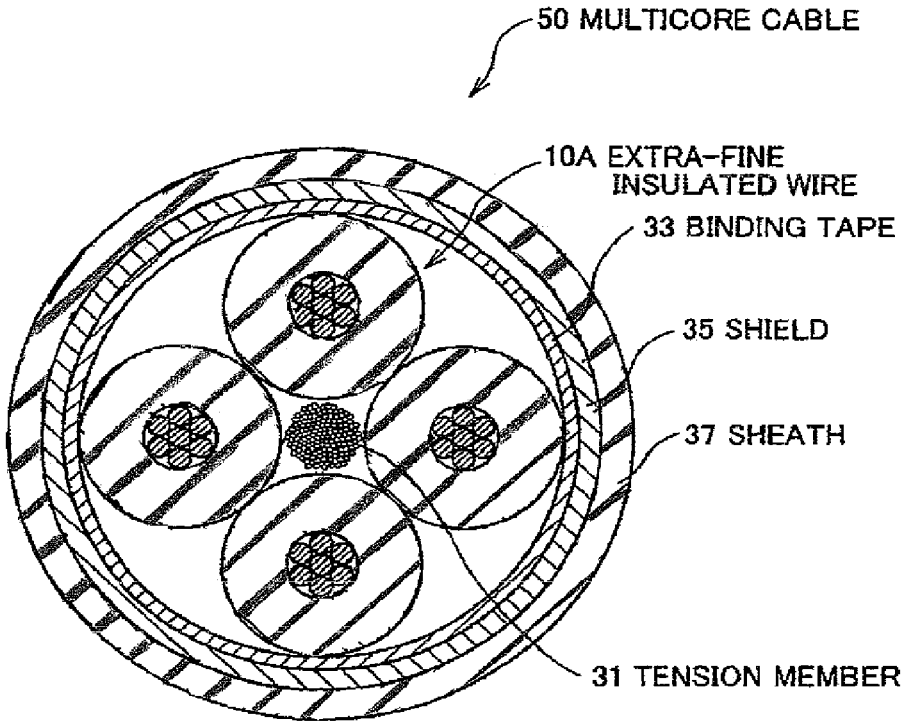
FIG. 11 is a cross sectional view showing a multicore cable in the other preferred embodiment according to the invention.

FIG. 11 is a cross sectional view showing a multicore cable in the other preferred embodiment according to the invention;

The multicore cable 50 is a differential transmission cable which comprises a tension member 31 (or an central interposition), the four extra-fine insulated wire 1A shown in FIG. 7 disposed on an outer circumference of the tension member 31, arranged on a concentric circle at FIG. 11 of a cross-sectional view surface, twisted together, and wound by a binding tape 33, and a shield 35 and a sheath 37 disposed on an outside of the binding tape 33.

FIG. 11 shows a structure that the four extra-fine insulated wires 10A are arranged to form a single layer on a concentric circle and twisted together, but more of the extra-fine insulated wires 10A can be arranged to form two or more layers and twisted together.

Multicore Cable with Four Coaxial Cable Units

Figure 12:
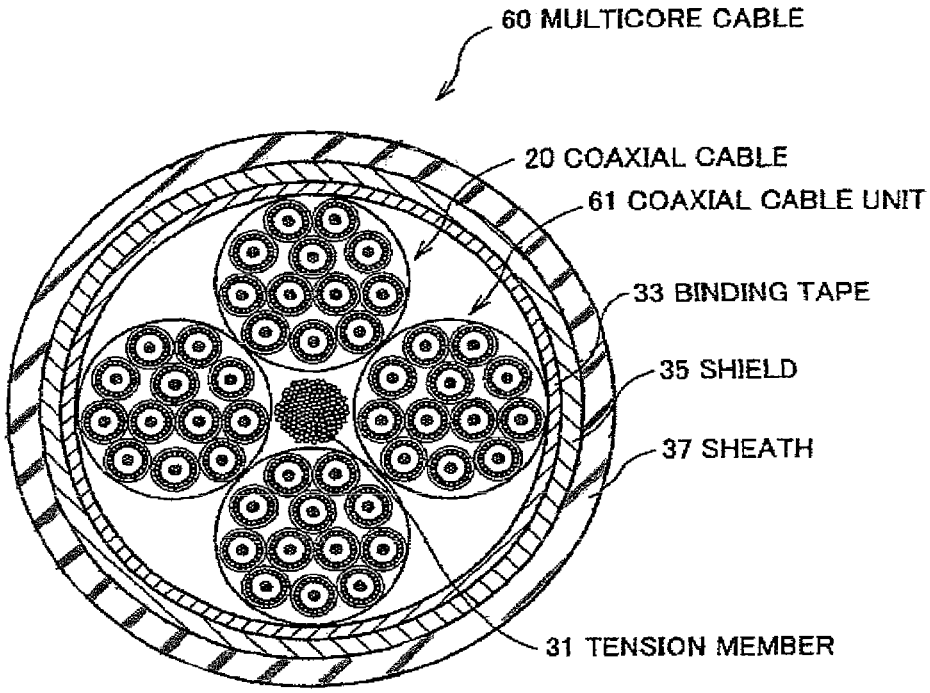
FIG. 12 is a cross sectional view showing a multicore cable in the other preferred embodiment according to the invention.

FIG. 12 is a cross sectional view showing a multicore cable in the other preferred embodiment according to the invention.

The multicore cable 60 comprises a tension member 31 (or an central interposition), the four coaxial cable units 61 formed by that a plurality of the coaxial cables 20 shown in FIG. 8 are bound up, disposed on an outer circumference of the tension member 31, twisted together collectively, and wound by a binding tape 33, and a shield 35 and a sheath 37 disposed on an outside of the binding tape 33.

Multicore Cable with Curl Wires

Figure 13:
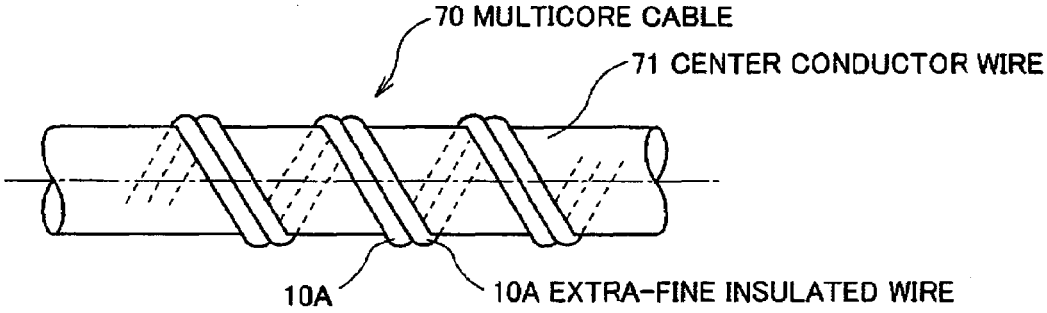
FIG. 13 is a cross sectional view showing a multicore cable in the other preferred embodiment according to the invention.

FIG. 13 is a cross sectional view showing a multicore cable in the other preferred embodiment according to the invention.

The multicore cable 70 comprises a central conductor wire 71 and curl wires formed by that the two extra-fine insulated wires 10A shown in FIG. 7 are wound on the central conductor wire 71 at a constant pitch. The central conductor wire 71 can be formed of e.g. silver-plated copper wire comprising a diameter of 0.16 mm. Further, instead of winding the two extra-fine insulated wires 10A, it can be adopted to wind one or two pair-twisted wires formed by that the two extra-fine insulated wires 10A are pair-twisted at a constant pitch.

Multicore Cable with Multicore Ribbon Cable

Figure 14:
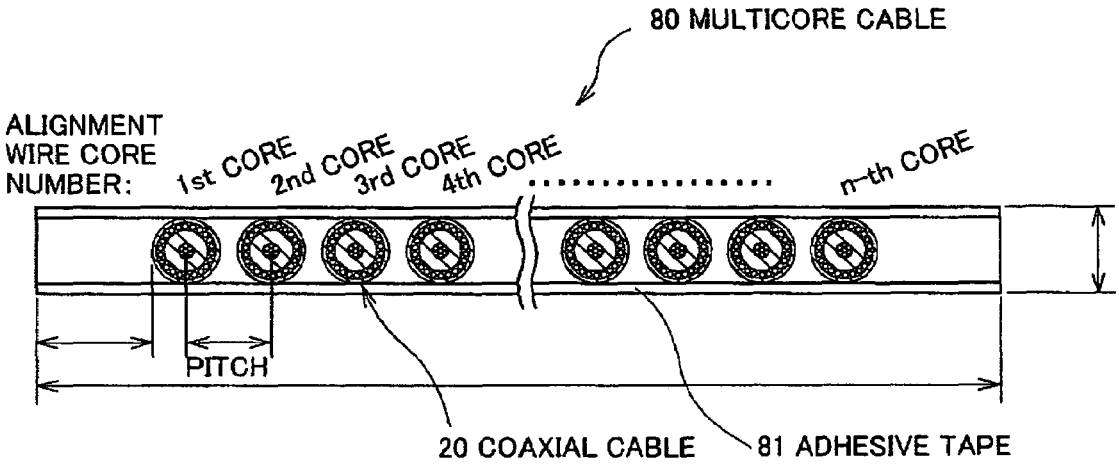
FIG. 14 is a cross sectional view showing a multicore cable in the other preferred embodiment according to the invention.

FIG. 14 is a cross sectional view showing a multicore cable in the other preferred embodiment according to the invention.

The multicore cable 80 comprises a multicore ribbon cable comprising a juxtaposing member formed by that a plurality of the coaxial cables 20 shown in FIG. 8 are juxtaposed at a constant pitch and adhesive tapes 81 laminated to both surfaces of the juxtaposing member.

Manufacturing Method

Hereinafter, a manufacturing method of the copper alloy wire and the copper alloy twisted wire in a preferred embodiment according to the invention will be explained.

The manufacturing method comprises the following steps. First, adding silver of 1 to 3 weight %, preferably 1.5 to 2.5 to a pure copper, so as to produce a copper alloy. After that, conducting a wire drawing work or interposing a heat treatment during the wire drawing work, so as to form an extra-fine wire comprising a wire diameter of 0.010 to 0.025 mm. In this case, it can be adopted to plate the extra-fine wire comprising an intermediate wire diameter with a tin (Sn), silver (Ag) or a nickel (Ni), so as to finally obtain the extra-fine wire comprising the wire diameter of 0.010 to 0.025 mm.

Next, conducting a heat treatment in a specific condition to the one extra-fine copper alloy wire or extra-fine copper alloy twisted wire formed by that predetermined number of wires, for example, seven extra-fine wires are twisted together. The heat treatment is conducted by running the extra-fine wire or the twisted wire in a heating furnace heated at a temperature of 300 to 500° C. for 0.2 to 5 seconds, preferably 0.5 to 1.5 seconds. As a condition of the heat treatment, a temperature of 300 to 500° C. and a time of 0.2 to 5 seconds are adopted, for the reason that if the temperature is less than 300° C. and the time is less than 0.5 seconds, a lowering of the tensile strength is small, but an increase in the electrical conductivity is also small so that a desired characteristic can not be obtained. Further, if the temperature is more than 500° C. and the time is more than 5 seconds, the increase in the electrical conductivity is extremely large, but the lowering of the tensile strength also extremely large so that a desired characteristic can not be obtained.

Further, the heat treatment is conducted at the time of preferably 0.5 to 1.5 seconds, so that a performance satisfying at a maximum both characteristics of the tensile strength and the electrical conductivity can be obtained.

The extra-fine copper alloy wire or the extra-fine copper alloy twisted wire obtained by the treating described above comprises the wire diameter of 0.010 to 0.025 mm, the silver content of 1 to 3 weight %, preferably 1.5 to 2.5 weight %, the tensile strength of 850 MPa or more, the electrical conductivity of 85% IACS or more.

Advantages of the Embodiment

According to the preferred embodiment an extra-fine copper alloy wire and an extra-fine copper alloy twisted wire are provided, that comprise a final wire diameter of not more than 0.025 mm, satisfy both of a high strength characteristic and a low resistance characteristic (a high electrical conductivity), and also comprise a high heat resistance so that a lowering of a strength property is suppressed even in a heat load work such as an extrusion making work, a soldering work at a terminal portion.

Therefore, the coaxial cable made by using the extra-fine copper alloy wire and the extra-fine copper alloy twisted wire are suitably applied to a cable for an electronics device and a medical device, the cable required a downsizing, a diameter thinning, a weight saving, a high flexibility, a high transmission performance.

Coaxial Cable

Figure 15:
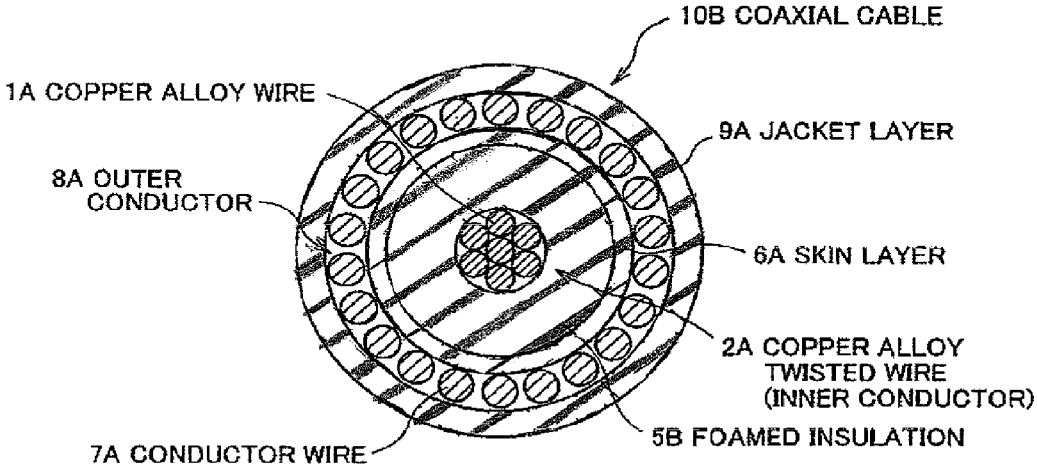
FIG. 15 is a cross sectional view showing a coaxial cable in the other preferred embodiment according to the invention.

FIG. 15 is a cross sectional view showing a coaxial cable in the other preferred embodiment according to the invention.

The coaxial cable 10B comprises a copper alloy twisted wire (an inner conductor) 2A formed by twisting the seven extra-fine copper alloy wires 1A together, covering a foamed insulation 5B on an outer circumference of the copper alloy twisted wire (inner conductor) 2A, forming a skin layer 6A on an outside of the foamed insulation 5B, forming an outer conductor 8A such that a plurality of conductor wires 7A are wound on the skin layer 6A along the longitudinal direction of the copper alloy twisted wire (the inner conductor) 2A in a spiral form, and covering a jacket layer 9A on the surface of the outer conductor 8A.

Copper Alloy Wire

The copper alloy wire 1A is formed of a Cu—Ag alloy wire, and comprises a wire diameter of 0.010 to 0.025 mm and silver content of 1 to 3 weight %, preferably 1.5 to 2.5 weight %.

The silver content of 1 to 3 weight % is adopted, for the reason that if less than 1 weight % the strength is not enhanced and if more than 3 weight % while the strength is enhanced, the electrical conductivity is lowered. Further, the silver content of 1.5 to 2.5 weight % is adopted, so that a performance satisfying at a maximum both characteristics of the strength and the electrical conductivity can be obtained.

Further, a plated layer formed of a tin (Sn), silver (Ag) or a nickel (Ni) can be formed on the copper alloy wire 1A.

Inner Conductor

The inner conductor comprises the copper alloy twisted wire 2A formed by that the seven copper alloy wires 1A are twisted together, and comprises a tensile strength of 850 MPa or more, an electrical conductivity of 85% IACS or more. The tensile strength of 850 MPa or more, and the electrical conductivity of 85% IACS or more are adopted, for the reason that in consideration of being applied to a cable for a medical device if within the range described above characteristics satisfying a bending property, an electric resistance and a flexibility etc. can be obtained, but if outside the ranges they are not obtained.

Further, the copper alloy twisted wire (the inner conductor) 2A to which a heat treatment is applied, comprise a lowering rate of 6% or more in an electric resistance after the heat treatment and a lowering rate of not more than 20% in a tensile strength after the heat treatment. If the lowering rate of the electric resistance after the heat treatment is less than 6% and the lowering rate of the tensile strength after the heat treatment is more than 20%, a breaking of wire is likely to be caused in a foam extrusion making work and in a soldering work at a terminal portion, and it is difficult to obtain characteristics satisfying both of a high strength and a low resistance (a high electrical conductivity).

Further, the following relationships are established between the electric resistance of the copper alloy twisted wire (the inner conductor) 2A and the wire diameter of the copper alloy wire 1A.

(1) When the wire diameter of the copper alloy wire 1A is more than 0.021 mm and not more than 0.025 mm, the electric resistance is less than 7500 Ω/km,
(2) When the wire diameter of the copper alloy wire 1A is more than 0.018 mm and not more than 0.022 mm, the electric resistance is less than 10000 Ω/km,
(3) When the wire diameter of the copper alloy wire 1A is more than 0.016 mm and not more than 0.020 mm, the electric resistance is less than 13000 Ω/km,
(4) When the wire diameter of the copper alloy wire 1A is more than 0.014 mm and not more than 0.018 mm, the electric resistance is less than 15500 Ω/km,
(5) When the wire diameter of the copper alloy wire 1A is more than 0.013 mm and not more than 0.017 mm, the electric resistance is less than 17000 Ω/km,
(6) When the wire diameter of the copper alloy wire 1A is more than 0.011 mm and not more than 0.015 mm, the electric resistance is less than 23500 Ω/km,
(7) When the wire diameter of the copper alloy wire 1A is more than 0.008 mm and not more than 0.012 mm, the electric resistance is less than 40000 Ω/km.

The electric resistance is limited according to each of the wire diameters, for the reason that copper alloy twisted wire (the inner conductor) 2A satisfying truly both of a downsizing of the diameter and an enhancing of an electric characteristic can be obtained, complying with the AWG (American Wire Gauge).

Foamed Insulation

The foamed insulation 5B can be formed of e.g. polytetrafluoroethylene/perfluoropropylvinylether copolymer (PFA) for a foaming extrusion. The foamed insulation 5B is formed on an outer circumference of the copper alloy twisted wire (the inner conductor) 2A of not more than 0.28 mm in thickness. The thickness of not more than 0.28 mm is adopted for the reason that a capacitance of 30 pF/m or more can be obtained in a coaxial cable of 43 to 50 AWG.

Skin Layer

The skin layer 6A can be formed by that a PET tape is wound up on the foamed insulation 5B, or resins such as polytetrafluoroethylene/perfluoropropylvinylether copolymer (PFA), polytetrafluoroethylene/polyhexafluoropropylene copolymer (FEP), ethylene/polytetrafluoroethylene copolymer (ETFE) are extruded and formed on the foamed insulation 5B.

Outer Conductor

The outer conductor 8A (served shield) is formed by that a plurality (e.g. 30 to 60 wires) of the conductor wires 7A such as a Sn-plated copper wire, a Sn-plated copper alloy wire, a Ag-plated copper wire, a Ag-plated copper alloy wire etc. are laterally wound in a spiral form at a predetermined pitch.

Jacket Layer

The jacket layer 9A can be formed by that the PET tape is wound up on the outer conductor 8A, or resins such as polytetrafluoroethylene/perfluoropropylvinylether copolymer (PFA), polytetrafluoroethylene/polyhexafluoropropylene copolymer (FEP), ethylene/polytetrafluoroethylene copolymer (ETFE) etc. are extruded and formed on the outer conductor 8A.

Capacitance of Coaxial Cable

The coaxial cable 10B comprises a low capacitance of 30 to 80 pF/m, in every case that the wire diameter of the copper alloy wire 1A is more than 0.021 mm and not more than 0.025 mm, more than 0.018 mm and not more than 0.022 mm, more than 0.016 mm and not more than 0.020 mm, more than 0.014 mm and not more than 0.018 mm, more than 0.013 mm and not more than 0.017 mm, more than 0.011 mm and not more than 0.015 mm, more than 0.008 mm and not more than 0.012 mm.

Multicore Cable with Four Coaxial Cables

Figure 16:
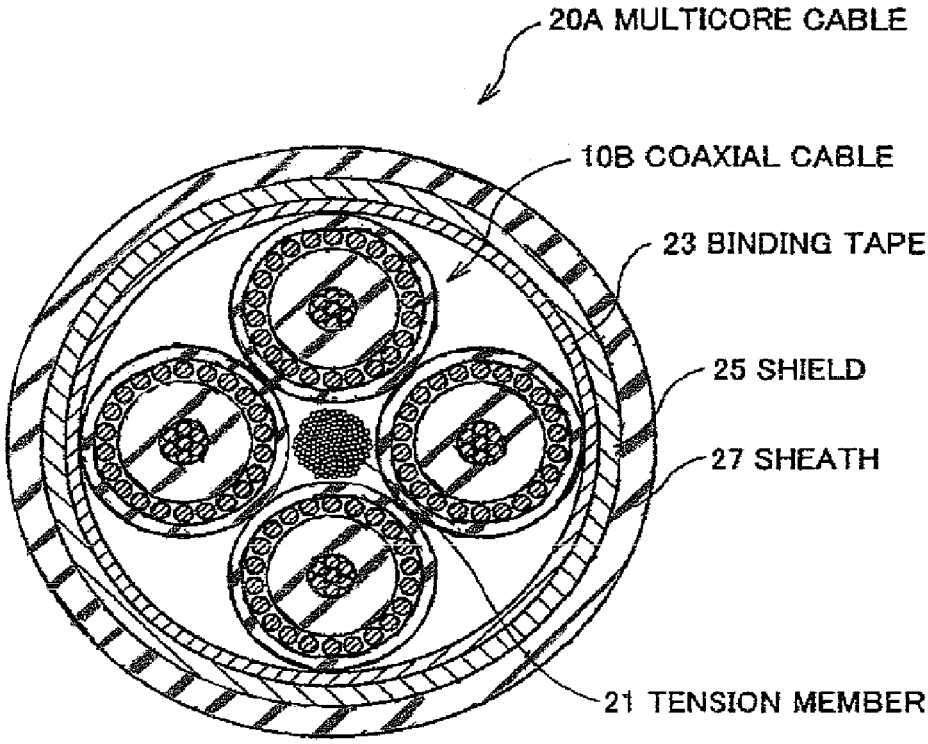
FIG. 16 is a cross sectional view showing a multicore cable in the other preferred embodiment according to the invention.

FIG. 16 is a cross sectional view showing a multicore cable in the other preferred embodiment according to the invention.

The multicore cable 20A comprises a tension member 21 (or an central interposition), the four coaxial cables 10B shown in FIG. 15 disposed on an outer circumference of the tension member 21, arranged on a concentric circle at FIG. 15 of a cross-sectional view surface, twisted together, and wound by a binding tape 23, and a shield 25 and a sheath 27 disposed on an outside of the binding tape 23.

The binding tape 23 comprises a wound thickness of e.g. 0.05 mm. Further, the shield 25 can be formed of e.g. a braided Sn-plated annealed copper wire of 0.05 mm in thickness. The shield 25 can be a served shield. The sheath 27 can be formed by that the PET tape is wound around the shield 25, or resins such as polytetrafluoroethylene/perfluoropropylvinylether copolymer (PFA), polytetrafluoroethylene/polyhexafluoropropylene copolymer (FEP), ethylene/polytetrafluoroethylene copolymer (ETFE), polyvinylchloride (PVC) etc. are extruded and formed on the shield 25.

FIG. 16 shows a structure that the coaxial cables 10B are arranged to form a single layer on a concentric circle and twisted together, but more of the coaxial cables 10B can be arranged to form two or more layers and twisted together.

Multicore Cable with Four Coaxial Cable Units

Figure 17:
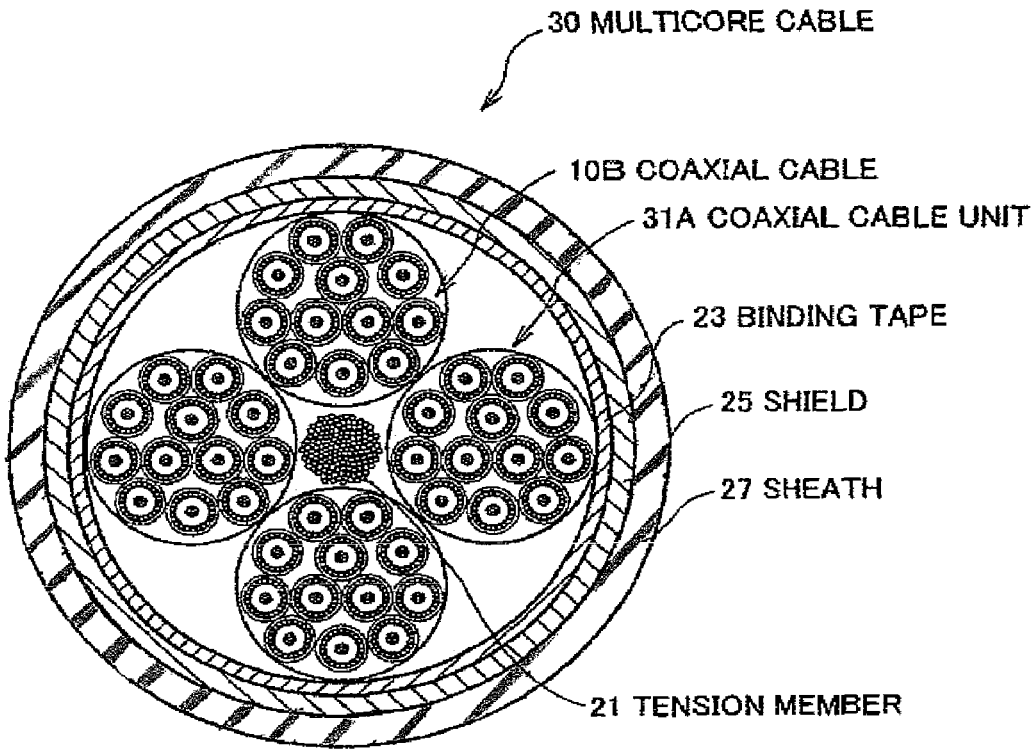
FIG. 17 is a cross sectional view showing a multicore cable in the other preferred embodiment according to the invention.

FIG. 17 is a cross sectional view showing a multicore cable in the other preferred embodiment according to the invention.

The multicore cable 30 comprises a tension member 21 (or an central interposition), the four coaxial cable units 31A formed by that a plurality of the coaxial cables 10B shown in FIG. 15 are bound up, disposed on an outer circumference of the tension member 21, twisted together collectively, and wound by a binding tape 23, and a shield 25 and a sheath 27 disposed on an outside of the binding tape 23.

Multicore Cable with Multicore Ribbon Cable

Figure 18:
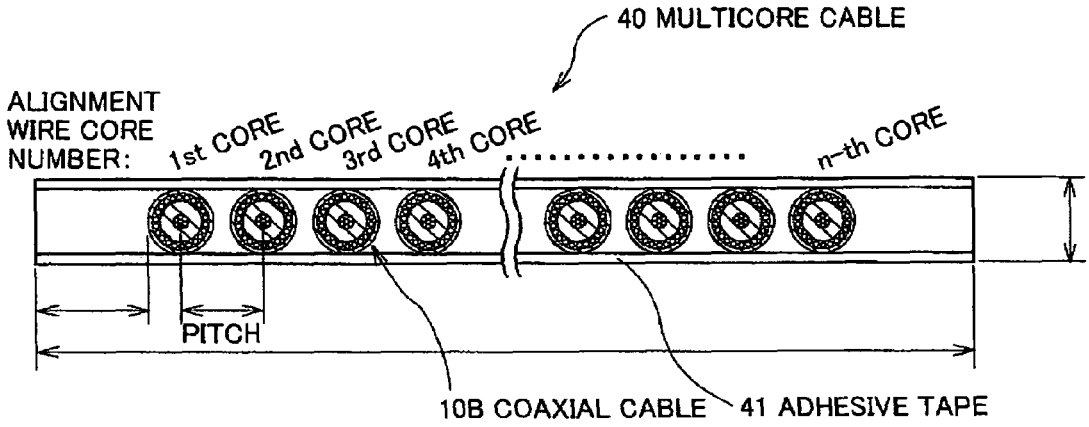
FIG. 18 is a cross sectional view showing a multicore cable in the other preferred embodiment according to the invention.

FIG. 18 is a cross sectional view showing a multicore cable in the other preferred embodiment according to the invention.

The multicore cable 40 comprises a multicore ribbon cable comprising a juxtaposing member formed by that a plurality of the coaxial cables 10B shown in FIG. 15 are juxtaposed at a constant pitch and adhesive tapes 41 laminated to both surfaces of the juxtaposing member.

Manufacturing Method

Hereinafter, a manufacturing method of the copper alloy wire and the copper alloy twisted wire in a preferred embodiment according to the invention will be explained.

The manufacturing method comprises the following steps. First, adding silver of 1 to 3 weight %, preferably 1.5 to 2.5 to a pure copper, so as to produce a copper alloy. After that, conducting a wire drawing work or interposing a heat treatment during the wire drawing work, so as to form an extra-fine wire comprising a wire diameter of 0.010 to 0.025 mm. In this case, it can be adopted to plate the extra-fine wire comprising an intermediate wire diameter with a tin (Sn), silver (Ag) or a nickel (Ni), so as to finally obtain the extra-fine wire comprising the wire diameter of 0.010 to 0.025 mm.

Next, conducting a heat treatment under a specific condition to the one extra-fine copper alloy wire or extra-fine copper alloy twisted wire formed by that predetermined number of wires, for example, seven extra-fine wires are twisted together. The heat treatment is conducted by running the extra-fine wire or the twisted wire in a heating furnace heated at a temperature of 300 to 500° C. for 0.2 to 5 seconds, preferably 0.5 to 1.5 seconds. As a condition of the heat treatment, a temperature of 300 to 500° C. and a time of 0.2 to 5 seconds are adopted, for the reason that if the temperature is less than 300° C. and the time is less than 0.5 seconds, a lowering of the tensile strength is small, but an increase in the electrical conductivity is also small so that a desired characteristic can not be obtained. Further, if the temperature is more than 500° C. and the time is more than 5 seconds, the increase in the electrical conductivity is extremely large, but the lowering of the tensile strength also extremely large so that a desired characteristic can not be obtained.

Further, the heat treatment is conducted at the time of preferably 0.5 to 1.5 seconds, so that a performance satisfying at a maximum both characteristics of the tensile strength and the electrical conductivity can be obtained.

The extra-fine copper alloy wire or the extra-fine copper alloy twisted wire obtained by the treating described above comprises the wire diameter of 0.010 to 0.025 mm, the silver content of 1 to 3 weight %, preferably 1.5 to 2.5 weight %, the tensile strength of 850 MPa or more, the electrical conductivity of 85% IACS or more.

Advantages of the Embodiment

According to the preferred embodiment an extra-fine copper alloy wire and an extra-fine copper alloy twisted wire are provided, that comprise a final wire diameter of not more than 0.025 mm, satisfy both of a high strength characteristic and a low resistance characteristic (a high electrical conductivity), and also comprise a high heat resistance so that a lowering of a strength property is suppressed even in a heat load work such as a foam extrusion making work, a soldering work at a terminal portion.

Therefore, the coaxial cable made by using the extra-fine copper alloy wire and the extra-fine copper alloy twisted wire are suitably applied to a cable for an electronics device and a medical device, the cable required a downsizing, a diameter thinning, a weight saving, a high flexibility, a high transmission performance.

EXAMPLES

Examples according to the invention will be detailed below.

Example 1

Manufacture of Cu—Ag Alloy Wire

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm.

After that, a wire drawing work, a process annealing, a wire drawing work, and silver plating process were conducted in order, and a wire drawing work was continuously conducted so that extra-fine copper alloy wires comprising the wire diameter of 0.010 to 0.025 mm were obtained. Then the extra-fine copper alloy wires being obtained were heat-treated in a heat treating condition within a stipulated range, so that the extra-fine copper alloy wires comprising various wire diameters respectively were obtained.

By each wire diameter of the extra-fine copper alloy wires obtained, a tensile strength (MPa), an electrical conductivity (% IACS), and an elongation (%) were measured. Further, in order to evaluate a heat resistance a heat treatment of 350° C. and 5.0 seconds was conducted, and a strength change of the tensile strength (MPa) after the heat treatment was investigated. The heat resistance was evaluated by a lowering rate of the tensile strength (MPa), and the lowering rate of the tensile strength (MPa) was defined as the lowering rate of the tensile strength ($\sigma_{h1}$) after the heat treatment to the tensile strength ($\sigma_{h0}$) before the heat treatment represented as a formula [$(1-\sigma_{h1}/\sigma_{h0})\times 100\%$]. The result is shown in Table 1.

TABLE 1

| No. | Wire Diameter (mm) | Ag Concentration (weight %) | Tensile Strength (MPa) | Electric Conductivity (% IACS) | Elongation (%) | Heat Resistance (%) | Heat Treatment (° C. × sec.) |
|---|---|---|---|---|---|---|---|
| 1 | 0.025 | 2.0 | 952 | 86.2 | 1.3 | 1.3 | 350 × 5.0 |
| 2 | 0.025 | 2.0 | 915 | 88.3 | 1.5 | 1.2 | 450 × 1.5 |
| 3 | 0.025 | 2.0 | 910 | 87.2 | 1.4 | 1.1 | 500 × 0.4 |
| 4 | 0.023 | 2.0 | 960 | 86.4 | 1.2 | 1.2 | 350 × 5.0 |
| 5 | 0.023 | 2.0 | 920 | 88.1 | 1.0 | 1.1 | 450 × 1.5 |
| 6 | 0.023 | 2.0 | 915 | 87.6 | 1.5 | 1.2 | 500 × 0.4 |
| 7 | 0.020 | 2.0 | 954 | 86.0 | 1.2 | 1.0 | 350 × 5.0 |

TABLE 1-continued

| No. | Wire Diameter (mm) | Ag Concentration (weight %) | Tensile Strength (MPa) | Electric Conductivity (% IACS) | Elongation (%) | Heat Resistance (%) | Heat Treatment (° C. × sec.) |
|---|---|---|---|---|---|---|---|
| 8 | 0.020 | 2.0 | 930 | 87.2 | 1.4 | 0.5 | 450 × 1.5 |
| 9 | 0.020 | 2.0 | 925 | 86.5 | 1.3 | 0.6 | 500 × 0.4 |
| 10 | 0.018 | 2.0 | 965 | 87.8 | 1.4 | 1.2 | 350 × 5.0 |
| 11 | 0.018 | 2.0 | 925 | 88.1 | 1.5 | 1.0 | 450 × 1.5 |
| 12 | 0.018 | 2.0 | 920 | 87.1 | 1.4 | 1.0 | 500 × 0.4 |
| 13 | 0.016 | 2.0 | 962 | 86.8 | 1.3 | 1.2 | 350 × 5.0 |
| 14 | 0.016 | 2.0 | 935 | 87.4 | 1.2 | 1.3 | 450 × 1.5 |
| 15 | 0.016 | 2.0 | 923 | 87.2 | 1.4 | 1.3 | 500 × 0.4 |
| 16 | 0.013 | 2.0 | 975 | 86.0 | 1.2 | 1.1 | 350 × 5.0 |
| 17 | 0.013 | 2.0 | 950 | 86.3 | 1.0 | 1.2 | 450 × 1.5 |
| 18 | 0.013 | 2.0 | 940 | 86.2 | 1.3 | 1.0 | 500 × 0.4 |
| 19 | 0.010 | 2.0 | 985 | 87.5 | 1.2 | 1.2 | 350 × 5.0 |
| 20 | 0.010 | 2.0 | 950 | 86.5 | 1.0 | 1.4 | 450 × 1.5 |
| 21 | 0.010 | 2.0 | 935 | 87.1 | 1.3 | 1.2 | 500 × 0.4 |

Example 2

Manufacture of Cu—Ag Alloy Twisted Wire

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm.

After that, a wire drawing work, a process annealing, a wire drawing work, and silver plating process were conducted in order, and a wire drawing work was continuously conducted so that extra-fine copper alloy wires comprising the wire diameter of 0.010 to 0.025 mm were obtained. Further, the seven extra-fine copper alloy wires obtained were twisted together by each wire diameter, so that extra-fine copper alloy twisted wires were obtained. Then the extra-fine copper alloy twisted wires being obtained were heat-treated in a heat treating condition within a stipulated range, so that the extra-fine copper alloy twisted wires comprising various wire diameters respectively were obtained.

By each wire diameter of the extra-fine copper alloy twisted wires obtained, a tensile strength (MPa), an electrical conductivity (% IACS), and an elongation (%) were measured. Further, in order to evaluate a heat resistance a heat treatment of 350° C. and 5.0 seconds was conducted, and a strength change of the tensile strength (MPa) after the heat treatment was investigated. The heat resistance was evaluated by a lowering rate of the tensile strength (MPa) similarly to Example 1, and the lowering rate of the tensile strength (MPa) was defined as the lowering rate of the tensile strength ($\sigma_{h1}$) after the heat treatment to the tensile strength ($\sigma_{h0}$) before the heat treatment represented as a formula $[(1-\sigma_{h1}/\sigma_{h0})\times 100\%]$. The result is shown in Table 2.

TABLE 2

| No. | Number of Wires/ Wire Diameter (wires/mm) | Ag Concentration (weight %) | Tensile Strength (MPa) | Electric Resistance (Ω/km) | Elongation (%) | Heat Resistance (%) | Heat Treatment (° C. × sec.) |
|---|---|---|---|---|---|---|---|
| 1 | 7/0.025 | 2.0 | 932 | 5,630 | 2.0 | 1.0 | 350 × 5.0 |
| 2 | 7/0.025 | 2.0 | 905 | 5,500 | 2.4 | 1.2 | 450 × 1.5 |
| 3 | 7/0.025 | 2.0 | 910 | 5,600 | 2.2 | 1.3 | 500 × 0.4 |
| 4 | 7/0.023 | 2.0 | 942 | 6,680 | 2.4 | 1.2 | 350 × 5.0 |
| 5 | 7/0.023 | 2.0 | 910 | 6,500 | 2.5 | 1.1 | 450 × 1.5 |
| 6 | 7/0.023 | 2.0 | 910 | 6,620 | 2.3 | 1.3 | 500 × 0.4 |
| 7 | 7/0.020 | 2.0 | 955 | 8,850 | 2.2 | 1.0 | 350 × 5.0 |
| 8 | 7/0.020 | 2.0 | 920 | 8,700 | 2.4 | 0.5 | 450 × 1.5 |
| 9 | 7/0.020 | 2.0 | 915 | 8,800 | 2.3 | 0.8 | 500 × 0.4 |
| 10 | 7/0.018 | 2.0 | 943 | 11,000 | 2.3 | 1.2 | 350 × 5.0 |
| 11 | 7/0.018 | 2.0 | 915 | 10,900 | 2.5 | 1.0 | 450 × 1.5 |
| 12 | 7/0.018 | 2.0 | 920 | 10,950 | 2.4 | 1.0 | 500 × 0.4 |
| 13 | 7/0.016 | 2.0 | 945 | 14,080 | 2.3 | 1.2 | 350 × 5.0 |
| 14 | 7/0.016 | 2.0 | 925 | 14,000 | 2.2 | 1.3 | 450 × 1.5 |
| 15 | 7/0.016 | 2.0 | 930 | 14,000 | 2.3 | 1.2 | 500 × 0.4 |
| 16 | 7/0.013 | 2.0 | 954 | 20,550 | 2.2 | 1.3 | 350 × 5.0 |
| 17 | 7/0.013 | 2.0 | 940 | 20,500 | 2.0 | 1.2 | 450 × 1.5 |
| 18 | 7/0.013 | 2.0 | 945 | 20,500 | 2.4 | 1.0 | 500 × 0.4 |
| 19 | 7/0.010 | 2.0 | 955 | 37,100 | 2.2 | 1.3 | 350 × 5.0 |
| 20 | 7/0.010 | 2.0 | 950 | 37,000 | 2.0 | 1.4 | 450 × 1.5 |
| 21 | 7/0.010 | 2.0 | 945 | 37,080 | 2.3 | 1.2 | 500 × 0.4 |

Comparative Example 1

Manufacture of Cu—Ag Alloy Wire

Extra-fine copper alloy wires were made by adopting an additive amount of silver or the heat treating condition out of the stipulated range in the invention. The other conditions were similar to Example 1. The result is shown in Table 3.

TABLE 3

| No. | Wire Diameter (mm) | Ag Concentration (weight %) | Tensile Strength (MPa) | Electric Conductivity (% IACS) | Elongation (%) | Heat Resistance (%) | Heat Treatment (° C. × sec.) |
|---|---|---|---|---|---|---|---|
| 1 | 0.023 | 2.0 | 1025 | 83.5 | 1.0 | 5.0 | No treatment |
| 2 | 0.023 | 0.5 | 750 | 90.5 | 1.5 | 3.5 | 450 × 1.5 |
| 3 | 0.023 | 3.5 | 1100 | 82.0 | 1.5 | 1.5 | 450 × 1.5 |
| 4 | 0.023 | 2.0 | 1090 | 82.4 | 1.5 | 3.0 | 250 × 5.0 |
| 5 | 0.023 | 2.0 | 700 | 88.4 | 4.0 | 1.5 | 600 × 0.2 |
| 6 | 0.023 | 2.0 | 980 | 84.0 | 1.0 | 4.5 | 450 × 0.1 |
| 7 | 0.023 | 2.0 | 800 | 88.8 | 3.5 | 1.2 | 450 × 6.0 |

Comparative Example 2

Manufacture of Cu—Ag Alloy Twisted Wire

Extra-fine copper alloy twisted wires were made by adopting the additive amount of silver or the heat treating condition out of the stipulated range in the invention. The other conditions were similar to Example 2. The result is shown in Table 4.

TABLE 4

| No. | Number of Wires/ Wire Diameter (wires/mm) | Ag Concentration (weight %) | Tensile Strength (MPa) | Electric Resistance (Ω/km) | Elongation (%) | Heat Resistance (%) | Heat Treatment (° C. × sec.) |
|---|---|---|---|---|---|---|---|
| 1 | 7/0.023 | 2.0 | 1020 | 6,800 | 1.1 | 5.5 | No treatment |
| 2 | 7/0.023 | 0.5 | 760 | 6,300 | 2.5 | 4.5 | 450 × 1.5 |
| 3 | 7/0.023 | 3.5 | 1150 | 7,100 | 1.7 | 2.5 | 450 × 1.5 |
| 4 | 7/0.023 | 2.0 | 1050 | 7,050 | 1.6 | 3.5 | 250 × 5.0 |
| 5 | 7/0.023 | 2.0 | 720 | 6,400 | 4.5 | 2.5 | 600 × 0.2 |
| 6 | 7/0.023 | 2.0 | 985 | 6,800 | 1.5 | 4.8 | 450 × 0.1 |
| 7 | 7/0.023 | 2.0 | 810 | 6,400 | 4.0 | 1.5 | 450 × 6.0 |

Conventional Example 1

Manufacture of Cu—Sn Alloy Wire

An oxygen free copper being added a tin of 0.3 weight % was melted by heating in a graphite crucible fixed in a vacuum chamber, and was cast continuously by using a graphite casting mold, so as to obtain roughly drawn wires comprising a wire diameter of 8.0 mm.

After that, a wire drawing work, a process annealing, a wire drawing work, and silver plating process were conducted in order, and a wire drawing work was continuously conducted so that extra-fine copper alloy wires comprising the wire diameter of 0.023 mm were obtained, and an evaluation similar to Example 1 was conducted. Further, the extra-fine copper alloy wires being obtained were heat-treated in a heat treating condition within a stipulated range in the invention, so that the extra-fine copper alloy wires to be evaluated were obtained and the wires were evaluated similarly to Example 1. The result is shown in Table 5.

Conventional Example 2

Manufacture of Cu—Sn Alloy Twisted Wire

An oxygen free copper being added a tin of 0.3 weight % was melted by heating in a graphite crucible fixed in a vacuum chamber, and was cast continuously by using a graphite casting mold, so as to obtain roughly drawn wires comprising a wire diameter of 8.0 mm.

After that, a wire drawing work, a process annealing, a wire drawing work, and silver plating process were conducted in order, and a wire drawing work was continuously conducted so that extra-fine copper alloy wires comprising the wire diameter of 0.023 mm were obtained. Further, the seven extra-fine copper alloy wires obtained were twisted together, so that extra-fine copper alloy twisted wires were obtained, and an evaluation similar to Example 2 was conducted. Furthermore, the extra-fine copper alloy twisted wires being obtained were heat-treated in a heat treating condition within a stipulated range in the invention, so that the extra-fine copper alloy twisted wires to be evaluated were obtained and the twisted wires were evaluated similarly to Example 2. The result is shown in Table 6.

TABLE 5

| No. | Wire Diameter (mm) | Concentration (weight %) | Tensile Strength (MPa) | Electric Conductivity (% IACS) | Elongation (%) | Heat Resistance (%) | Heat Treatment (° C. × sec.) |
|---|---|---|---|---|---|---|---|
| 1 | 0.023 | 0.3 | 800 | 78.0 | 1.0 | 18.0 | No treatment |
| 2 | 0.023 | 0.3 | 700 | 82.0 | 1.5 | 4.0 | 450 × 1.5 |

TABLE 6

| No. | Number of Wires/ Wire Diameter (wires/mm) | Sn Concentration (weight %) | Tensile Strength (MPa) | Electric Conductivity (% IACS) | Elongation (%) | Heat Resistance (%) | Heat Treatment (° C. × sec.) |
|---|---|---|---|---|---|---|---|
| 1 | 7/0.023 | 0.3 | 780 | 7,500 | 1.1 | 17.5 | No treatment |
| 2 | 7/0.023 | 0.3 | 710 | 7,100 | 2.5 | 4.5 | 450 × 1.5 |

Evaluation (of the extra-fine copper alloy wires and the extra-fine copper alloy twisted wires in Examples 1 to 2, Comparative Examples 1 to 2, and Conventional Examples 1 to 2)

As shown in Table 1, the extra-fine copper alloy wire of Example 1 comprises characteristics of a high strength and a high electrical conductivity, such as a tensile strength of 850 MPa or more, an electrical conductivity of 85% IACS, so that it is clear that characteristics of Example 1 is superior to Conventional Example 1 shown in Table 5. Further, it is recognized that the conventional Cu—Sn alloy wire, even if being treated by a heat treatment similar to Example 1 (No. 2 in Table 5) is less likely to satisfy both of the electrical conductivity and the tensile strength, since while the former is enhanced by the heat treatment, the latter is largely lowered.

As shown in Table 2, the extra-fine copper alloy twisted wire of Example 2 comprises characteristics of a higher strength and a lower electric resistance in comparison with characteristics of Conventional Example 2 shown in Table 6, so that the wire of Example 2 is most suitably applied to a coaxial cable intended to realize a downsizing of a diameter. Further, it is recognized that the conventional Cu—Sn alloy twisted wire, even if being treated by a heat treatment similar to Example 2 (No. 2 in Table 6) is less likely to satisfy both of the electric resistance and the tensile strength, since while the former is decreased by the heat treatment, the latter is largely lowered.

Further, the extra-fine copper alloy twisted wire of Example 2 comprises a high heat resistance since the wire comprises a small lowering rate of the tensile strength of approx. 1.0%, that is, comprises a large thermal stability. On the other hand, the twisted wire of Conventional Example 2 (No. 1 in Table 6) comprises a low heat resistance since the wire comprises a large lowering rate of the tensile strength of 17.5%. And, the twisted wire of Conventional Example 2, even if being treated by the heat treatment similar to Example 2 (No. 2 in Table 6) comprises the lowering rate remaining large as 4.5%. In order to evaluate the difference of the heat resistance described above, an extruding experiment was conducted to insulation members comprising the extra-fine copper alloy twisted wires of Example 2 (No. 5 in Table 2) and Conventional Example 2 (Nos. 1, 2 in Table 6). As the result, the extra-fine copper alloy twisted wire of Example 2 (No. 5 in Table 2) could be well extruded, but in the twisted wire of Conventional Example 2 (Nos. 1, 2 in Table 6) a breaking of wire was caused during the extrusion. Therefore, it is clear that the extra-fine copper alloy twisted wire of Example 2 is superior to the extra-fine copper alloy twisted wire of Comparative Example 2 in the heat resistance.

Table 3 shows an evaluation result of the extra-fine copper alloy wires made in a condition out of the stipulated range in the invention. No. 1 was not applied the heat treatment so that while the tensile strength is high, the electrical conductivity is low. Further, as to No. 1 the lowering rate of the tensile strength showing the heat resistance is also large as 5%. Nos. 2, 3 were made in a condition out of the additive amount of silver (silver concentration) in the invention, when the silver concentration is small while the electrical conductivity is high, the strength is low, and when the silver concentration is large while the strength is high, the electrical conductivity is low. Nos. 4, 5 were made within the range of the heat treatment time and out of the range of the heat treatment temperature, so that they are less likely to satisfy both of the tensile strength and the electrical conductivity. Nos. 6, 7 were made within the range of the heat treatment temperature and out of the range of the heat treatment time, so that they are similarly less likely to satisfy both of the tensile strength and the electrical conductivity.

Table 4 shows an evaluation result of the extra-fine copper alloy twisted wires made in a condition out of the stipulated range in the invention. No. 1 was not applied the heat treatment so that while the tensile strength is high, the electric resistance is high. Further, as to No. 1 the lowering rate of the tensile strength showing the heat resistance is also large as 5.5%. Nos. 2, 3 were made in a condition out of the additive amount of silver (silver concentration) in the invention, when the silver concentration is small while the electric resistance is low, the strength is low, and when the silver concentration is large while the strength is high, the electric resistance is high. Nos. 4, 5 were made within the range of the heat treatment time and out of the range of the heat treatment temperature, so that they are less likely to satisfy both of the tensile strength and the electric resistance. Nos. 6, 7 were made within the range of the heat treatment temperature and out of the range of the heat treatment time, so that they are similarly less likely to satisfy both of the tensile strength and the electric resistance.

Other Embodiments

As an additive element to the copper alloy, one or two kind(s) of metal(s) selected from magnesium (Mg) and indium (In) other than silver (Ag) can be added by total amount of 0.02 to 0.10 weight %. Increase of the additive element leads to increase of a production cost, but it is expected that the strength can be further enhanced.

Further, the extra-fine Cu—Ag alloy wire can be applied to all the fields required both of the strength and an electrical conductivity, such as not only fields of an electronics device and a medical device, but also a field of an enameled wire etc.

Example 3

Manufacture of Coaxial Wire of 43 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 1 μm, and a wire drawing work was continuously conducted so that extra-fine copper alloy wires comprising the wire diameter of 0.023 mm were obtained. Further, the seven Ag-plated copper alloy (Cu-2% Ag) wires with a wire diameter of 0.023 mm were twisted together at a pitch of 1.1 mm, so that a twisted wire with an outer diameter of 0.069 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, the tensile strength and the electric resistance before and after the heat treatment, and the electrical conductivity after the heat treatment were measured, and a changing rate of the tensile strength and the electric resistance were calculated. Further, the changing rate was calculated according to the formula [(value before heat treatment−value after heat treatment)/value before heat treatment]×100%. The result is shown in Table 7.

Further, a PFA resin of 0.053 mm in thickness was extruded and formed on an outer circumference of the twisted wire, so as to form a solid inside insulating member of 0.175 mm in outer diameter. A Cu—In—Sn alloy wire of 0.025 mm in wire diameter (including 0.19 weight % of Sn, and 0.20 weight % of In) was laterally wound on an outer circumference of the inside insulating member, so as to form an outer conductor, and a jacket formed of the PFA resin of 0.03 mm in thickness was formed on an outer circumference of the outer conductor, so as to obtain a coaxial cable of 0.285 mm in outer diameter.

Example 4

Manufacture of Coaxial Wire of 43 AWG

A coaxial wire in Example 4 was made by a process similar to Example 3 except that the heat treatment was conducted at 450° C. for 1.5 seconds.

Example 5

Manufacture of Coaxial Wire of 43 AWG

A coaxial wire in Example 5 was made by a process similar to Example 3 except that the heat treatment was conducted at 500° C. for 0.4 seconds.

Example 6

Manufacture of Coaxial Wire of 44 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.9 μm, and a wire drawing work was continuously conducted so that extra-fine copper alloy wires comprising the wire diameter of 0.020 mm were obtained. Further, the Ag-plated copper alloy (Cu-2% Ag) wires with a wire diameter of 0.020 mm were twisted together at a pitch of 1.0 mm, so that a twisted wire with an outer diameter of 0.06 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 3, the tensile strength and the electric resistance before and after the heat treatment, and the electrical conductivity after the heat treatment were measured, and the changing rate of the tensile strength and the electric resistance were calculated. The result is shown in Table 7.

Further, a PFA resin of 0.048 mm in thickness was extruded and formed on an outer circumference of the twisted wire, so as to form a solid inside insulating member of 0.156 mm in outer diameter. A Cu—In—Sn alloy wire of 0.020 mm in wire diameter (including 0.19 weight % of Sn, and 0.20 weight % of In) was laterally wound on an outer circumference of the inside insulating member, so as to form an outer conductor, and a jacket formed of the PFA resin of 0.03 mm in thickness was formed on an outer circumference of the outer conductor, so as to obtain a coaxial cable of 0.256 mm in outer diameter.

Example 7

Manufacture of Coaxial Wire of 44 AWG

A coaxial wire in Example 7 was made by a process similar to Example 6 except that the heat treatment was conducted at 450° C. for 1.5 seconds.

Example 8

Manufacture of Coaxial Wire of 44 AWG

A coaxial wire in Example 8 was made by a process similar to Example 6 except that the heat treatment was conducted at 500° C. for 0.4 seconds.

Example 9

Manufacture of Coaxial Wire of 45 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.8 μm, and a wire drawing work was continuously conducted so that extra-fine copper alloy wires comprising the wire diameter of 0.018 mm were obtained. Further, the seven Ag-plated copper alloy (Cu-2% Ag) wires with a wire diameter of 0.018 mm were twisted together at a pitch of 0.8 mm, so that a twisted wire with an outer diameter of 0.054 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 3, the tensile strength and the electric resistance before and after the heat treatment, and the electrical conductivity after the heat-treatment were measured, and the changing rate of the tensile strength and the electric resistance were calculated. The result is shown in Table 7.

Further, a PFA resin of 0.038 mm in thickness was extruded and formed on an outer circumference of the twisted wire, so as to form a solid inside insulating member of 0.130 mm in outer diameter. A Cu—In—Sn alloy wire of 0.020 mm in wire diameter (including 0.19 weight % of Sn, and 0.20 weight % of In) was laterally wound on an outer circumference of the inside insulating member, so as to form an outer conductor, and a jacket formed of the PFA resin of 0.025 mm in thickness was formed on an outer circumference of the outer conductor, so as to obtain a coaxial cable of 0.220 mm in outer diameter.

Example 10

Manufacture of Coaxial Wire of 45 AWG

A coaxial wire in Example 10 was made by a process similar to Example 9 except that the heat treatment was conducted at 450° C. for 1.5 seconds.

Example 11

Manufacture of Coaxial Wire of 45 AWG

A coaxial wire in Example 11 was made by a process similar to Example 9 except that the heat treatment was conducted at 500° C. for 0.4 seconds.

Example 12

Manufacture of Coaxial Wire of 46 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.7 μm, and a wire drawing work was continuously conducted so that extra-fine copper alloy wires comprising the wire diameter of 0.016 mm were obtained. Further, the seven Ag-plated copper alloy (Cu-2% Ag) wires with a wire diameter of 0.016 mm were twisted together at a pitch of 0.8 mm, so that a twisted wire with an outer diameter of 0.048 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 3, the tensile strength and the electric resistance before and after the heat treatment, and the electrical conductivity after the heat treatment were measured, and the changing rate of the tensile strength and the electric resistance were calculated. The result is shown in Table 7.

Further, a PFA resin of 0.033 mm in thickness was extruded and formed on an outer circumference of the twisted wire, so as to form a solid inside insulating member of 0.114 mm in outer diameter. A Cu—In—Sn alloy wire of 0.020 mm in wire diameter (including 0.19 weight % of Sn, and 0.20 weight % of In) was laterally wound on an outer circumference of the inside insulating member, so as to form an outer conductor, and a jacket formed of the PFA resin of 0.025 mm in thickness was formed on an outer circumference of the outer conductor, so as to obtain a coaxial cable of 0.204 mm in outer diameter.

Example 13

Manufacture of Coaxial Wire of 46 AWG

A coaxial wire in Example 13 was made by a process similar to Example 12 except that the heat treatment was conducted at 450° C. for 1.5 seconds.

Example 14

Manufacture of Coaxial Wire of 46 AWG

A coaxial wire in Example 14 was made by a process similar to Example 12 except that the heat treatment was conducted at 500° C. for 0.4 seconds.

Example 15

Manufacture of Coaxial Wire of 47 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.6 μm, and a wire drawing work was continuously conducted so that extra-fine copper alloy wires comprising the wire diameter of 0.015 mm were obtained. Further, the seven Ag-plated copper alloy (Cu-2% Ag) wires with a wire diameter of 0.015 mm were twisted together at a pitch of 0.8 mm, so that a twisted wire with an outer diameter of 0.045 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 3, the tensile strength and the electric resistance before and after the heat treatment, and the electrical conductivity after the heat treatment were measured, and the changing rate of the tensile strength and the electric resistance were calculated. The result is shown in Table 7.

Further, a PFA resin of 0.030 mm in thickness was extruded and formed on an outer circumference of the twisted wire, so as to form a solid inside insulating member of 0.105 mm in outer diameter. A Cu—In—Sn alloy wire of 0.020 mm in wire diameter (including 0.19 weight % of Sn, and 0.20 weight % of In) was laterally wound on an outer circumference of the inside insulating member, so as to form an outer conductor, and a jacket formed of the PFA resin of 0.020 mm in thickness was formed on an outer circumference of the outer conductor, so as to obtain a coaxial cable of 0.185 mm in outer diameter.

Example 16

Manufacture of Coaxial Wire of 47 AWG

A coaxial wire in Example 16 was made by a process similar to Example 15 except that the heat treatment was conducted at 450° C. for 1.5 seconds.

Example 17

Manufacture of Coaxial Wire of 47 AWG

A coaxial wire in Example 14 was made by a process similar to Example 15 except that the heat treatment was conducted at 500° C. for 0.4 seconds.

Example 18

Manufacture of Coaxial Wire of 48 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.5 μm, and a wire drawing work was continuously conducted so that extra-fine copper alloy wires comprising the wire diameter of 0.013 mm were obtained. Further, the seven Ag-plated copper alloy (Cu-2% Ag) wires with a wire diameter of 0.013 mm were twisted together at a pitch of 0.7 mm, so that a twisted wire with an outer diameter of 0.039 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 3, the tensile strength and the electric resistance before and after the heat treatment, and the electrical conductivity after the heat treatment were measured, and the changing rate of the tensile strength and the electric resistance were calculated. The result is shown in Table 7.

Further, a PFA resin of 0.027 mm in thickness was extruded and formed on an outer circumference of the twisted wire, so as to form-a solid inside insulating member of 0.093 mm in outer diameter. A Cu—In—Sn alloy wire of 0.016 mm in wire diameter (including 0.19 weight % of Sn, and 0.20 weight % of In) was laterally wound on an outer circumference of the inside insulating member, so as to form an outer conductor, and a jacket formed of the PFA resin of 0.020 mm in thickness was formed on an outer circumference of the outer conductor, so as to obtain a coaxial cable of 0.165 mm in outer diameter.

Example 19

Manufacture of Coaxial Wire of 48 AWG

A coaxial wire in Example 19 was made by a process similar to Example 18 except that the heat treatment was conducted at 450° C. for 1.5 seconds.

Example 20

Manufacture of Coaxial Wire of 48 AWG

A coaxial wire in Example 20 was made by a process similar to Example 18 except that the heat treatment was conducted at 500° C. for 0.4 seconds.

Example 21

Manufacture of Coaxial Wire of 50 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.4 μm, and a wire drawing work was continuously conducted so that extra-fine copper alloy wires comprising the wire diameter of 0.010 mm were obtained. Further, the seven Ag-plated copper alloy (Cu-2% Ag) wires with a wire diameter of 0.010 mm were twisted together at a pitch of 0.5 mm, so that a twisted wire with an outer diameter of 0.030 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 3, the tensile strength and the electric resistance before and after the heat treatment, and the electrical conductivity after the heat treatment were measured, and the changing rate of the tensile strength and the electric resistance were calculated. The result is shown in Table 7.

Further, a PFA resin of 0.020 mm in thickness was extruded and formed on an outer circumference of the twisted wire, so as to form a solid inside insulating member of 0.07 mm in outer diameter. A Cu—In—Sn alloy wire of 0.013 mm in wire diameter (including 0.19 weight % of Sn, and 0.20 weight % of In) was laterally wound on an outer circumference of the inside insulating member, so as to form an outer conductor, and a jacket formed of the PFA resin of 0.015 mm in thickness was formed on an outer circumference of the outer conductor, so as to obtain a coaxial cable of 0.126 mm in outer diameter.

Example 22

Manufacture of Coaxial Wire of 50 AWG

A coaxial wire in Example 22 was made by a process similar to Example 21 except that the heat treatment was conducted at 450° C. for 1.5 seconds.

Example 23

Manufacture of Coaxial Wire of 50 AWG

A coaxial wire in Example 23 was made by a process similar to Example 21 except that the heat treatment was conducted at 500° C. for 0.4 seconds.

Comparative Example 3

Manufacture of Coaxial Wire of 43 AWG

A coaxial wire in Comparative Example 3 was made by a process similar to Example 3 except that the heat treatment was not conducted.

Comparative Example 4

Manufacture of Coaxial Wire of 43 AWG

A coaxial wire in Comparative Example 4 was made by a process similar to Example 4 except that the silver concentration was set to 0.5 weight %.

Comparative Example 5

Manufacture of Coaxial Wire of 43 AWG

A coaxial wire in Comparative Example 5 was made by a process similar to Example 4 except that the silver concentration was set to 3.5 weight %.

Comparative Example 6

Manufacture of Coaxial Wire of 43 AWG

A coaxial wire in Comparative Example 6 was made by a process similar to Example 3 except that the heat treatment was conducted at 250° C. for 5.0 seconds.

Comparative Example 7

Manufacture of Coaxial Wire of 43 AWG

A coaxial wire in Comparative Example 7 was made by a process similar to Example 3 except that the heat treatment was conducted at 600° C. for 0.2 seconds.

Comparative Example 8

Manufacture of Coaxial Wire of 43 AWG

A coaxial wire in Comparative Example 8 was made by a process similar to Example 3 except that the heat treatment was conducted at 450° C. for 0.1 second.

Comparative Example 9

Manufacture of Coaxial Wire of 43 AWG

A coaxial wire in Comparative Example 9 was made by a process similar to Example 3 except that the heat treatment was conducted at 450° C. for 6.0 seconds.

Conventional Example 3

Manufacture of Coaxial Wire of 43 AWG

A coaxial wire in Conventional Example 3 was made by a process similar to Example 3 except that as the additive element a tin (Sn) of 0.3 weight % was adopted instead of silver (Ag) and the heat treatment was not conducted.

Conventional Example 4

Manufacture of Coaxial Wire of 43 AWG

A coaxial wire in Conventional Example 4 was made by a process similar to Example 3 except that as the additive element a tin (Sn) of 0.3 weight % was adopted instead of silver (Ag).

Conventional Example 5

Manufacture of Coaxial Wire of 43 AWG

A coaxial wire in Conventional Example 5 was made by a process similar to Example 4 except that as the additive element a tin (Sn) of 0.3 weight % was adopted instead of silver (Ag).

Conventional Example 6

Manufacture of Coaxial Wire of 43 AWG

A coaxial wire in Conventional Example 6 was made by a process similar to Example 5 except that as the additive element a tin (Sn) of 0.3 weight % was adopted instead of silver (Ag).

Comparative Example 10

Manufacture of Coaxial Wire of 42 AWG

An oxygen free copper being added a tin (Sn) of 0.19 weight % and an indium (In) of 0.20 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 1.1 μm, and a wire drawing work was continuously conducted so that extra-fine copper alloy wires comprising the wire diameter of 0.025 mm were obtained. Further, the seven Ag-plated copper alloy (Cu-2% Ag) wires with a wire diameter of 0.025 mm were twisted together at a pitch of 1.3 mm, so that a twisted wire with an outer diameter of 0.075 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 3, the tensile strength and the electric resistance before and after the heat treatment, and the electrical conductivity after the heat treatment were measured, and the changing rate of the tensile strength and the electric resistance were calculated. The result is shown in Table 7.

Further, a PFA resin of 0.06 mm in thickness was extruded and formed on an outer circumference of the twisted wire, so as to form a solid inside insulating member of 0.195 mm in outer diameter. A Cu—In—Sn alloy wire of 0.025 mm in wire diameter (including 0.19 weight % of Sn, and 0.20 weight % of In) was laterally wound on an outer circumference of the inside insulating member, so as to form an outer conductor, and a jacket formed of the PFA resin of 0.03 mm in thickness was formed on an outer circumference of the outer conductor, so as to obtain a coaxial cable of 0.305 mm in outer diameter.

Comparative Example 11

Manufacture of Coaxial Wire of 42 AWG

A coaxial wire in Comparative Example 11 was made by a process similar to Comparative Example 10 except that the heat treatment was conducted at 450° C. for 1.5 seconds.

Comparative Example 12

Manufacture of Coaxial Wire of 42 AWG

A coaxial wire in Comparative Example 12 was made by a process similar to Comparative Example 10 except that the heat treatment was conducted at 500° C. for 0.4 seconds.

Comparative Example 13

Manufacture of Coaxial Wire of 44 AWG

A coaxial wire in Comparative Example 13 was made by a process similar to Example 6 except that as the additive element a tin (Sn) of 0.19 weight % and an indium (In) of 0.19 weight % were adopted instead of silver (Ag).

Comparative Example 14

Manufacture of Coaxial Wire of 44 AWG

A coaxial wire in Comparative Example 14 was made by a process similar to Comparative Example 13 except that the heat treatment was conducted at 450° C. for 1.5 seconds.

Comparative Example 15

Manufacture of Coaxial Wire of 44 AWG

A coaxial wire in Comparative Example 15 was made by a process similar to Comparative Example 13 except that the heat treatment was conducted at 500° C. for 0.4 seconds.

Comparative Example 16

Manufacture of Coaxial Wire of 46 AWG

A coaxial wire in Comparative Example 16 was made by a process similar to Example 12 except that as the additive element a tin (Sn) of 0.19 weight % and an indium (In) of 0.19 weight % were adopted instead of silver (Ag).

Comparative Example 17

Manufacture of Coaxial Wire of 46 AWG

A coaxial wire in Comparative Example 17 was made by a process similar to Comparative Example 16 except that the heat treatment was conducted at 450° C. for 1.5 seconds.

Comparative Example 18

Manufacture of Coaxial Wire of 46 AWG

A coaxial wire in Comparative Example 18 was made by a process similar to Comparative Example 16 except that the heat treatment was conducted at 500° C. for 0.4 seconds.

Comparative Example 19

Manufacture of Coaxial Wire of 48 AWG

A coaxial wire in Comparative Example 19 was made by a process similar to Example 18 except that as the additive element a tin (Sn) of 0.19 weight % and an indium (In) of 0.19 weight % were adopted instead of silver (Ag).

Comparative Example 20

Manufacture of Coaxial Wire of 48 AWG

A coaxial wire in Comparative Example 20 was made by a process similar to Comparative Example 19 except that the heat treatment was conducted at 450° C. for 1.5 seconds.

Comparative Example 21

Manufacture of Coaxial Wire of 48 AWG

A coaxial wire in Comparative Example 21 was made by a process similar to Comparative Example 19 except that the heat treatment was conducted at 500° C. for 0.4 seconds.

Comparative Example 22

Manufacture of Coaxial Wire of 50 AWG

A coaxial wire in Comparative Example 22 was made by a process similar to Example 21 except that as the additive element a tin (Sn) of 0.19 weight % and an indium (In) of 0.19 weight % were adopted instead of silver (Ag).

Comparative Example 23

Manufacture of Coaxial Wire of 50 AWG

A coaxial wire in Comparative Example 23 was made by a process similar to Comparative Example 22 except that the heat treatment was conducted at 450° C. for 1.5 seconds.

Comparative Example 24

Manufacture of Coaxial Wire of 50 AWG

A coaxial wire in Comparative Example 24 was made by a process similar to Comparative Example 22 except that the heat treatment was conducted at 500° C. for 0.4 seconds.

Evaluation (of the extra-fine copper alloy twisted wires in Examples 3 to 23, Comparative Examples 3 to 24, Conventional Examples 3 to 6)

Table 7 shows a measurement result of the tensile strength and the electric resistance before and after the heat treatment, and the electrical conductivity after the heat treatment, and the changing rate of tensile strength and the electric resistance of the extra-fine copper alloy twisted wires in Examples 3 to 23, Comparative Examples 3 to 24, Conventional Examples 3 to 6.

TABLE 7

| | | Additive Metal | | Tensile Strength (MPa) | | Electric Resistance (Ω/km) | | Electric | Changing Rate* (%) | |
|---|---|---|---|---|---|---|---|---|---|---|
| | Wire Size (AWG) | Concentration (weight %) | Heat Treatment (° C. × sec.) | Before Heating | After Heating | Before Heating | After Heating | Conductivity (% IACS) | Tensile Strength | Electric Resistance |
| Ex. 3 | 43 | Ag 2.0 | 350 × 5.0 | 1020 | 910 | 6,870 | 6,450 | 89.1 | 10.8 | 6.1 |
| Ex. 4 | 43 | Ag 2.0 | 450 × 1.5 | 990 | 920 | 6,950 | 6,440 | 88.8 | 7.1 | 7.3 |
| Ex. 5 | 43 | Ag 2.0 | 500 × 0.4 | 1010 | 940 | 6,890 | 6,450 | 88.3 | 6.9 | 6.4 |
| Ex. 6 | 44 | Ag 2.0 | 350 × 5.0 | 1000 | 920 | 9,420 | 8,700 | 89.5 | 8.0 | 7.6 |
| Ex. 7 | 44 | Ag 2.0 | 450 × 1.5 | 980 | 920 | 9,450 | 8,730 | 89.2 | 6.1 | 7.6 |
| Ex. 8 | 44 | Ag 2.0 | 500 × 0.4 | 990 | 930 | 9,460 | 8,780 | 88.7 | 6.1 | 7.2 |
| Ex. 9 | 45 | Ag 2.0 | 350 × 5.0 | 1000 | 915 | 11,890 | 10,900 | 87.3 | 8.5 | 8.3 |
| Ex. 10 | 45 | Ag 2.0 | 450 × 1.5 | 1010 | 940 | 11,920 | 10,950 | 86.9 | 6.9 | 8.1 |
| Ex. 11 | 45 | Ag 2.0 | 500 × 0.4 | 980 | 920 | 11,930 | 10,990 | 86.6 | 6.1 | 7.9 |
| Ex. 12 | 46 | Ag 2.0 | 350 × 5.0 | 980 | 925 | 14,950 | 14,000 | 87.9 | 5.6 | 6.4 |
| Ex. 13 | 46 | Ag 2.0 | 450 × 1.5 | 990 | 930 | 14,920 | 13,980 | 88.0 | 6.1 | 6.3 |
| Ex. 14 | 46 | Ag 2.0 | 500 × 0.4 | 980 | 940 | 14,960 | 13,970 | 88.1 | 4.1 | 6.6 |
| Ex. 15 | 47 | Ag 2.0 | 350 × 5.0 | 1030 | 960 | 16,480 | 15,300 | 91.1 | 6.8 | 7.2 |
| Ex. 16 | 47 | Ag 2.0 | 450 × 1.5 | 1010 | 940 | 16,520 | 15,340 | 90.8 | 6.9 | 7.1 |
| Ex. 17 | 47 | Ag 2.0 | 500 × 0.4 | 990 | 930 | 16,470 | 15,320 | 91.0 | 6.1 | 7.0 |
| Ex. 18 | 48 | Ag 2.0 | 350 × 5.0 | 1120 | 940 | 21,960 | 20,500 | 91.6 | 16.1 | 6.6 |
| Ex. 19 | 48 | Ag 2.0 | 450 × 1.5 | 1040 | 930 | 21,980 | 20,200 | 91.3 | 10.6 | 8.1 |
| Ex. 20 | 48 | Ag 2.0 | 500 × 0.4 | 990 | 920 | 21,950 | 20,250 | 91.0 | 7.1 | 7.7 |
| Ex. 21 | 50 | Ag 2.0 | 350 × 5.0 | 1090 | 950 | 37,100 | 34,700 | 91.0 | 12.8 | 6.5 |
| Ex. 22 | 50 | Ag 2.0 | 450 × 1.5 | 1020 | 930 | 37,300 | 34,900 | 90.5 | 8.8 | 6.4 |
| Ex. 23 | 50 | Ag 2.0 | 500 × 0.4 | 990 | 930 | 37,400 | 34,700 | 91.0 | 6.1 | 7.2 |
| Comp. 3 | 43 | Ag 2.0 | No treatment | 1020 | — | 6,870 | — | 83.6 | — | — |
| Comp. 4 | 43 | Ag 0.5 | 450 × 1.5 | 840 | 760 | 6,420 | 6,300 | 91.2 | 9.5 | 2 |
| Comp. 5 | 43 | Ag 3.5 | 450 × 1.5 | 1,200 | 1,150 | 7,170 | 7,100 | 80.9 | 4.2 | 1 |
| Comp. 6 | 43 | Ag 2.0 | 250 × 5.0 | 1,080 | 1,050 | 6,870 | 6,830 | 84.1 | 2.8 | 0.5 |
| Comp. 7 | 43 | Ag 2.0 | 600 × 0.2 | 990 | 720 | 6,870 | 6,400 | 89.7 | 27.3 | 6.8 |
| Comp. 8 | 43 | Ag 2.0 | 450 × 0.1 | 1,020 | 985 | 6,870 | 6,800 | 84.5 | 3.4 | 1 |
| Comp. 9 | 43 | Ag 2.0 | 450 × 6.0 | 1,040 | 810 | 6,870 | 6,400 | 89.8 | 22.1 | 6.8 |
| Conv. 3 | 43 | Sn 0.3 | No treatment | 780 | — | 7,570 | — | 76.6 | — | — |
| Conv. 4 | 43 | Sn 0.3 | 350 × 5.0 | 870 | 730 | 7,500 | 7,480 | 77.5 | 4.6 | 0.3 |
| Conv. 5 | 43 | Sn 0.3 | 450 × 1.5 | 850 | 730 | 7,490 | 7,460 | 77.5 | 14.1 | 0.4 |
| Conv. 6 | 43 | Sn 0.3 | 500 × 0.4 | 880 | 710 | 7,570 | 7,500 | 77.3 | 9 | 0.9 |
| Comp. 10 | 42 | Sn 0.19 In 0.19 | 350 × 5.0 | 850 | 750 | 6,300 | 6,100 | 82.3 | 13 | 3.2 |
| Comp. 11 | 42 | Sn 0.19 In 0.19 | 450 × 1.5 | 880 | 760 | 6,370 | 6,260 | 80.2 | 13.6 | 1.7 |
| Comp. 12 | 42 | Sn 0.19 In 0.19 | 500 × 0.4 | 870 | 750 | 6,340 | 6,290 | 79.8 | 13.8 | 0.8 |
| Comp. 13 | 44 | Sn 0.19 In 0.19 | 350 × 5.0 | 850 | 750 | 9,800 | 9,600 | 81.1 | 11.8 | 2.0 |
| Comp. 14 | 44 | Sn 0.19 In 0.19 | 450 × 1.5 | 860 | 770 | 9,760 | 9,650 | 80.7 | 10.5 | 1.1 |
| Comp. 15 | 44 | Sn 0.19 In 0.19 | 500 × 0.4 | 840 | 750 | 9,780 | 9,710 | 80.2 | 10.7 | 0.6 |

TABLE 7-continued

| | Wire Size (AWG) | Additive Metal Concentration (weight %) | Heat Treatment (° C. × sec.) | Tensile Strength (MPa) Before Heating | Tensile Strength (MPa) After Heating | Electric Resistance (Ω/km) Before Heating | Electric Resistance (Ω/km) After Heating | Electric Conductivity (% IACS) | Changing Rate* (%) Tensile Strength | Changing Rate* (%) Electric Resistance |
|---|---|---|---|---|---|---|---|---|---|---|
| Comp. 16 | 46 | Sn 0.19 In 0.19 | 350 × 5.0 | 850 | 750 | 15,300 | 14,990 | 82.1 | 11.8 | 2.0 |
| Comp. 17 | 46 | Sn 0.19 In 0.19 | 450 × 1.5 | 840 | 770 | 15,280 | 15,150 | 81.2 | 8.3 | 0.9 |
| Comp. 18 | 46 | Sn 0.19 In 0.19 | 500 × 0.4 | 850 | 780 | 15,330 | 15,030 | 81.9 | 8.2 | 2.0 |
| Comp. 19 | 48 | Sn 0.19 In 0.19 | 350 × 5.0 | 840 | 760 | 23,700 | 22,990 | 81.7 | 9.5 | 3.0 |
| Comp. 20 | 48 | Sn 0.19 In 0.19 | 450 × 1.5 | 830 | 750 | 23,800 | 23,200 | 81.0 | 9.6 | 2.5 |
| Comp. 21 | 48 | Sn 0.19 In 0.19 | 500 × 0.4 | 840 | 780 | 23,700 | 23,100 | 81.3 | 7.1 | 2.5 |
| Comp. 22 | 50 | Sn 0.19 In 0.19 | 350 × 5.0 | 830 | 770 | 39,800 | 38,600 | 81.8 | 7.2 | 3.0 |
| Comp. 23 | 50 | Sn 0.19 In 0.19 | 450 × 1.5 | 820 | 740 | 39,600 | 38,500 | 82.0 | 9.8 | 2.8 |
| Comp. 24 | 50 | Sn 0.19 In 0.19 | 500 × 0.4 | 840 | 760 | 39,900 | 38,700 | 81.6 | 9.5 | 3.0 |

*Changing rate = [(value before heat treatment − value after heat treatment)/value before heat treatment] × 100%

As shown in Table 7, in the seven-wire twisted wire of Examples 3 to 5 (43 AWG), the additive element concentration and the heat treatment condition were pertinent, so that the lowering rate of the tensile strength remained at 6.9 to 10.8%, and the tensile strength after the heat treatment was 910 MPa, so that the tensile strength of 850 MPa or more of a target value could be achieved. Further, the lowering rate of the electric resistance was notably large as 6.1 to 7.3% (the changing rate of the electric resistance of 6% or more) and the electric resistance after the heat treatment was 6450 Ω/km, so that a high electrical conductivity wire material comprising the electrical conductivity of 85% or more could be obtained.

On the other hand, in the seven-wire twisted wire formed of Cu—Sn alloy wires of Conventional Examples 3 to 6 (43 AWG), the tensile strength thereof was lowered below 850 MPa, and even if the heat treatment according to the invention was similarly conducted to the conventional Cu—Sn alloy wire (Conventional Examples 4 to 6) the tensile strength was lowered largely as 710 to 730 MPa and the lowering rate of the electric resistance was suppressed not more than 0.9%, so that it is difficult to obtain characteristics satisfying both of a high strength and a high electrical conductivity.

In the seven-wire twisted wire formed of conventional Cu—Sn—In alloy wires (refer to Comparative Examples 10 to 24), the tensile strength after the heat treatment was lowered below 850 MPa, so that a high strength wire material could not be obtained.

In Comparative Example 3 the heat treatment was not conducted, so that while the tensile strength was high, the electric resistance was high as 6870 Ω/km and the high electrical conductivity wire material comprising the electrical conductivity of 85% could not be obtained.

In Comparative Example 4 the silver concentration was too small as 0.5 weight %, so that the tensile strength was lowered below 850 MPa of a target value and the lowering rate of the electric resistance remained at 2%. Therefore, it was recognized that it is difficult to obtain characteristics satisfying both of a high strength and a low electric resistance.

In Comparative Example 5 the silver concentration was too large as 3.5 weight %, so that the lowering rate of the electric resistance remained at 1%. Therefore, it was recognized that it is difficult to obtain characteristics satisfying both of a high strength and a low electric resistance.

In Comparative Example 6 the heat treatment temperature was low as 250° C., so that the lowering rate of the electric resistance remained at 0.5%. Therefore, it was recognized that it is difficult to obtain characteristics satisfying both of a high strength and a low electric resistance.

In Comparative Example 7 the heat treatment temperature was high as 600° C., so that the lowering rate of the tensile strength was notably large as 27.3%. Therefore, it was recognized that it is difficult to obtain characteristics satisfying both of a high strength and a low electric resistance.

In Comparative Example 8 the heat treatment time was short as 0.1 second, so that the lowering rate of the electric resistance remained at 1%. Therefore, it was recognized that it is difficult to obtain characteristics satisfying both of a high strength and a low electric resistance.

In Comparative Example 9 the heat treatment time was long as 6.0 seconds, so that the lowering rate of the tensile strength was large as 22.1% and the tensile strength was low as 810 MPa. Therefore, it was recognized that it is difficult to obtain characteristics satisfying both of a high strength and a low electric resistance.

Comparing Comparative Examples 10 to 24 with Examples 3 to 23, in the twisted wires of Comparative Examples 10 to 24 the lowering rate of the electric resistance remained to an extent of 0.8 to 3.2%, so that each of the twisted wires became a wire material comprising the electric resistance of a high value. Further, in Comparative Examples 10 to 24 the tensile strength was lowered below 850 MPa of the target value.

To sum up, Table 7 shows that in a case of using a Cu—Sn (0.19%)-In (0.19%) alloy as Comparative Examples 10 to 24 the tensile strength is lowered more than Examples 3 to 23 regardless of the heat treatment, and the electric resistance is higher than Examples 3 to 23.

Further, as explained in a paragraph of Description of the Related Art, in conventional articles, a Cu—Sn (0.19%)-In (0.19%) alloy twisted wire not heat-treated specifically has been used and a heat treatment has not been conducted separately. Therefore, it is recognized that even if in a stage of bare seven-wire twisted wire the wire comprises characteristics of a high electrical conductivity and a high tensile strength, by a heat generated at an extruding work (e.g. 400 to 300° C., 1 to 5 seconds), as shown in the alloy twisted wires in Comparative Examples 10 to 24, the lowering rate of the electric resistance is suppressed to a small value and the tensile strength is lowered more largely than before the heat treatment.

On the other hand, in the twisted wires in Examples a heat treatment is preliminarily conducted after a twist work, so that a heat history generated by the heat generated at the extruding work does not occur, and a coaxial cable can be provided, the cable comprising the tensile strength and the electric resistance not changing before and after the extruding work.

Table 7 shows that an electric characteristic of the coaxial cables in Examples are equal to the conventional coaxial cables thicker by one size than the cables in Examples (e.g. electric and mechanical characteristics of the coaxial cables of 43 AWG, 45 AWG, and 47 AWG in Examples are equal to the characteristics of the conventional coaxial cables of 42 AWG, 44 AWG, and 46 AWG). Therefore, coaxial cables of odd numbers as 43 AWG, 45 AWG, and 47 AWG are used, so that a deterioration of the electric characteristic of the coaxial cable can be prevented while a downsizing of a diameter of the coaxial cable can be realized.

Evaluation (of coaxial wires in Examples 3 to 23, Comparative Examples 3 to 24, Conventional Examples 3 to 6)

First, as to the coaxial cable of each of Examples 3 to 23, Comparative Examples 3 to 24, and Conventional Examples 3 to 6, a bending test was conducted to evaluate its bending life. The bending test is conducted such that one end portion of a sample cable (=a coaxial cable) is fixed to a jig with a bend radius of 2 mm, a weight of 50 gf or 20 gf according to the size of the sample cable is hung on the other end portion thereof, the sample cable is repeatedly bent (alternately) in the left and right directions perpendicular to the longitudinal direction of the coaxial cable at a test speed of 30 times/1 minute, the number of bends (=bending life) repeated until the breaking of the inner conductor of the sample cable is measured. Especially in this invention, a power voltage of several volts was constantly applied to the cable and the bending life is defined as the number of repeated bends at the time when the electric current value of the cable was reduced by 20% relative to that at the start of the test. Values in the following tables show the number of repeated bends when reaching the bending life.

Next, as to the coaxial cable of each of Examples 3 to 23, Comparative Examples 3 to 24, and Conventional Examples 3 to 6, its capacitance, attenuation, and characteristic impedance were evaluated.

The capacitance was measured at a frequency of 1 kHz by connecting a LCR meter in between the inner conductor and the outer conductor of the sample cable (the coaxial cable) with a length of 1 m. Further, in between the inner conductor and the outer conductor at both ends of the 1 m long sample cable, the transmitting side and the receiving side of a network analyzer were connected through measurement coaxial cables (i.e., lead wires) to evaluate its attenuation at a frequency of 10 MHz. Furthermore, before the measurement of the attenuation of the sample cable a calibration was conducted so as to eliminate an influence of the measurement coaxial cable (the lead wire). And, the characteristic impedance was measured by the network analyzer as a value at a frequency of 10 MHz.

Table 8 shows an evaluation result of the electric and mechanical characteristics.

TABLE 8

| | Wire Size | Additive Metal Concentration | Heat Treatment | Capacitance (at 1 KHz) | Attenuation (10 MHz) | Characteristic Impedance (10 MHz) | Bending Life R = 2 mm | |
|---|---|---|---|---|---|---|---|---|
| | (AWG) | (weight %) | (° C. × sec.) | (pF/m) | (dB/m) | (Ω) | W = 50 g | W = 20 g |
| Ex. 3 | 43 | Ag 2.0 | 350 × 5.0 | 111 | 0.7 | 50 | 41,300 | |
| Ex. 4 | 43 | Ag 2.0 | 450 × 1.5 | 110 | 0.7 | 50 | 42,400 | |
| Ex. 5 | 43 | Ag 2.0 | 500 × 0.4 | 110 | 0.7 | 50 | 40,900 | |
| Ex. 6 | 44 | Ag 2.0 | 350 × 5.0 | 109 | 1.0 | 50 | 45,000 | |
| Ex. 7 | 44 | Ag 2.0 | 450 × 1.5 | 110 | 1.0 | 50 | 43,900 | |
| Ex. 8 | 44 | Ag 2.0 | 500 × 0.4 | 110 | 1.0 | 50 | 43,700 | |
| Ex. 9 | 45 | Ag 2.0 | 350 × 5.0 | 115 | 1.2 | 50 | 62,000 | |
| Ex. 10 | 45 | Ag 2.0 | 450 × 1.5 | 114 | 1.2 | 50 | 61,800 | |
| Ex. 11 | 45 | Ag 2.0 | 500 × 0.4 | 115 | 1.2 | 50 | 67,300 | |
| Ex. 12 | 46 | Ag 2.0 | 350 × 5.0 | 114 | 1.3 | 50 | 98,000 | |
| Ex. 13 | 46 | Ag 2.0 | 450 × 1.5 | 116 | 1.3 | 50 | 96,700 | |
| Ex. 14 | 46 | Ag 2.0 | 500 × 0.4 | 115 | 1.3 | 50 | 100,200 | |
| Ex. 15 | 47 | Ag 2.0 | 350 × 5.0 | 116 | 1.5 | 50 | | 116,000 |
| Ex. 16 | 47 | Ag 2.0 | 450 × 1.5 | 117 | 1.5 | 50 | | 103,500 |
| Ex. 17 | 47 | Ag 2.0 | 500 × 0.4 | 117 | 1.5 | 50 | | 99,800 |
| Ex. 18 | 48 | Ag 2.0 | 350 × 5.0 | 118 | 2.0 | 50 | | 98,000 |
| Ex. 19 | 48 | Ag 2.0 | 450 × 1.5 | 118 | 2.0 | 50 | | 92,700 |
| Ex. 20 | 48 | Ag 2.0 | 500 × 0.4 | 117 | 2.0 | 50 | | 95,800 |
| Ex. 21 | 50 | Ag 2.0 | 350 × 5.0 | 118 | 3.0 | 50 | | 83,000 |
| Ex. 22 | 50 | Ag 2.0 | 450 × 1.5 | 118 | 3.0 | 50 | | 81,000 |
| Ex. 23 | 50 | Ag 2.0 | 500 × 0.4 | 117 | 3.0 | 50 | | 84,400 |
| Comp. 3 | 43 | Ag 2.0 | No treatment | 111 | 0.8 | 50 | 37,600 | |
| Comp. 4 | 43 | Ag 0.5 | 450 × 1.5 | 111 | 0.7 | 50 | 22,300 | |
| Comp. 5 | 43 | Ag 3.5 | 450 × 1.5 | 111 | 0.8 | 50 | 38,200 | |
| Comp. 6 | 43 | Ag 2.0 | 250 × 5.0 | 110 | 0.8 | 50 | 36,600 | |
| Comp. 7 | 43 | Ag 2.0 | 600 × 0.2 | 111 | 0.7 | 50 | 31,400 | |
| Comp. 8 | 43 | Ag 2.0 | 450 × 0.1 | 111 | 0.8 | 50 | 36,800 | |
| Comp. 9 | 43 | Ag 2.0 | 450 × 6.0 | 111 | 0.7 | 50 | 35,300 | |
| Conv. 3 | 43 | Sn 0.3 | No treatment | 110 | 0.8 | 50 | 26,500 | |
| Conv. 4 | 43 | Sn 0.3 | 350 × 5.0 | 110 | 0.8 | 50 | 19,400 | |
| Conv. 5 | 43 | Sn 0.3 | 450 × 1.5 | 110 | 0.8 | 50 | 21,800 | |
| Conv. 6 | 43 | Sn 0.3 | 500 × 0.4 | 110 | 0.8 | 50 | 20,400 | |
| Comp. 10 | 42 | Sn 0.19 In 0.19 | 350 × 5.0 | 109 | 0.7 | 50 | 18,200 *(13,400) | |
| Comp. 11 | 42 | Sn 0.19 In 0.19 | 450 × 1.5 | 110 | 0.7 | 50 | 19,400 *(13,800) | |
| Comp. 12 | 42 | Sn 0.19 In 0.19 | 500 × 0.4 | 109 | 0.7 | 50 | 16,800 *(12,800) | |

TABLE 8-continued

| | Wire Size | Additive Metal Concentration | Heat Treatment | Capacitance (at 1 KHz) | Attenuation (10 MHz) | Characteristic Impedance (10 MHz) | Bending Life R = 2 mm | |
|---|---|---|---|---|---|---|---|---|
| | (AWG) | (weight %) | (° C. × sec.) | (pF/m) | (dB/m) | (Ω) | W = 50 g | W = 20 g |
| Comp. 13 | 44 | Sn 0.19 In 0.19 | 350 × 5.0 | 110 | 1.2 | 50 | 32,600 *(28,300) | |
| Comp. 14 | 44 | Sn 0.19 In 0.19 | 450 × 1.5 | 109 | 1.2 | 50 | 28,800 *(27,400) | |
| Comp. 15 | 44 | Sn 0.19 In 0.19 | 500 × 0.4 | 110 | 1.2 | 50 | 31,600 *(26,800) | |
| Comp. 16 | 46 | Sn 0.19 In 0.19 | 350 × 5.0 | 115 | 1.5 | 50 | 68,500 *(58,900) | |
| Comp. 17 | 46 | Sn 0.19 In 0.19 | 450 × 1.5 | 116 | 1.5 | 50 | 62,300 *(54,500) | |
| Comp. 18 | 46 | Sn 0.19 In 0.19 | 500 × 0.4 | 114 | 1.5 | 50 | 67,200 *(56,500) | |
| Comp. 19 | 48 | Sn 0.19 In 0.19 | 350 × 5.0 | 117 | 2.2 | 50 | | 78,200 *(65,000) |
| Comp. 20 | 48 | Sn 0.19 In 0.19 | 450 × 1.5 | 118 | 2.2 | 50 | | 72,600 *(66,000) |
| Comp. 21 | 48 | Sn 0.19 In 0.19 | 500 × 0.4 | 118 | 2.2 | 50 | | 74,300 *(64,000) |
| Comp. 22 | 50 | Sn 0.19 In 0.19 | 350 × 5.0 | 117 | 3.3 | 50 | | 66,000 *(57,800) |
| Comp. 23 | 50 | Sn 0.19 In 0.19 | 450 × 1.5 | 118 | 3.3 | 50 | | 68,000 *(54,800) |
| Comp. 24 | 50 | Sn 0.19 In 0.19 | 500 × 0.4 | 118 | 3.3 | 50 | | 63,000 *(53,800) |

*Figures shown in parentheses represent bending life before heating.

As shown in Table 8, the bending life of the coaxial cables in Examples 3 to 5 (43 AWG) was 40900 times or more, while Comparative Examples 3 to 9 (43 AWG) and Conventional Examples 3 to 6 (43 AWG) were respectively 37600, 22300, 38200, 36600, 31400, 36800, 35300, 26500, 19400, 21800, and 20400 times. Therefore, it is recognized that the coaxial cables in Examples 3 to 5 comprise a long bending life and an good bending characteristic.

Further, comparing the coaxial cables in Examples 6 to 23 and the cables in Comparative Examples 13 to 24, the cables comprising an identical wire size, it is recognized that the coaxial cables in Examples comprise the bending life longer than and the bending characteristic superior to the coaxial cables in Comparative Examples.

Also, from the result shown in Table 8 it could be confirmed that the coaxial cables in Examples 3 to 23 maintain the capacitance and the characteristic impedance equal to those of the cables in Comparative Examples and Conventional Examples. As to the attenuation at the frequency of 10 MHz, it could be confirmed that the coaxial cables in Examples maintain an attenuation characteristic similar to or more than that of the cables in Comparative Examples and Conventional Examples comprising an identical wire size.

Particularly, as to the bending life and the attenuation, comparing the coaxial cables (43 AWG) in Examples 3 to 5 with the coaxial cable (42 AWG) in Comparative Example 10, it can be evaluated that the cables in Examples 3 to 5 comprise the bending life longer than and the attenuation equal to the cable in Comparative Example 10.

Further, as to the tensile strength and the electric resistance, referring to Table 7 and comparing the in Examples 3 to 5 with the cable in Comparative Example 10, it can be evaluated that the cables in Examples 3 to 5 comprise the tensile strength superior to and the electric resistance equal to the cable in Comparative Example 10.

To sum up, according to Examples of the invention, even if the coaxial cable was downsized by one size according to requirements of customers, a coaxial cable can be provided, the cable comprising the electric characteristics (the central conductor resistance, the attenuation) equal to and the bending characteristic (the tensile strength) higher than the cables in Comparative Examples comprising a wire diameter thicker by one size than the cables in the Examples.

Other Embodiments

As an additive element to the copper alloy, one or two kind(s) of metal(s) selected from magnesium (Mg) and indium (In) other than silver (Ag) can be added by total amount of 0.02 to 0.10 weight %. Increase of the additive element leads to increase of a production cost, but it is expected that the strength can be further enhanced.

Example 24

Manufacture of Coaxial Wire of 43 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 1 μm, and a wire drawing work was continuously conducted so that extra-fine copper alloy wires comprising the wire diameter of 0.023 mm were obtained. Further, the seven Ag-plated copper alloy (Cu-2% Ag) wires with a wire diameter of 0.023 mm were twisted together at a pitch of 1.1 mm, so that a twisted wire with an outer diameter of 0.069 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, the tensile strength and the electric resistance before and after the heat treatment, and the electrical conductivity after the heat treatment were measured, and a changing rate of the tensile strength and the electric resistance were calculated. Further, the changing rate was calculated according to the formula [(value before heat treatment−value after heat treatment)/value before heat treatment]×100%. The result is shown in Table 9.

Further, a PFA foamed resin of 0.07 mm in thickness was extruded and formed on an outer circumference of the twisted wire, so as to form an inside insulating member comprising air bubbles and an outer diameter of 0.210 mm. A skin layer formed of a PET tape of 0.01 mm in thickness was formed on the outer circumference of the inside insulating member, and a Cu—In—Sn alloy wire of 0.025 mm in wire diameter (including 0.19 weight % of Sn, and 0.20 weight % of In) was laterally wound on the outer circumference of the skin layer, so as to form an outer conductor, and a jacket formed of the PET tape of 0.015 mm in thickness was formed on an outer circumference of the outer conductor, so as to obtain a coaxial cable of 0.310 mm in outer diameter.

Example 25

Manufacture of Coaxial Wire of 43 AWG

A coaxial wire in Example 25 was made by a process similar to Example 24 except that the heat treatment was conducted at 450° C. for 1.5 seconds.

Example 26

Manufacture of Coaxial Wire of 43 AWG

A coaxial wire in Example 26 was made by a process similar to Example 24 except that the heat treatment was conducted at 500° C. for 0.4 seconds.

Example 27

Manufacture of Coaxial Wire of 44 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.9 μm, and a wire drawing work was continuously conducted so that extra-fine copper alloy wires comprising the wire diameter of 0.020 mm were obtained. Further, the seven Ag-plated copper alloy (Cu-2% Ag) wires with a wire diameter of 0.020 mm were twisted together at a pitch of 1.0 mm, so that a twisted wire with an outer diameter of 0.06 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 24, the tensile strength and the electric resistance before and after the heat treatment, and the electrical conductivity after the heat treatment were measured, and the changing rate of the tensile strength and the electric resistance were calculated. The result is shown in Table 9.

Further, a foamed PFA resin of 0.06 mm in thickness was extruded to cover the outer circumference of the twisted wire, so as to form an inside insulation member with air bubbles and an outer diameter of 0.180 mm. A skin layer formed of a PET tape of 0.01 mm in thickness was formed on the outer circumference of the inside insulating member, and a Cu—In—Sn alloy wire of 0.025 mm in wire diameter (containing 0.19 weight % of Sn and 0.20 weight % of In) was laterally wound on the outer circumference of the skin layer, so as to form an outer conductor, and a jacket formed of the PET tape of 0.015 mm in thickness was formed on an outer circumference of the outer conductor, so as to obtain a coaxial cable of 0.280 mm in outer diameter.

Example 28

Manufacture of Coaxial Wire of 44 AWG

A coaxial wire in Example 28 was made by a process similar to Example 27 except that the heat treatment was conducted at 450° C. for 1.5 seconds.

Example 29

Manufacture of Coaxial Wire of 44 AWG

A coaxial wire in Example 29 was made by a process similar to Example 27 except that the heat treatment was conducted at 500° C. for 0.4 seconds.

Example 30

Manufacture of Coaxial Wire of 45 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.8 μm, and a wire drawing work was continuously conducted so that extra-fine copper alloy wires comprising the wire diameter of 0.018 mm were obtained. Further, the seven Ag-plated copper alloy (Cu-2% Ag) wires with a wire diameter of 0.018 mm were twisted together at a pitch of 0.8 mm, so that a twisted wire with an outer diameter of 0.054 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 24, the tensile strength and the electric resistance before and after the heat treatment, and the electrical conductivity after the heat treatment were measured, and the changing rate of the tensile strength and the electric resistance were calculated. The result is shown in Table 7.

Further, a PFA foamed resin of 0.05 mm in thickness was extruded and formed on an outer circumference of the twisted wire, so as to form an inside insulating member comprising air bubbles and an outer diameter of 0.154 mm. A skin layer formed of a PET tape of 0.01 mm in thickness was formed on the outer circumference of the inside insulating member, and a Cu—In—Sn alloy wire of 0.020 mm in wire diameter (including 0.19 weight % of Sn, and 0.20 weight % of In) was laterally wound on the outer circumference of the skin layer, so as to form an outer conductor, and a jacket formed of the PET tape of 0.015 mm in thickness was formed on an outer circumference of the outer conductor, so as to obtain a coaxial cable of 0.244 mm in outer diameter.

Example 31

Manufacture of Coaxial Wire of 45 AWG

A coaxial wire in Example 31 was made by a process similar to Example 30 except that the heat treatment was conducted at 450° C. for 1.5 seconds.

Example 32

Manufacture of Coaxial Wire of 45 AWG

A coaxial wire in Example 32 was made by a process similar to Example 30 except that the heat treatment was conducted at 500° C. for 0.4 seconds.

Example 33

Manufacture of Coaxial Wire of 46 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.7 μm, and a wire drawing work was continuously conducted so that extra-fine copper alloy wires comprising the wire diameter of 0.016 mm were obtained. Further, the seven Ag-plated copper alloy (Cu-2% Ag) wires with a wire diameter of 0.016 mm were twisted together at a pitch of 0.8 mm, so that a twisted wire with an outer diameter of 0.048 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 24, the tensile strength and the electric resistance before and after the heat treatment, and the electrical conductivity after the heat treatment were measured, and the changing rate of the tensile strength and the electric resistance were calculated. The result is shown in Table 9.

Further, a PFA foamed resin of 0.04 mm in thickness was extruded and formed on an outer circumference of the twisted wire, so as to form an inside insulating member comprising air bubbles and an outer diameter of 0.128 mm. A skin layer formed of a PET tape of 0.01 mm in thickness was formed on the outer circumference of the inside insulating member, and a Cu—In—Sn alloy wire of 0.020 mm in wire diameter (including 0.19 weight % of Sn, and 0.20 weight % of In) was laterally wound on the outer circumference of the skin layer, so as to form an outer conductor, and a jacket formed of the PET tape of 0.015 mm in thickness was formed on an outer circumference of the outer conductor, so as to obtain a coaxial cable of 0.218 mm in outer diameter.

Example 34

Manufacture of Coaxial Wire of 46 AWG

A coaxial wire in Example 34 was made by a process similar to Example 33 except that the heat treatment was conducted at 450° C. for 1.5 seconds.

Example 35

Manufacture of Coaxial Wire of 46 AWG

A coaxial wire in Example 35 was made by a process similar to Example 33 except that the heat treatment was conducted at 500° C. for 0.4 seconds.

Example 36

Manufacture of Coaxial Wire of 47 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.6 μm, and a wire drawing work was continuously conducted so that extra-fine copper alloy wires comprising the wire diameter of 0.015 mm were obtained. Further, the seven Ag-plated copper alloy (Cu-2% Ag) wires with a wire diameter of 0.015 mm were twisted together at a pitch of 0.8 mm, so that a twisted wire with an outer diameter of 0.045 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 24, the tensile strength and the electric resistance before and after the heat treatment, and the electrical conductivity after the heat treatment were measured, and the changing rate of the tensile strength and the electric resistance were calculated. The result is shown in Table 9.

Further, a PFA foamed resin of 0.035 mm in thickness was extruded and formed on an outer circumference of the twisted wire, so as to form an inside insulating member comprising air bubbles and an outer diameter of 0.115 mm. A skin layer formed of a PET tape of 0.01 mm in thickness was formed on the outer circumference of the inside insulating member, and a Cu—In—Sn alloy wire of 0.020 mm in wire diameter (including 0.19 weight % of Sn, and 0.20 weight % of In) was laterally wound on the outer circumference of the skin layer, so as to form an outer conductor, and a jacket formed of the PET tape of 0.015 mm in thickness was formed on an outer circumference of the outer conductor, so as to obtain a coaxial cable of 0.205 mm in outer diameter.

Example 37

Manufacture of Coaxial Wire of 47 AWG

A coaxial wire in Example 37 was made by a process similar to Example 36 except that the heat treatment was conducted at 450° C. for 1.5 seconds.

Example 38

Manufacture of Coaxial Wire of 47 AWG

A coaxial wire in Example 38 was made by a process similar to Example 36 except that the heat treatment was conducted at 500° C. for 0.4 seconds.

Example 39

Manufacture of Coaxial Wire of 48 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.5 μm, and a wire drawing work was continuously conducted so that extra-fine copper alloy wires comprising the wire diameter of 0.013 mm were obtained.

Further, the seven Ag-plated copper alloy (Cu-2% Ag) wires with a wire diameter of 0.013 mm were twisted together at a pitch of 0.7 mm, so that a twisted wire with an outer diameter of 0.039 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 24, the tensile strength and the electric resistance before and after the heat treatment, and the electrical conductivity after the heat treatment were measured, and the changing rate of the tensile strength and the electric resistance were calculated. The result is shown in Table 9.

Further, a PFA foamed resin of 0.03 mm in thickness was extruded and formed on an outer circumference of the twisted wire, so as to form an inside insulating member comprising air bubbles and an outer diameter of 0.099 mm. A skin layer formed of a PET tape of 0.01 mm in thickness was formed on the outer circumference of the inside insulating member, and a Cu—In—Sn alloy wire of 0.016 mm in wire diameter (including 0.19 weight % of Sn, and 0.20 weight % of In) was laterally wound on the outer circumference of the skin layer, so as to form an outer conductor, and a jacket formed of the PET tape of 0.015 mm in thickness was formed on an outer circumference of the outer conductor, so as to obtain a coaxial cable of 0.181 mm in outer diameter.

Example 40

Manufacture of Coaxial Wire of 48 AWG

A coaxial wire in Example 40 was made by a process similar to Example 39 except that the heat treatment was conducted at 450° C. for 1.5 seconds.

Example 41

Manufacture of Coaxial Wire of 48 AWG

A coaxial wire in Example 41 was made by a process similar to Example 39 except that the heat treatment was conducted at 500° C. for 0.4 seconds.

Example 42

Manufacture of Coaxial Wire of 50 AWG

An oxygen free copper being added silver of 2.0 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 0.4 μm, and a wire drawing work was continuously conducted so that extra-fine copper alloy wires comprising the wire diameter of 0.010 mm were obtained. Further, the seven Ag-plated copper alloy (Cu-2% Ag) wires with a wire diameter of 0.010 mm were twisted together at a pitch of 0.5 mm, so that a twisted wire with an outer diameter of 0.030 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 24, the tensile strength and the electric resistance before and after the heat treatment, and the electrical conductivity after the heat treatment were measured, and the changing rate of the tensile strength and the electric resistance were calculated. The result is shown in Table 9.

Further, a PFA foamed resin of 0.025 mm in thickness was extruded and formed on an outer circumference of the twisted wire, so as to form an inside insulating member comprising air bubbles and an outer diameter of 0.08 mm. A skin layer formed of a PET tape of 0.01 mm in thickness was formed on the outer circumference of the inside insulating member, and a Cu—In—Sn alloy wire of 0.016 mm in wire diameter (including 0.19 weight % of Sn, and 0.20 weight % of In) was laterally wound on the outer circumference of the skin layer, so as to form an outer conductor, and a jacket formed of the PET tape of 0.015 mm in thickness was formed on an outer circumference of the outer conductor, so as to obtain a coaxial cable of 0.162 mm in outer diameter.

Example 43

Manufacture of Coaxial Wire of 50 AWG

A coaxial wire in Example 43 was made by a process similar to Example 42 except that the heat treatment was conducted at 450° C. for 1.5 seconds.

Example 44

Manufacture of Coaxial Wire of 50 AWG

A coaxial wire in Example 44 was made by a process similar to Example 42 except that the heat treatment was conducted at 500° C. for 0.4 seconds.

Comparative Example 25

Manufacture of Coaxial Wire of 43 AWG

A coaxial wire in Comparative Example 25 was made by a process similar to Example 24 except that the heat treatment was not conducted.

Comparative Example 26

Manufacture of Coaxial Wire of 43 AWG

A coaxial wire in Comparative Example 26 was made by a process similar to Example 25 except that the silver concentration was set to 0.5 weight %.

Comparative Example 27

Manufacture of Coaxial Wire of 43 AWG

A coaxial wire in Comparative Example 27 was made by a process similar to Example 25 except that the silver concentration was set to 3.5 weight %.

Comparative Example 28

Manufacture of Coaxial Wire of 43 AWG

A coaxial wire in Comparative Example 28 was made by a process similar to Example 24 except that the heat treatment was conducted at 250° C. for 5.0 seconds.

Comparative Example 29

Manufacture of Coaxial Wire of 43 AWG

A coaxial wire in Comparative Example 29 was made by a process similar to Example 24 except that the heat treatment was conducted at 600° C. for 0.2 seconds.

Comparative Example 30

Manufacture of Coaxial Wire of 43 AWG

A coaxial wire in Comparative Example 30 was made by a process similar to Example 24 except that the heat treatment was conducted at 450° C. for 0.1 second.

Comparative Example 31

Manufacture of Coaxial Wire of 43 AWG

A coaxial wire in Comparative Example 31 was made by a process similar to Example 24 except that the heat treatment was conducted at 450° C. for 6.0 seconds.

Conventional Example 7

Manufacture of coaxial wire of 43 AWG

A coaxial wire in Conventional Example 7 was made by a process similar to Example 1 except that as the additive element a tin (Sn) of 0.3 weight % was adopted instead of silver (Ag) and the heat treatment was not conducted.

Conventional Example 8

Manufacture of coaxial wire of 43 AWG

A coaxial wire in Conventional Example 8 was made by a process similar to Example 24 except that as the additive element a tin (Sn) of 0.3 weight % was adopted instead of silver (Ag).

Conventional Example 9

Manufacture of Coaxial Wire of 43 AWG

A coaxial wire in Conventional Example 9 was made by a process similar to Example 25 except that as the additive element a tin (Sn) of 0.3 weight % was adopted instead of silver (Ag).

Conventional Example 10

Manufacture of Coaxial Wire of 43 AWG

A coaxial wire in Conventional Example 10 was made by a process similar to Example 26 except that as the additive element a tin (Sn) of 0.3 weight % was adopted instead of silver (Ag).

Comparative Example 32

Manufacture of Coaxial Wire of 42 AWG

An oxygen free copper being added a tin (Sn) of 0.19 weight % and an indium (In) of 0.20 weight % was melted by heating in a graphite crucible fixed in a vacuum chamber, and was cast continuously by using a graphite casting mold, so as to obtain roughly drawn wires comprising a wire diameter of 8.0 mm. After that, through a wire drawing work, a process annealing and a wire drawing work, silver plating process was conducted so that a final wire comprises a plating thickness of 1.1 μm, and a wire drawing work was continuously conducted so that extra-fine copper alloy wires comprising the wire diameter of 0.025 mm were obtained. Further, the seven Ag-plated copper alloy (Cu-2% Ag) wires with a wire diameter of 0.025 mm were twisted together at a pitch of 1.3 mm, so that a twisted wire with an outer diameter of 0.075 mm was obtained. Then the twisted wires obtained were heat-treated in a heating furnace heated at 350° C. for 5.0 seconds, so that the extra-fine copper alloy twisted wire was obtained.

As to the extra-fine copper alloy twisted wire, similarly to Example 24, the tensile strength and the electric resistance before and after the heat treatment, and the electrical conductivity after the heat treatment were measured, and the changing rate of the tensile strength and the electric resistance were calculated. The result is shown in Table 9.

Further, a PFA foamed resin of 0.08 mm in thickness was extruded and formed on an outer circumference of the twisted wire, so as to form an inside insulating member comprising air bubbles and an outer diameter of 0.235 mm. A skin layer formed of a PET tape of 0.01 mm in thickness was formed on the outer circumference of the inside insulating member, and a Cu—In—Sn alloy wire of 0.025 mm in wire diameter (including 0.19 weight % of Sn, and 0.20 weight % of In) was laterally wound on the outer circumference of the skin layer, so as to form an outer conductor, and a jacket formed of the PET tape of 0.015 mm in thickness was formed on an outer circumference of the outer conductor, so as to obtain a coaxial cable of 0.335 mm in outer diameter.

Comparative Example 33

Manufacture of Coaxial Wire of 42 AWG

A coaxial wire in Comparative Example 33 was made by a process similar to Comparative Example 32 except that the heat treatment was conducted at 450° C. for 1.5 seconds.

Comparative Example 34

Manufacture of Coaxial Wire of 42 AWG

A coaxial wire in Comparative Example 34 was made by a process similar to Comparative Example 32 except that the heat treatment was conducted at 500° C. for 0.4 seconds.

Comparative Example 35

Manufacture of Coaxial Wire of 44 AWG

A coaxial wire in Comparative Example 35 was made by a process similar to Example 27 except that as the additive element a tin (Sn) of 0.19 weight % and an indium (In) of 0.19 weight % were adopted instead of silver (Ag).

Comparative Example 36

Manufacture of Coaxial Wire of 44 AWG

A coaxial wire in Comparative Example 36 was made by a process similar to Comparative Example 35 except that the heat treatment was conducted at 450° C. for 1.5 seconds.

Comparative Example 37

Manufacture of Coaxial Wire of 44 AWG

A coaxial wire in Comparative Example 37 was made by a process similar to Comparative Example 35 except that the heat treatment was conducted at 500° C. for 0.4 seconds.

Comparative Example 38

Manufacture of Coaxial Wire of 46 AWG

A coaxial wire in Comparative Example 38 was made by a process similar to Example 33 except that as the additive element a tin (Sn) of 0.19 weight % and an indium (In) of 0.19 weight % were adopted instead of silver (Ag).

Comparative Example 39

Manufacture of Coaxial Wire of 46 AWG

A coaxial wire in Comparative Example 39 was made by a process similar to Comparative Example 38 except that the heat treatment was conducted at 450° C. for 1.5 seconds.

Comparative Example 40

Manufacture of Coaxial Wire of 46 AWG

A coaxial wire in Comparative Example 40 was made by a process similar to Comparative Example 38 except that the heat treatment was conducted at 500° C. for 0.4 seconds.

Comparative Example 41

Manufacture of Coaxial Wire of 48 AWG

A coaxial wire in Comparative Example 41 was made by a process similar to Example 39 except that as the additive element a tin (Sn) of 0.19 weight % and an indium (In) of 0.19 weight % were adopted instead of silver (Ag).

Comparative Example 42

Manufacture of Coaxial Wire of 48 AWG

A coaxial wire in Comparative Example 42 was made by a process similar to Comparative Example 41 except that the heat treatment was conducted at 450° C. for 1.5 seconds.

Comparative Example 43

Manufacture of Coaxial Wire of 48 AWG

A coaxial wire in Comparative Example 43 was made by a process similar to Comparative Example 41 except that the heat treatment was conducted at 500° C. for 0.4 seconds.

Comparative Example 44

Manufacture of Coaxial Wire of 50 AWG

A coaxial wire in Comparative Example 44 was made by a process similar to Example 42 except that as the additive element a tin (Sn) of 0.19 weight % and an indium (In) of 0.19 weight % were adopted instead of silver (Ag).

Comparative Example 45

Manufacture of Coaxial Wire of 50 AWG

A coaxial wire in Comparative Example 45 was made by a process similar to Comparative Example 44 except that the heat treatment was conducted at 450° C. for 1.5 seconds.

Comparative Example 46

Manufacture of Coaxial Wire of 50 AWG

A coaxial wire in Comparative Example 46 was made by a process similar to Comparative Example 44 except that the heat treatment was conducted at 500° C. for 0.4 seconds.

Evaluation (of the extra-fine copper alloy twisted wires in Examples 24 to 44, Comparative Examples 25 to 46, Conventional Examples 7 to 10)

Table 9 shows a measurement result of the tensile strength and the electric resistance before and after the heat treatment, and the electrical conductivity after the heat treatment, and the changing rate of tensile strength and the electric resistance of the extra-fine copper alloy twisted wires in Examples 24 to 44, Comparative Examples 25 to 46, Conventional Examples 7 to 10.

TABLE 9

| | | Additive Metal | | Tensile Strength (MPa) | | Electric Resistance (Ω/km) | | Electric | Changing Rate* (%) | |
|---|---|---|---|---|---|---|---|---|---|---|
| | Wire Size (AWG) | Concentration (weight %) | Heat Treatment (° C. × sec.) | Before Heating | After Heating | Before Heating | After Heating | Conductivity (% IACS) | Tensile Strength | Electric Resistance |
| Ex. 24 | 43 | Ag 2.0 | 350 × 5.0 | 1020 | 910 | 6,870 | 6,450 | 89.1 | 10.8 | 6.1 |
| Ex. 25 | 43 | Ag 2.0 | 450 × 1.5 | 990 | 920 | 6,950 | 6,440 | 88.8 | 7.1 | 7.3 |
| Ex. 26 | 43 | Ag 2.0 | 500 × 0.4 | 1010 | 940 | 6,890 | 6,450 | 88.3 | 6.9 | 6.4 |
| Ex. 27 | 44 | Ag 2.0 | 350 × 5.0 | 1000 | 920 | 9,420 | 8,700 | 89.5 | 8.0 | 7.6 |
| Ex. 28 | 44 | Ag 2.0 | 450 × 1.5 | 980 | 920 | 9,450 | 8,730 | 89.2 | 6.1 | 7.6 |
| Ex. 29 | 44 | Ag 2.0 | 500 × 0.4 | 990 | 930 | 9,460 | 8,780 | 88.7 | 6.1 | 7.2 |
| Ex. 30 | 45 | Ag 2.0 | 350 × 5.0 | 1000 | 915 | 11,890 | 10,900 | 87.3 | 8.5 | 8.3 |
| Ex. 31 | 45 | Ag 2.0 | 450 × 1.5 | 1010 | 940 | 11,920 | 10,950 | 86.9 | 6.9 | 8.1 |
| Ex. 32 | 45 | Ag 2.0 | 500 × 0.4 | 980 | 920 | 11,930 | 10,990 | 86.6 | 6.1 | 7.9 |
| Ex. 33 | 46 | Ag 2.0 | 350 × 5.0 | 980 | 925 | 14,950 | 14,000 | 87.9 | 5.6 | 6.4 |
| Ex. 34 | 46 | Ag 2.0 | 450 × 1.5 | 990 | 930 | 14,920 | 13,980 | 88.0 | 6.1 | 6.3 |
| Ex. 35 | 46 | Ag 2.0 | 500 × 0.4 | 980 | 940 | 14,960 | 13,970 | 88.1 | 4.1 | 6.6 |
| Ex. 36 | 47 | Ag 2.0 | 350 × 5.0 | 1030 | 960 | 16,480 | 15,300 | 91.1 | 6.8 | 7.2 |
| Ex. 37 | 47 | Ag 2.0 | 450 × 1.5 | 1010 | 940 | 16,520 | 15,340 | 90.8 | 6.9 | 7.1 |
| Ex. 38 | 47 | Ag 2.0 | 500 × 0.4 | 990 | 930 | 16,470 | 15,320 | 91.0 | 6.1 | 7.0 |
| Ex. 39 | 48 | Ag 2.0 | 350 × 5.0 | 1120 | 940 | 21,960 | 20,500 | 91.6 | 16.1 | 6.6 |
| Ex. 40 | 48 | Ag 2.0 | 450 × 1.5 | 1040 | 930 | 21,980 | 20,200 | 91.3 | 10.6 | 8.1 |
| Ex. 41 | 48 | Ag 2.0 | 500 × 0.4 | 990 | 920 | 21,950 | 20,250 | 91.0 | 7.1 | 7.7 |
| Ex. 42 | 50 | Ag 2.0 | 350 × 5.0 | 1090 | 950 | 37,100 | 34,700 | 91.0 | 12.8 | 6.5 |
| Ex. 43 | 50 | Ag 2.0 | 450 × 1.5 | 1020 | 930 | 37,300 | 34,900 | 90.5 | 8.8 | 6.4 |
| Ex. 44 | 50 | Ag 2.0 | 500 × 0.4 | 990 | 930 | 37,400 | 34,700 | 91.0 | 6.1 | 7.2 |
| Comp. 25 | 43 | Ag 2.0 | No treatment | 1020 | — | 6,870 | — | 83.6 | — | — |
| Comp. 26 | 43 | Ag 0.5 | 450 × 1.5 | 840 | 760 | 6,420 | 6,300 | 91.2 | 9.5 | 2 |
| Comp. 27 | 43 | Ag 3.5 | " | 1,200 | 1,150 | 7,170 | 7,100 | 80.9 | 4.2 | 1 |
| Comp. 28 | 43 | Ag 2.0 | 250 × 5.0 | 1,080 | 1,050 | 6,870 | 6,830 | 84.1 | 2.8 | 0.5 |

TABLE 9-continued

| | Wire Size (AWG) | Additive Metal Concentration (weight %) | Heat Treatment (° C. × sec.) | Tensile Strength (MPa) Before Heating | Tensile Strength (MPa) After Heating | Electric Resistance (Ω/km) Before Heating | Electric Resistance (Ω/km) After Heating | Electric Conductivity (% IACS) | Changing Rate* (%) Tensile Strength | Changing Rate* (%) Electric Resistance |
|---|---|---|---|---|---|---|---|---|---|---|
| Comp. 29 | 43 | Ag 2.0 | 600 × 0.2 | 990 | 720 | 6,870 | 6,400 | 89.7 | 27.3 | 6.8 |
| Comp. 30 | 43 | Ag 2.0 | 400 × 0.1 | 1,020 | 985 | 6,870 | 6,800 | 84.5 | 3.4 | 1 |
| Comp. 31 | 43 | Ag 2.0 | 400 × 6.0 | 1,040 | 810 | 6,870 | 6,400 | 89.8 | 22.1 | 6.8 |
| Cnvv. 7 | 43 | Sn 0.3 | No treatment | 780 | — | 7,570 | — | 76.6 | — | — |
| Cnvv. 8 | 43 | Sn 0.3 | 350 × 5.0 | 870 | 730 | 7,500 | 7,480 | 77.5 | 4.6 | 0.3 |
| Cnvv. 9 | 43 | Sn 0.3 | 450 × 1.5 | 850 | 730 | 7490 | 7,460 | 77.5 | 14.1 | 0.4 |
| Cnvv. 10 | 43 | Sn 0.3 | 500 × 0.4 | 880 | 710 | 7570 | 7,500 | 77.3 | 9 | 0.9 |
| Comp. 32 | 42 | Sn 0.19 In 0.19 | 350 × 5.0 | 850 | 750 | 6,300 | 6,100 | 82.3 | 13 | 3.2 |
| Comp. 33 | 42 | Sn 0.19 In 0.19 | 450 × 1.5 | 880 | 760 | 6,370 | 6,260 | 80.2 | 13.6 | 1.7 |
| Comp. 34 | 42 | Sn 0.19 In 0.19 | 500 × 0.4 | 870 | 750 | 6,340 | 6,290 | 79.8 | 13.8 | 0.8 |
| Comp. 35 | 44 | Sn 0.19 In 0.19 | 350 × 5.0 | 850 | 750 | 9,800 | 9,600 | 81.1 | 11.8 | 2.0 |
| Comp. 36 | 44 | Sn 0.19 In 0.19 | 450 × 1.5 | 860 | 770 | 9,760 | 9,650 | 80.7 | 10.5 | 1.1 |
| Comp. 37 | 44 | Sn 0.19 In 0.19 | 500 × 0.4 | 840 | 750 | 9,780 | 9,710 | 80.2 | 10.7 | 0.6 |
| Comp. 38 | 46 | Sn 0.19 In 0.19 | 350 × 5.0 | 850 | 750 | 15,300 | 14,990 | 82.1 | 11.8 | 2.0 |
| Comp. 39 | 46 | Sn 0.19 In 0.19 | 450 × 1.5 | 840 | 770 | 15,280 | 15,150 | 81.2 | 8.3 | 0.9 |
| Comp. 40 | 46 | Sn 0.19 In 0.19 | 500 × 0.4 | 850 | 780 | 15,330 | 15,030 | 81.9 | 8.2 | 2.0 |
| Comp. 41 | 48 | Sn 0.19 In 0.19 | 350 × 5.0 | 840 | 760 | 23,700 | 22,990 | 81.7 | 9.5 | 3.0 |
| Comp. 42 | 48 | Sn 0.19 In 0.19 | 450 × 1.5 | 830 | 750 | 23,800 | 23,200 | 81.0 | 9.6 | 2.5 |
| Comp. 43 | 48 | Sn 0.19 In 0.19 | 500 × 0.4 | 840 | 780 | 23,700 | 23,100 | 81.3 | 7.1 | 2.5 |
| Comp. 44 | 50 | Sn 0.19 In 0.19 | 350 × 5.0 | 830 | 770 | 39,800 | 38,600 | 81.8 | 7.2 | 3.0 |
| Comp. 45 | 50 | Sn 0.19 In 0.19 | 450 × 1.5 | 820 | 740 | 39,600 | 38,500 | 82.0 | 9.8 | 2.8 |
| Comp. 46 | 50 | Sn 0.19 In 0.19 | 500 × 0.4 | 840 | 760 | 39,900 | 38,700 | 81.6 | 9.5 | 3.0 |

*Changing rate = [(value before heat treatment − value after heat treatment)/value before heat treatment] × 100%

As shown in Table 9, in the seven-wire twisted wire of Examples 3 to 5 (43 AWG), the additive element concentration and the heat treatment condition were pertinent, so that the lowering rate of the tensile strength remained at 6.9 to 10.8%, and the tensile strength after the heat treatment was 910 MPa, so that the tensile strength of 850 MPa or more of a target value could be achieved. Further, the lowering rate of the electric resistance was notably large as 6.1 to 7.3% (the changing rate of the electric resistance of 6% or more) and the electric resistance after the heat treatment was 6450 Ω/km, so that a high electrical conductivity wire material comprising the electrical conductivity of 85% or more could be obtained.

On the other hand, in the seven-wire twisted wire formed of Cu—Sn alloy wires of Conventional Examples 7 to 10 (43 AWG), the tensile strength thereof was lowered below 850 MPa, and even if the heat treatment according to the invention was similarly conducted to the conventional Cu—Sn alloy wire (Conventional Examples 8 to 10) the tensile strength was lowered largely as 710 to 730 MPa and the lowering rate of the electric resistance was suppressed not more than 0.9%, so that it is difficult to obtain characteristics satisfying both of a high strength and a high electrical conductivity.

In the seven-wire twisted wire formed of conventional Cu—Sn—In alloy wires (refer to Comparative Examples 32 to 46), the tensile strength after the heat treatment was lowered below 850 MPa, so that a high strength wire material could not be obtained.

In Comparative Example 25 the heat treatment was not conducted, so that while the tensile strength was high, the electric resistance was high as 6870 Ω/km and the high electrical conductivity wire material comprising the electrical conductivity of 85% could not be obtained.

In Comparative Example 26 the silver concentration was too small as 0.5 weight %, so that the tensile strength was lowered below 850 MPa of a target value and the lowering rate of the electric resistance remained at 2%. Therefore, it was recognized that it is difficult to obtain characteristics satisfying both of a high strength and a low electric resistance.

In Comparative Example 27 the silver concentration was too large as 3.5 weight %, so that the lowering rate of the electric resistance remained at 1%. Therefore, it was recognized that it is difficult to obtain characteristics satisfying both of a high strength and a low electric resistance.

In Comparative Example 28 the heat treatment temperature was low as 250° C., so that the lowering rate of the electric resistance remained at 0.5%. Therefore, it was recognized that it is difficult to obtain characteristics satisfying both of a high strength and a low electric resistance.

In Comparative Example 29 the heat treatment temperature was high as 600° C., so that the lowering rate of the tensile strength was notably large as 27.3%. Therefore, it was recognized that it is difficult to obtain characteristics satisfying both of a high strength and a low electric resistance.

In Comparative Example 30 the heat treatment time was short as 0.1 second, so that the lowering rate of the electric resistance remained at 1%. Therefore, it was recognized that it is difficult to obtain characteristics satisfying both of a high strength and a low electric resistance.

In Comparative Example 31 the heat treatment time was long as 6.0 seconds, so that the lowering rate of the tensile strength was large as 22.1% and the tensile strength was low as 810 MPa. Therefore, it was recognized that it is difficult to obtain characteristics satisfying both of a high strength and a low electric resistance.

Comparing Comparative Examples 32 to 46 with Examples 24 to 44, in the twisted wires of Comparative Examples 32 to 44 the lowering rate of the electric resistance remained to an extent of 0.8 to 3.2%, so that each of the twisted wires became a wire material comprising the electric resistance of a high value. Further, in Comparative Examples 32 to 44 the tensile strength was lowered below 850 MPa of the target value.

To sum up, Table 9 shows that in a case of using a Cu—Sn (0.19%)-In (0.19%) alloy as Comparative Examples 32 to 46 the tensile strength is lowered more than Examples 24 to 44 regardless of the heat treatment, and the electric resistance is higher than Examples 24 to 44.

Further, as explained in a paragraph of Description of the Related Art, in conventional articles, a Cu—Sn (0.19%)-In (0.19%) alloy twisted wire not heat-treated specifically has been used and a heat treatment has not been conducted separately. Therefore, it is recognized that even if in a stage of bare seven-wire twisted wire the wire comprises characteristics of a high electrical conductivity and a high tensile strength, by a heat generated at an extruding work (e.g. 400 to 300° C., 1 to 5 seconds), as shown in the alloy twisted wires in Comparative Examples 32 to 46, the lowering rate of the electric resistance is suppressed to a small value and the tensile strength is lowered more largely than before the heat treatment.

On the other hand, in the twisted wires in Examples a heat treatment is preliminarily conducted after a twist work, so that a heat history generated by the heat generated at the extruding work does not occur, and a coaxial cable can be provided, the cable comprising the tensile strength and the electric resistance not changing before and after the extruding work.

Table 9 shows that an electric characteristic of the coaxial cables in Examples are equal to the conventional coaxial cables thicker by one size than the cables in Examples (e.g. electric and mechanical characteristics of the coaxial cables of 43 AWG, 45 AWG, and 47 AWG in Examples are equal to the characteristics of the conventional coaxial cables of 42 AWG, 44 AWG, and 46 AWG). Therefore, coaxial cables of odd numbers as 43 AWG, 45 AWG, and 47 AWG are used, so that a deterioration of the electric characteristic of the coaxial cable can be prevented while a downsizing of a diameter of the coaxial cable can be realized.

Evaluation (of the coaxial wires in Examples 24 to 44, Comparative Examples 25 to 46, and Conventional Examples 7 to 10)

First, as to the coaxial cable of each of Examples 3 to 23, Comparative Examples 3 to 24, and Conventional Examples 3 to 6, a bending test was conducted to evaluate its bending life. The bending test is conducted such that one end portion of a sample cable (=a coaxial cable) is fixed to a jig with a bend radius of 2 mm, a weight of 50 gf or 20 gf according to the size of the sample cable is hung on the other end portion thereof, the sample cable is repeatedly bent (alternately) in the left and right directions perpendicular to the longitudinal direction of the coaxial cable at a test speed of 30 times/1 minute, the number of bends (=bending life) repeated until the breaking of the inner conductor of the sample cable is measured. Especially in this invention, a power voltage of several volts was constantly applied to the cable and the bending life is defined as the number of repeated bends at the time when the electric current value of the cable was reduced by 20% relative to that at the start of the test. Values in the following tables show the number of repeated bends when reaching the bending life.

Next, as to the coaxial cable of each of Examples 24 to 44, Comparative Examples 25 to 46, and Conventional Examples 7 to 10, a capacitance, an attenuation, and a characteristic impedance were evaluated.

The capacitance was measured at a frequency of 1 kHz by connecting a LCR meter in between the inner conductor and the outer conductor of the sample cable (the coaxial cable) with a length of 1 m. Further, in between the inner conductor and the outer conductor at both ends of the 1 m long sample cable, the transmitting side and the receiving side of a network analyzer were connected through measurement coaxial cables (i.e., lead wires) to evaluate its attenuation at a frequency of 10 MHz. Furthermore, before the measurement of the attenuation of the sample cable a calibration was conducted so as to eliminate an influence of the measurement coaxial cable (the lead wire). And, the characteristic impedance was measured by the network analyzer as a value at a frequency of 10 MHz.

Table 10 shows an evaluation result of the electric and mechanical characteristics.

TABLE 10

| | Wire Size | Additive Metal Concentration | Heat Treatment | Capacitance (at 1 KHz) | Attenuation (10 MHz) | Characteristic Impedance (10 MHz) | Bending Life R = 2 mm | |
|---|---|---|---|---|---|---|---|---|
| | (AWG) | (weight %) | (° C. × sec.) | (pF/m) | (dB/m) | (Ω) | W = 50 g | W = 20 g |
| Ex. 24 | 43 | Ag 2.0 | 350 × 5.0 | 60 | 0.5 | 78 | 21,300 | |
| Ex. 25 | 43 | Ag 2.0 | 450 × 1.5 | 60 | 0.5 | 78 | 22,400 | |
| Ex. 26 | 43 | Ag 2.0 | 500 × 0.4 | 60 | 0.5 | 78 | 20,900 | |
| Ex. 27 | 44 | Ag 2.0 | 350 × 5.0 | 60 | 0.6 | 78 | 25,000 | |
| Ex. 28 | 44 | Ag 2.0 | 450 × 1.5 | 60 | 0.6 | 78 | 23,900 | |
| Ex. 29 | 44 | Ag 2.0 | 500 × 0.4 | 60 | 0.6 | 78 | 23,700 | |
| Ex. 30 | 45 | Ag 2.0 | 350 × 5.0 | 60 | 0.7 | 78 | 42,000 | |
| Ex. 31 | 45 | Ag 2.0 | 450 × 1.5 | 60 | 0.7 | 78 | 41,800 | |
| Ex. 32 | 45 | Ag 2.0 | 500 × 0.4 | 60 | 0.7 | 78 | 47,300 | |
| Ex. 33 | 46 | Ag 2.0 | 350 × 5.0 | 60 | 0.8 | 78 | 78,000 | |
| Ex. 34 | 46 | Ag 2.0 | 450 × 1.5 | 60 | 0.8 | 78 | 76,700 | |
| Ex. 35 | 46 | Ag 2.0 | 500 × 0.4 | 60 | 0.8 | 78 | 80,200 | |
| Ex. 36 | 47 | Ag 2.0 | 350 × 5.0 | 60 | 0.9 | 78 | | 96,000 |
| Ex. 37 | 47 | Ag 2.0 | 450 × 1.5 | 60 | 0.9 | 78 | | 83,500 |
| Ex. 38 | 47 | Ag 2.0 | 500 × 0.4 | 117 | 0.9 | 78 | | 79,800 |
| Ex. 39 | 48 | Ag 2.0 | 350 × 5.0 | 118 | 1.1 | 78 | | 78,000 |
| Ex. 40 | 48 | Ag 2.0 | 450 × 1.5 | 118 | 1.1 | 78 | | 72,700 |
| Ex. 41 | 48 | Ag 2.0 | 500 × 0.4 | 117 | 1.1 | 78 | | 75,800 |
| Ex. 42 | 50 | Ag 2.0 | 350 × 5.0 | 118 | 1.5 | 78 | | 63,000 |
| Ex. 43 | 50 | Ag 2.0 | 450 × 1.5 | 118 | 1.5 | 78 | | 61,000 |
| Ex. 44 | 50 | Ag 2.0 | 500 × 0.4 | 117 | 1.5 | 78 | | 64,400 |
| Comp. 25 | 43 | Ag 2.0 | No treatment | 111 | 0.5 | 78 | 19,600 | |
| Comp. 26 | 43 | Ag 0.5 | 450 × 1.5 | 111 | 0.5 | 78 | 12,300 | |
| Comp. 27 | 43 | Ag 3.5 | 450 × 1.5 | 111 | 0.5 | 78 | 18,200 | |

TABLE 10-continued

| | Wire Size | Additive Metal Concentration | Heat Treatment | Capacitance (at 1 KHz) | Attenuation (10 MHz) | Characteristic Impedance (10 MHz) | Bending Life R = 2 mm | |
|---|---|---|---|---|---|---|---|---|
| | (AWG) | (weight %) | (° C. × sec.) | (pF/m) | (dB/m) | (Ω) | W = 50 g | W = 20 g |
| Comp. 28 | 43 | Ag 2.0 | 250 × 5.0 | 110 | 0.5 | 78 | 20,600 | |
| Comp. 29 | 43 | Ag 2.0 | 600 × 0.2 | 111 | 0.5 | 78 | 12,400 | |
| Comp. 30 | 43 | Ag 2.0 | 450 × 0.1 | 111 | 0.5 | 78 | 18,800 | |
| Comp. 31 | 43 | Ag 2.0 | 450 × 6.0 | 111 | 0.5 | 78 | 9,300 | |
| Cnvv. 7 | 43 | Sn 0.3 | No treatment | 110 | 0.5 | 78 | 16,500 | |
| Cnvv. 8 | 43 | Sn 0.3 | 350 × 5.0 | 110 | 0.5 | 78 | 12,400 | |
| Cnvv. 9 | 43 | Sn 0.3 | 450 × 1.5 | 110 | 0.5 | 78 | 11,900 | |
| Cnvv. 10 | 43 | Sn 0.3 | 500 × 0.4 | 110 | 0.5 | 78 | 12,300 | |
| Comp. 32 | 42 | Sn 0.19 In 0.19 | 350 × 5.0 | 109 | 0.5 | 78 | 14,200 *(13,400) | |
| Comp. 33 | 42 | Sn 0.19 In 0.19 | 450 × 1.5 | 110 | 0.5 | 78 | 15,400 *(13,800) | |
| Comp. 34 | 42 | Sn 0.19 In 0.19 | 500 × 0.4 | 109 | 0.5 | 78 | 14,800 *(12,800) | |
| Comp. 35 | 44 | Sn 0.19 In 0.19 | 350 × 5.0 | 110 | 0.7 | 78 | 18,600 *(18,300) | |
| Comp. 36 | 44 | Sn 0.19 In 0.19 | 450 × 1.5 | 109 | 0.7 | 78 | 17,800 *(17,400) | |
| Comp. 37 | 44 | Sn 0.19 In 0.19 | 500 × 0.4 | 110 | 0.7 | 78 | 16,600 *(16,200) | |
| Comp. 38 | 46 | Sn 0.19 In 0.19 | 350 × 5.0 | 115 | 0.9 | 78 | 58,500 *(48,900) | |
| Comp. 39 | 46 | Sn 0.19 In 0.19 | 450 × 1.5 | 116 | 0.9 | 78 | 52,300 *(44,500) | |
| Comp. 40 | 46 | Sn 0.19 In 0.19 | 500 × 0.4 | 114 | 0.9 | 78 | 57,200 *(46,500) | |
| Comp. 41 | 48 | Sn 0.19 In 0.19 | 350 × 5.0 | 117 | 1.2 | 78 | | 68,200 *(55,000) |
| Comp. 42 | 48 | Sn 0.19 In 0.19 | 450 × 1.5 | 118 | 1.2 | 78 | | 62,600 *(56,000) |
| Comp. 43 | 48 | Sn 0.19 In 0.19 | 500 × 0.4 | 118 | 1.2 | 78 | | 64,300 *(54,800) |
| Comp. 44 | 50 | Sn 0.19 In 0.19 | 350 × 5.0 | 117 | 1.6 | 78 | | 46,000 *(37,800) |
| Comp. 45 | 50 | Sn 0.19 In 0.19 | 450 × 1.5 | 118 | 1.6 | 78 | | 48,000 *(34,800) |
| Comp. 46 | 50 | Sn 0.19 In 0.19 | 500 × 0.4 | 118 | 1.6 | 78 | | 43,000 *(33,800) |

*Figures shown in parentheses represent bending life before heating.

As shown in Table 10, the bending life of the coaxial cables in Examples 24 to 26 (43 AWG) was 20900 times or more, while Comparative Examples 25 to 31 (43 AWG) and Conventional Examples 7 to 10 (43 AWG) were respectively 19600, 12300, 18200, 20600, 12400, 18800, 9300, 16500, 12400, 11900, and 12300 times. Therefore, it is recognized that the coaxial cables in Examples 24 to 26 comprise a long bending life and an good bending characteristic.

Further, comparing the coaxial cables in Examples 27 to 44 and the cables in Comparative Examples 35 to 46, the cables comprising an identical wire size, it is recognized that the coaxial cables in Examples comprise the bending life longer than and the bending characteristic superior to the coaxial cables in Comparative Examples.

Also, from the result shown in Table 10 it could be confirmed that the coaxial cables in Examples 24 to 44 maintain the capacitance and the characteristic impedance equal to those of the cables in Comparative Examples and Conventional Examples. As to the attenuation at the frequency of 10 MHz, it could be confirmed that the coaxial cables in Examples maintain an attenuation characteristic similar to or more than that of the cables in Comparative Examples and Conventional Examples comprising an identical wire size.

Particularly, as to the bending life and the attenuation, comparing the coaxial cables (43 AWG) in Examples 24 to 26 with the coaxial cable (42 AWG) in Comparative Example 32, it can be evaluated that the cables in Examples 24 to 26 comprise the bending life longer than and the attenuation equal to the cable in Comparative Example 32.

Further, as to the tensile strength and the electric resistance, referring to Table 9 and comparing the in Examples 3 to 5 with the cable in Comparative Example 10, it can be evaluated that the cables in Examples 24 to 26 comprise the tensile strength superior to and the electric resistance equal to the cable in Comparative Example 32.

To sum up, according to Examples of the invention, even if the coaxial cable was downsized by one size according to requirements of customers, a coaxial cable can be provided, the cable comprising the electric characteristics (the central conductor resistance, the attenuation) equal to and the bending characteristic (the tensile strength) higher than the cables in Comparative Examples comprising a wire diameter thicker by one size than the cables in the Examples.

Other Embodiments

As an additive element to the copper alloy, one or two kind(s) of metal(s) selected from magnesium (Mg) and indium (In) other than silver (Ag) can be added by total amount of 0.02 to 0.10 weight %. Increase of the additive element leads to increase of a production cost, but it is expected that the strength can be further enhanced.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An extra-fine copper alloy wire, comprising:

a wire diameter of 0.010 to 0.025 mm;

1 to 3 weight % of silver (Ag), and a balance consisting copper (Co) and an inevitable impurity;

a tensile strength of not less than 850 MPa;

an electrical conductivity of not less than 85% IACS;

an elongation of 0.5 to 3.0%; and a lowering rate in tensile strength of not more than 2%, the lowering rate being represented by $[(1-\sigma_{h1}/\sigma_{h0})\times 100\%]$ where $\sigma_{h1}$ is a tensile strength of the wire measured after a heat treatment under conditions of a heating temperature of not more than 350° C. and a heating time of not more than 5 seconds, and $\sigma_{h0}$ is a tensile strength of the wire measured before the heat treatment.

2. The extra-fine copper alloy wire according to claim 1, further comprising:

a plated layer comprising tin (Sn), silver (Ag) or nickel (Ni) and formed on a surface of the extra-fine copper alloy wire.

3. An extra-fine copper alloy twisted wire, comprising:

a plurality of the extra-fine copper alloy wires according to claim 1 twisted together.

4. The extra-fine copper alloy twisted wire according to claim 3, wherein:

the plurality of the extra-fine copper alloy wires comprise the seven extra-fine copper alloy wires with a wire diameter of 0.025 mm, and the twisted wire comprises an electric resistance of not more than 6000 Ω/km at 20° C.

5. The extra-fine copper alloy twisted wire according to claim 3, wherein:

the plurality of the extra-fine copper alloy wires comprise the seven extra-fine copper alloy wires with a wire diameter of 0.023 mm, and the twisted wire comprises an electric resistance of not more than 7000 Ω/km at 20° C.

6. The extra-fine copper alloy twisted wire according to claim 3, wherein:

the plurality of the extra-fine copper alloy wires comprise the seven extra-fine copper alloy wires with a wire diameter of 0.020 mm, and the twisted wire comprises an electric resistance of not more than 9500 Ω/km at 20° C.

7. The extra-fine copper alloy twisted wire according to claim 3, wherein:

the plurality of the extra-fine copper alloy wires comprise the seven extra-fine copper alloy wires with a wire diameter of 0.018 mm, and the twisted wire comprises an electric resistance of not more than 11500 Ω/km at 20° C.

8. The extra-fine copper alloy twisted wire according to claim 3, wherein:

the plurality of the extra-fine copper alloy wires comprise the seven extra-fine copper alloy wires with a wire diameter of 0.016 mm, and the twisted wire comprises an electric resistance of not more than 15000 Ω/km at 20° C.

9. The extra-fine copper alloy twisted wire according to claim 3, wherein:

the plurality of the extra-fine copper alloy wires comprise the seven extra-fine copper alloy wires with a wire diameter of 0.013 mm, and the twisted wire comprises an electric resistance of not more than 22000 Ω/km at 20° C.

10. The extra-fine copper alloy twisted wire according to claim 3, wherein:

the plurality of the extra-fine copper alloy wires comprise the seven extra-fine copper alloy wires with a wire diameter of 0.010 mm, and the twisted wire comprises an electric resistance of not more than 38000 Ω/km at 20° C.

11. A coaxial cable, comprising:

a central conductor comprising a plurality of the extra-fine copper alloy wires according to claim 1 twisted together;

an insulation cover formed on an outer circumference of the central conductor;

an outer conductor comprising a copper or a copper alloy formed on an outer circumference of the insulation cover; and a jacket layer formed on an outer circumference of the outer conductor.

12. A multicore cable, comprising:

a shield layer;

a plurality of the coaxial cables according to claim 11 disposed in the shield layer; and a sheath formed on an outer circumference of the shield layer.

13. A method of making an extra-fine copper alloy wire, comprising the steps of:

adding 1 to 3 weight % of silver to a pure copper so as to produce a copper alloy;

conducting a wire drawing work to the copper alloy to form an extra-fine copper alloy wire with a wire diameter of 0.010 to 0.025 mm; and conducting a heat treatment to the extra-fine copper alloy wire at a temperature of 300 to 500° C. for 0.2 to 5 seconds such that the extra-fine copper alloy wire comprises a tensile strength of 850 MPa or more, an electrical conductivity of 85% IACS or more, an elongation of 0.5 to 3.0%, and a lowering rate in tensile strength of not more than 2%, the lowering rate being represented by $[(1-\sigma_{h1}/\sigma_{h0})\times 100\%]$ where $\sigma_{h1}$ is a tensile strength of the wire measured after a test heat treatment under conditions of a heating temperature of not more than 350° C. and a heating time of not more than 5 seconds, and $\sigma_{h0}$ is a tensile strength of the wire measured the test heat treatment.

14. The method of making the extra-fine copper alloy wire according to claim 13, further comprising the step of:

after forming the extra-fine wire with a wire diameter of 0.010 to 0.025 mm, forming a plated layer formed of tin (Sn), silver (Ag) or nickel (Ni) on a surface of the extra-fine copper alloy wire.

15. A method of an extra-fine copper alloy twisted wire, comprising the steps of:

adding 1 to 3 weight % of silver to produce a copper alloy;

conducting a wire drawing work to the copper alloy to form an extra-fine copper alloy wire with a wire diameter of 0.010 to 0.025 mm;

twisting a plurality of the extra-fine copper alloy wires together to form an extra-fine copper alloy twisted wire; and conducting a heat treatment to the twisted wire at a temperature of 300 to 500° C. for 0.2 to 5 seconds.

16. A method of making an extra-fine insulated wire, comprising the steps of:

adding 1 to 3 weight % of silver to a pure copper to produce a copper alloy;

conducting a wire drawing work to the copper alloy to form an extra-fine copper alloy wire comprising a wire diameter of 0.010 to 0.025 mm;

twisting a plurality of the extra-fine copper alloy wires together to obtain an extra-fine copper alloy twisted wire;

conducting a heat treatment the twisted wire at a temperature of 300 to 500° C. for 0.2 to 5 seconds; and forming a solid insulation comprising a thickness of not more than 0.07 mm on an outer circumference of the extra-fine copper alloy twisted wire.

17. A method of making a coaxial cable, comprising the steps of:

adding 1 to 3 weight % of silver to a pure copper to produce a copper alloy;

conducting a wire drawing work to the copper alloy to form an extra-fine wire comprising a wire diameter of 0.010 to 0.025 mm;

twisting a plurality of the extra-fine copper alloy wires together to obtain an extra-fine copper alloy twisted wire;

conducting a heat treatment to the twisted wire at a temperature of 300 to 500° C. for 0.2 to 5 seconds;

forming a solid insulation comprising a thickness of not more than 0.07 mm on an outer circumference of the extra-fine copper alloy twisted wire to obtain an extra-fine insulated wire;

winding a plurality of conductor wires on an outer circumference of the extra-fine insulated wire along a longitudinal direction thereof in a spiral form to form an outer conductor; and forming a jacket layer on a surface of the outer conductor.

18. A method of making a coaxial cable, comprising the steps of:

adding 1 to 3 weight % of silver to a pure copper to produce a copper alloy;

conducting a wire drawing work to the copper alloy to form an extra-fine wire comprising a wire diameter of 0.010 to 0.025 mm;

twisting a plurality of the extra-fine copper alloy wires together to obtain an extra-fine copper alloy twisted wire;

conducting a heat treatment to the twisted wire at a temperature of 300 to 500° C. for 0.2 to 5 seconds;

forming a foamed insulation comprising a thickness of not more than 0.28 mm on an outer circumference of the extra-fine copper alloy twisted wire;

forming a skin layer on an outer circumference of the foamed insulation;

winding a plurality of conductor wires on an outer circumference of the skin layer along a longitudinal direction of the extra-fine copper alloy twisted wire in a spiral form to form an outer conductor; and forming a jacket layer on a surface of the outer conductor.

* * * * *